US006164091A

United States Patent [19]

Frullini et al.

[11] Patent Number: 6,164,091

[45] Date of Patent: Dec. 26, 2000

[54] METHOD AND APPARATUS FOR SEAMING EDGES OF KNITTED ARTICLES

[75] Inventors: Paolo Frullini; Alberto Frullini, both of Florence, Italy

[73] Assignees: Fabritex S.R.L.; Sagiacomo S.P.A., both of Italy

[21] Appl. No.: 09/253,403

[22] Filed: Feb. 19, 1999

[30] Foreign Application Priority Data

Feb. 20, 1998 [IT] Italy ..... FI98A0039

[51] Int. Cl.[7] ..... D04B 9/40

[52] U.S. Cl. ..... 66/148; 66/58

[58] Field of Search ..... 66/147, 148, 8, 66/13, 14, 17, 18, 58, 59

[56] References Cited

U.S. PATENT DOCUMENTS

| | | | |
|---|---|---|---|
| 5,551,260 | 9/1996 | Frullini et al. | 66/148 |
| 5,570,591 | 11/1996 | Frullini et al. | 66/148 |
| 5,617,744 | 4/1997 | Conti | 66/148 |
| 5,727,400 | 3/1998 | Lonati et al. | 66/148 |
| 5,761,931 | 6/1998 | Lonati et al. | 66/148 |

FOREIGN PATENT DOCUMENTS

| | | |
|---|---|---|
| 0 592 376 B1 | 4/1994 | European Pat. Off. . |
| 0 635 593 B1 | 1/1995 | European Pat. Off. . |
| WO 97/20089 | 6/1997 | WIPO . |

*Primary Examiner*—Larry Worrell
*Attorney, Agent, or Firm*—McGlew and Tuttle, P.C.

[57] ABSTRACT

Operational method for seaming the edges of a tubular knitted article (C) comprising the preliminary steps of knitting the article in a knitting station (T), removing the stitches of the last knitted rank with stitches-removing means mounted on a first unit movable between said station (T) and a hook-up station (R), overturning through 180° the first semirank of stitches about an axis which virtually subdivides the last knitted rank into said first and second semiranks so as to dispose the thus overturned stitches in correspondence of the stitches of the other semirank, hooking-up the thus disposed stitches of the first and second semiranks, characterized in that it comprises, following the step for the removal of the stitches of the last knitted rank, the transfer of the stitches of at least one semirank onto means other than those which operate the above said removal, said transfer means supporting the stitches of said at least one semirank during said overturning step.

19 Claims, 73 Drawing Sheets

8

METHOD AND APPARATUS FOR SEAMING EDGES OF KNITTED ARTICLES

FIELD OF THE INVENTION

The present invention refers to a method and an apparatus for seaming edges of knitted articles, especially tubular articles such as stockings.

It is known to produce stockings by means of one-cylinder or two-cylinder circular machines which may use a single or a double front of knitting or stitch-forming needles, the knitting on said machines starting conventionally from the side of the edge or hem, to end up on the side of the toe which remains open, and with the stitches of the last rank fitted over the respective forming needles.

BACKGROUND OF THE INVENTION

In order to close the toe of the thus produced tubular operational methods are known, disclosed in the documents EP 635593, EP 592376 and WO 97/20089, according to which each article is driven in such a way as to dispose, the homologous stitches of the two semiranks, into which the last knitted rank can be virtually subdivided, in a corresponding relationship allowing the sewing or hooking-up thereof afterwards by means of the devices provided either in the knitting station, that is, in correspondence of the textile machine of the machine, or in a separate knitting or hooking-up station.

However, the machines operating according to the operational techniques known at present may exhibit such drawbacks consisting mainly in their mechanical and structural complexity and in the impossibility of practically treating articles characterized by a very high fineness.

Also known are manual processes for closing the toe of tubular articles such as stockings, according to which each stocking is manually fed to a seaming or hooking-up machine which provides for joining the two facing edges of the toe portion of the articles. It is to be pointed out on this regard that the manual seaming and hooking-up imply excessive times and costs with respect to the current manufacturing requirements.

SUMMARY AND OBJECTS OF THE INVENTION

The main object of the present invention is to overcome the said drawbacks.

According to the invention, a method is provided for seaming edges of a tubular knitted article. The method includes knitting the article in a knitting station to provide a knitted article with the last knitted rank. The stitches of the last knitted rank are removed with a stitches-removing device, which is mounted on a first unit movable between the knitting station and a hook-up station. After the step of removing stitches of the last knitted rank, the stitches of at least one semirank are transferred onto a transfer device, the transfer device being something other than the stitches-removing device. The first semirank of stitches is then overturned through 180° about an axis which virtually subdivides the last knitted rank into the first semirank and second semirank. This disposes the overturn first semirank of stitches in correspondence of the stitches of the second semirank. The stitches are supported during the overturning step with the transferring device. The thus disposed overturned semirank of stitches and correspondence of the stitches of the second semirank are then hooked-up at the hooking-up station.

According to another aspect of the invention an apparatus for seaming the edges of a tubular knitted article is provided based on a knitting station with a circular machine and a hooking-up station. A first movable unit is also provided. A stitch removal device is provided which removes the last knitted rank of stitches. A stitch removal device is movable between the knitting station and the hooking-up station.

A transferring device is also provided which receives or transfers the stitches of at least one semirank and overturns the at least one semirank of stitches through 180° about an axis which virtually subdivides the last knitted rank into a first semirank of stitches and a second semirank of stitches. A stitch support is provided for supporting the stitches of the first and second semiranks thus disposed for the hooking-up thereof.

The advantages deriving from the present invention lie essentially in that it is possible to automatically seam the end edges of the article, for example, the closing of the toe of a stocking, both on one-cylinder and two-cylinder machines, by removing them from needles of any type and shape, both on the inner side and external side of the article, thereby reducing to a minimum the dwells of the members provided for the knitting of articles upon the step of joining the concerned edges, and increasing the production capacity of each working station.

A further advantage derives from the simplification of the mechanical structure and the interaction between the members provided for handling the stitches, with respect to the machines known at present.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DESCRIPTION OF THE PREFERRED EMBODIMENTS

Figure 1:
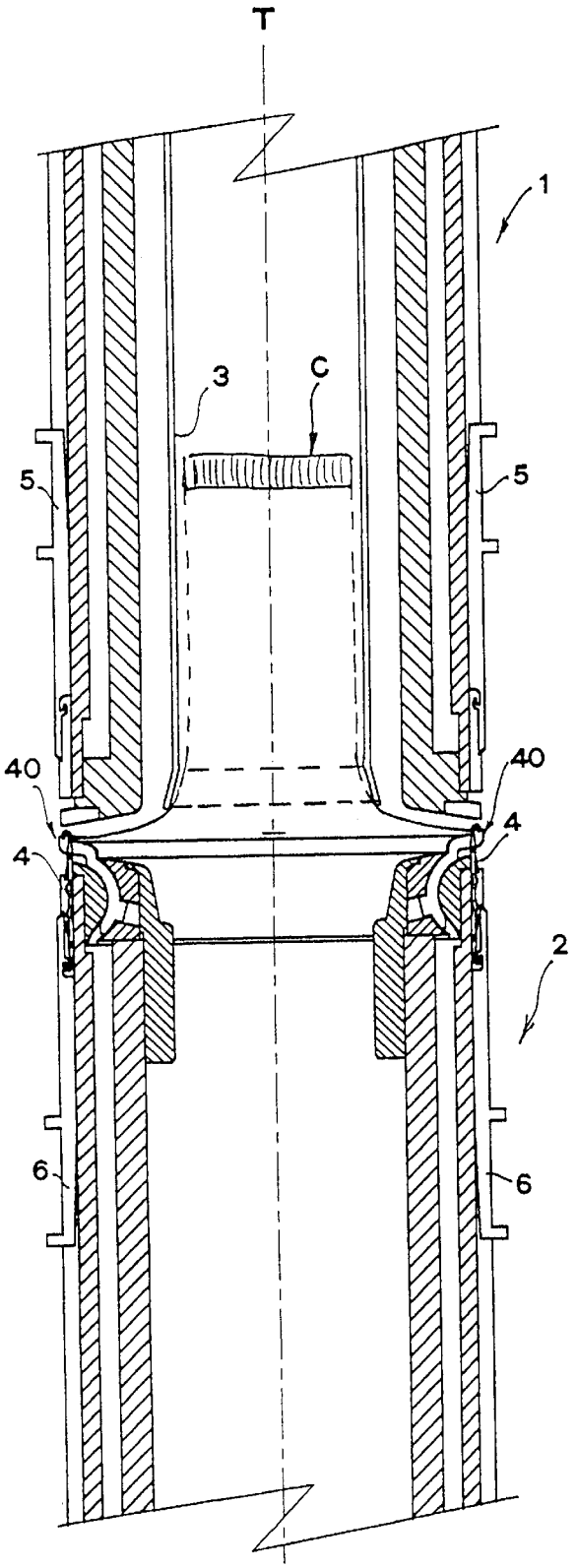
FIGS. 1–15, to be described in greater detail later on, relate to a first example of implementation of the operational method according to the invention.

Reduced to its basic structure, a method according to the invention, applied to the manufacturing of tubular articles such as stockings, comprises the preliminary knitting of the article on a one-cylinder or two-cylinder knit circular machine, starting from the side of the edge or hem and finishing with the formation of the portion corresponding to the toe in open condition, that is, with the stitches of the last rank fitted on the respective knitting or forming needles at the end of said preliminary step. Subsequently to the knitting of the article, provision is made for the following steps:

a) positioning, in correspondence of the machine's textile head, first means able to remove and hold the stitches of the last knitted rank;

b) transferring the article, with the stitches of the last rank removed and held from said first means, outside the machine's textile head used for knitting the article;

c) transferring the stitches of the first semirank onto second means intended to overturn said stitches of the first semirank about an axis (m—m) with respect to which the first rank of stitches is subdivided into a first and second semiranks;

d) transferring the stitches of the second semirank onto third means intended to support the stitches of both first and second semirank in a subsequent step for the hooking-up thereof;

e) overturning through 180° the stitches of the first semirank about the said axis (m—m) so that, at the end of this step, each stitch of the first semirank will result coaxially positioned with respect to a corresponding stitch of the second semirank;

f) transferring the thus overturned stitches of the first semirank onto said third means supporting the stitches of the second semirank, so that the stitches of the first semirank will result properly juxtaposed to the corresponding or homologous ones of the second rank;

g) operating the hooking-up of the stitches fitted onto said support means to carry out the union of the article edges corresponding to said first and second semiranks of stitches of the last knitted rank;

h) releasing the article, with the thus joined stitches of the last rank, form said third means;

i) turning the article inside out and moving it away from the hooking-up station.

It is understood that the said article-eversion step i) may be omitted, so that the article will result with the hooked-up part oriented toward its outer side, in a condition, whether of right-side out or inside out character, taken up the moment the same article is rejected from the hooking-up station.

It is deemed useful to pint out that for machine's textile head it is meant the assembly of members, known to those skilled in the art, provided for the formation of the stitches in cooperation with the needles of the cylinder(s) of a one-cylinder or two-cylinder machine. Moreover, it is stressed that the stitches of said first and second semirank of the last knitted rank correspond, respectively, to a first and a second series of contiguous needles, each series comprising a preset number of stitch-forming needles.

According to an alternative embodiment, an operational method according to the invention comprises—after the formation of the tubular article with open toe and stitches of the last knitted rank subdivided into a first and second semiranks—the following steps:

aa) positioning, in correspondence of the machine's textile head, first means able to remove and hold the stitches of the last rank;

bb) transferring the article, with the thus removed and held stitches outside the textile head of the circular machine;

cc) transferring the stitches of the first semirank onto second means intended to temporary holding them;

dd) transferring the stitches of the first semirank onto third means able to operate the overturning thereof, that is, the rotation through 180° about an axis (m—m) with respect to which the last rank of stitches is subdivided into said first and second semiranks, and also able to support the stitches in a successive hooking-up step;

ee) turning the article inside out;

ff) overturning through 180° the stitches of the first semirank about said axis (m—m);

gg) transferring the stitches of the second semirank onto said means provided for overturning the stitches of the first semirank, so that the corresponding or homologous stitches of the first and second semiranks will result coaxially juxtaposed;

hh) operating the hooking-up of the thus disposed stitches of the first and second semiranks;

ii) releasing the article from the means supporting the stitches being hooked-up;

ll) everting again the article and moving it away from the hooking-up station.

The said step ll) may be omitted as in the preceding case.

Moreover, step ee) may be carried out at any moment, also prior to step aa) but, however, before overturning the stitches of the first semirank.

It is understood that, after moving the article out of the machine's textile head, it is possible to start the knitting of the next article.

By taking into account the fact that the knitting of the tubular article may be performed both on one-cylinder and two-cylinder circular machines, the fact that the final hooking-up may be performed both on the outer and inner side of the article, the fact that, usually, in two-cylinder machines, the lower cylinder produces the plain stitch and the upper cylinder produces the inverted stitch, the fact that, in two-cylinder machines, the knitting of the article may require housing the latter into the cavity of both the lower and upper cylinders, so that the article may be removed from the knitting station in a right-side out or respectively inside out condition, and the fact that, in the one-cylinder machines, the article is usually removed in right-side condition, the operating method according to the invention is able to be implemented in more different ways. The attached drawings are a synthetic representation of the cases corresponding to various modes of implementation of the method according to the invention.

CASE A

Machine: two-cylinder type.
Carried out steps: a) to i).
Stitches removal: from the lower cylinder.
Hooking-up side: external.
Condition of rejected article: turned inside out.

CASE B

Machine: two-cylinder type.
Carried out steps: a) to i).
Stitches removal: from the upper cylinder.
Hooking-up side: internal.
Condition of rejected article: right-side out.

CASE C

Machine: one-cylinder type.
Carried out steps: a) to i).
Stitches removal: from the only one cylinder present.
Hooking-up side: external.
Condition of rejected article: turned inside out.

CASE D

Machine: two-cylinder type.
Carried out steps: a) to h).
Stitches removal: from the lower cylinder.
Hooking-up side: external.
Condition of rejected article: right side out.

CASE E

Machine: two-cylinder type.
Carried out steps: a) to h).
Stitches removal: from the upper cylinder.
Hooking-up side: internal.
Condition of rejected article: turned inside out.

CASE F

Machine: one-cylinder type.
Carried out steps: a) to h).
Stitches removal: from the only one cylinder present.
Hooking-up side: external.
Condition of rejected article: right side out.

CASE G

Machine: two-cylinder type.
Carried out steps: aa) to ll).
Stitches removal: from the lower cylinder.
Hooking-up side: internal.
Condition of rejected article: right side out.

CASE H

Machine: two-cylinder type.
Carried out steps: aa) to ll).
Stitches removal: from the upper cylinder.
Hooking-up side: external.
Condition of rejected article: turned inside out.

CASE I

Machine: one-cylinder type.
Carried out steps: aa) to ll).
Stitches removal: from the only one cylinder present.
Hooking-up side: external.
Condition of rejected article: turned inside out.

CASE L

Machine: two-cylinder type.
Carried out steps: aa) to ii).
Stitches removal: from the lower cylinder.
Hooking-up side: internal.
Condition of rejected article: turned inside out.

CASE M

Machine: two-cylinder type.
Carried out steps: aa) to ii).
Stitches removal: from the upper cylinder.

Hooking-up side: external.
Condition of rejected article: right side out.

CASE N

Machine: one-cylinder type.
Carried out steps: aa) to ii).
Stitches removal: from the only one cylinder present.
Hooking-up side: internal.
Condition of rejected article: turned inside out.

The method according to the invention may be preferably carried out with reference to those cases which correspond to the ejection of the finished article in right side out condition and internal hooking-up. It is pointed out, however, that in case of external hooking-up, the finished product is of highest quality too.

Described below with reference to the FIGS. 1–15 of the attached drawings is a first example of embodiment of the invention, corresponding to the case B above indicated, that is, relevant to the manufacturing of a stocking knitted in the traditional way by means of a two-cylinder machine, starting from the hem or edge and finishing with the portion corresponding to the toe to be hooked-up on the internal side. It must be first pointed out that usually, in this type of machines, the stocking (C) is aspirated, during the knitting thereof, inside the upper cylinder (1) with the aid of a suction tube (3) coaxial to the machine's cylinders (1; 2), and that the knitting members such as needles, sliders and sinkers, are driven into motion by cam means or equivalent actuators acting on corresponding control surfaces or portions thereof.

Figure 2:
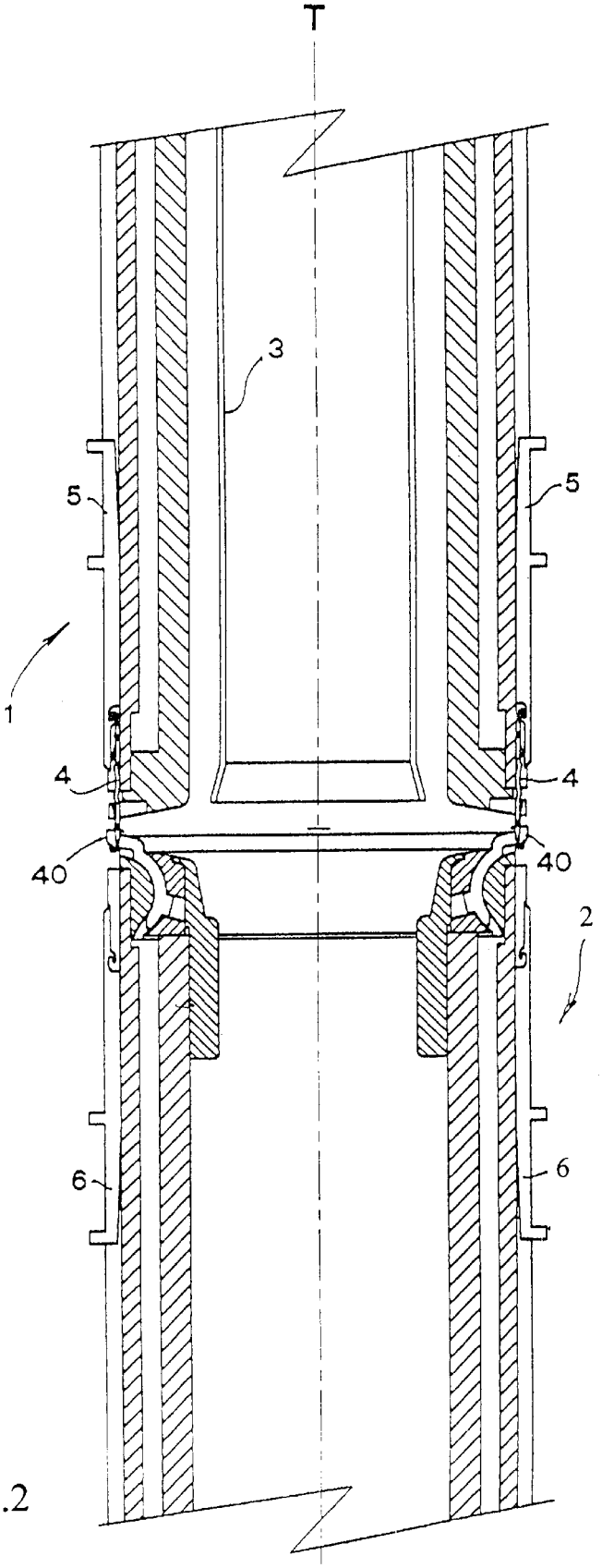
Figure 3:
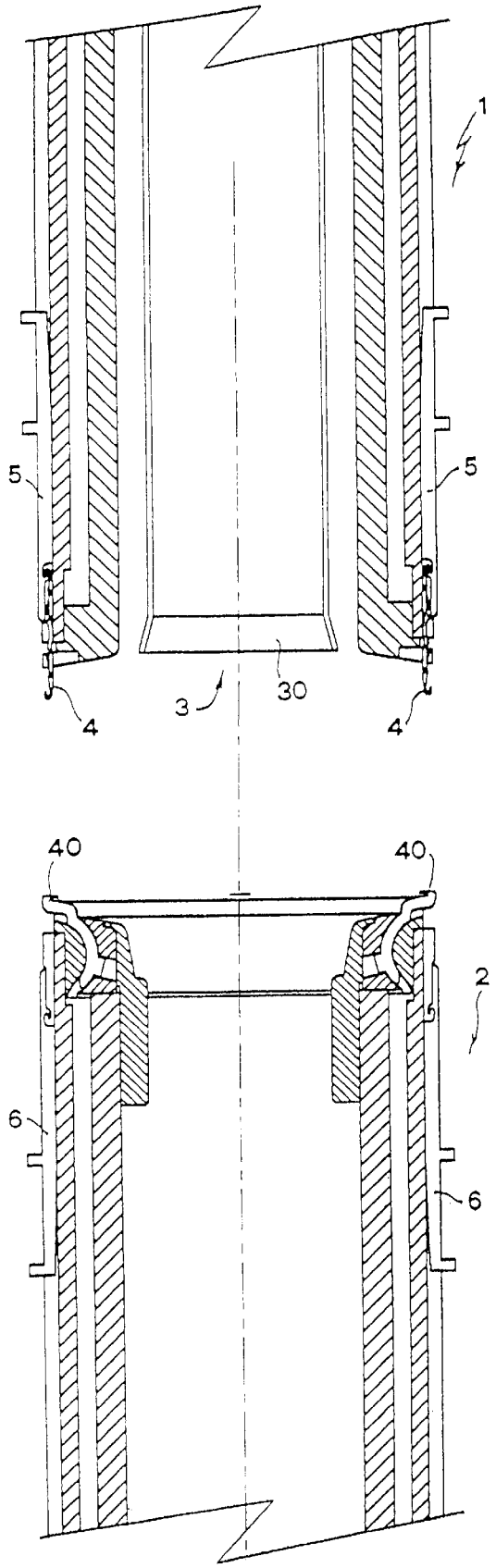
Figure 4:
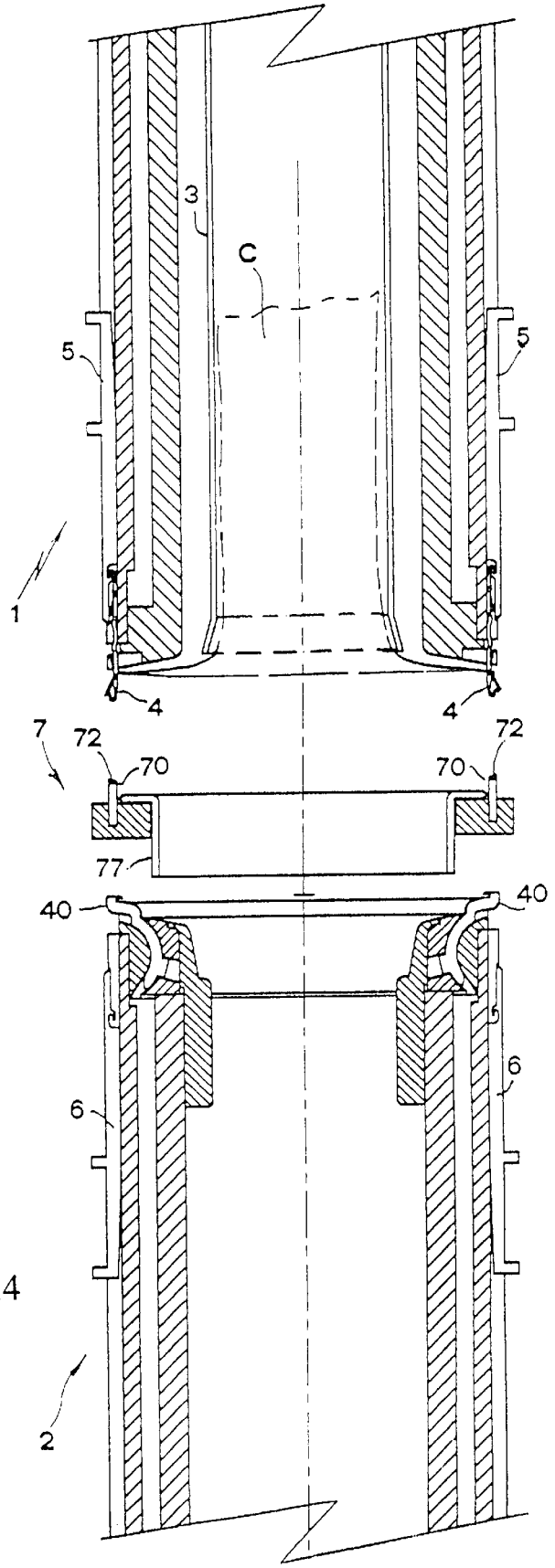
Figure 5:
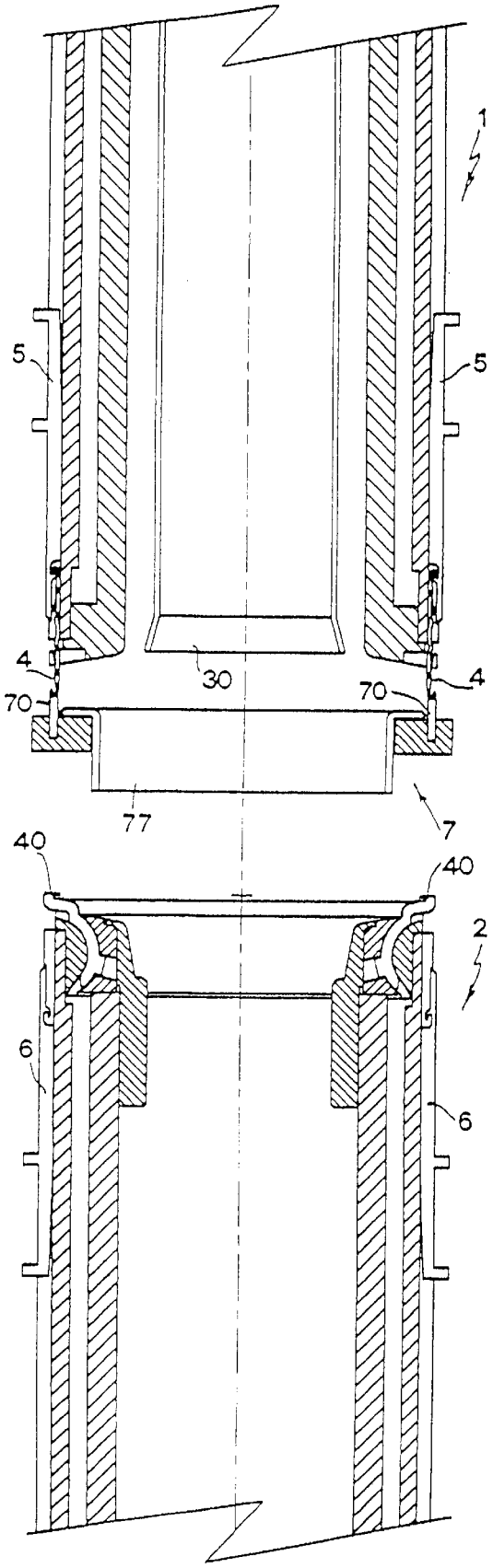
Figure 6:
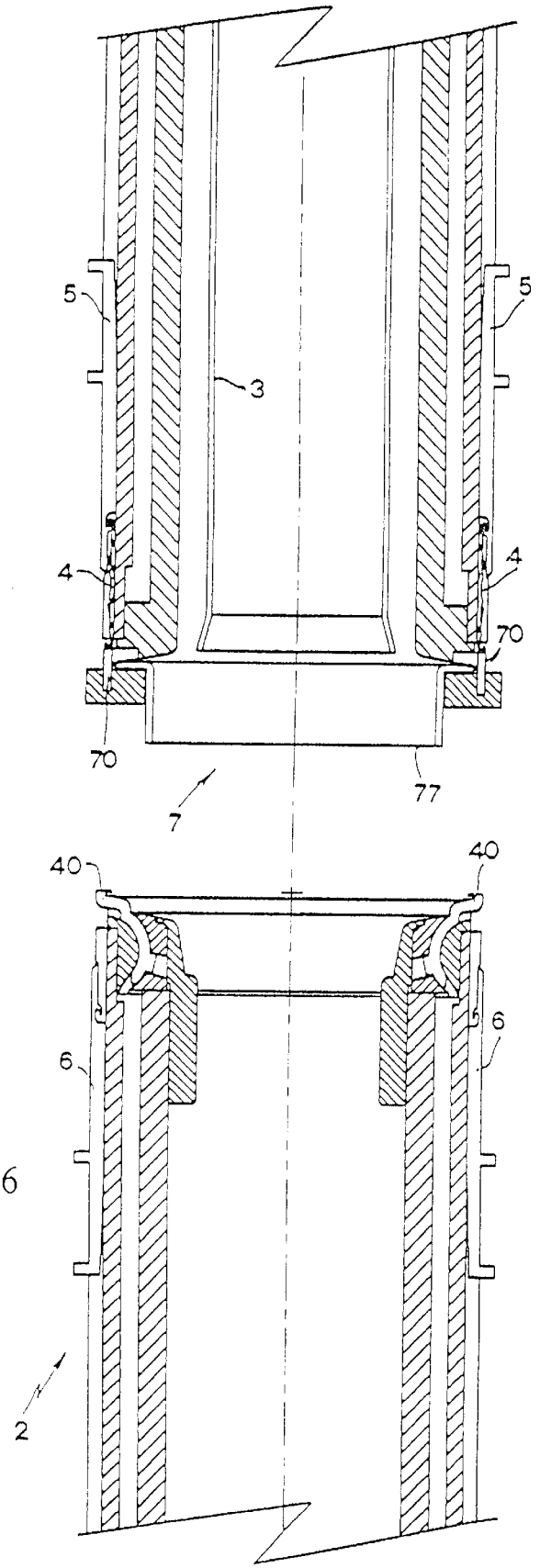
Figure 7:
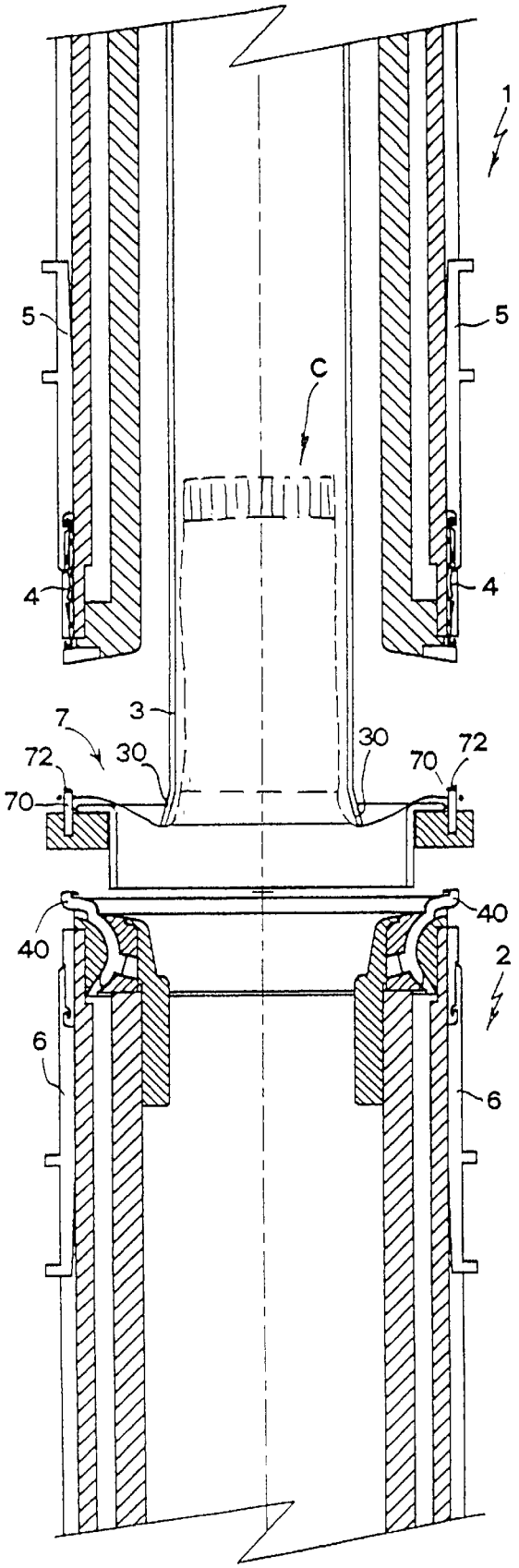
Figure 8:
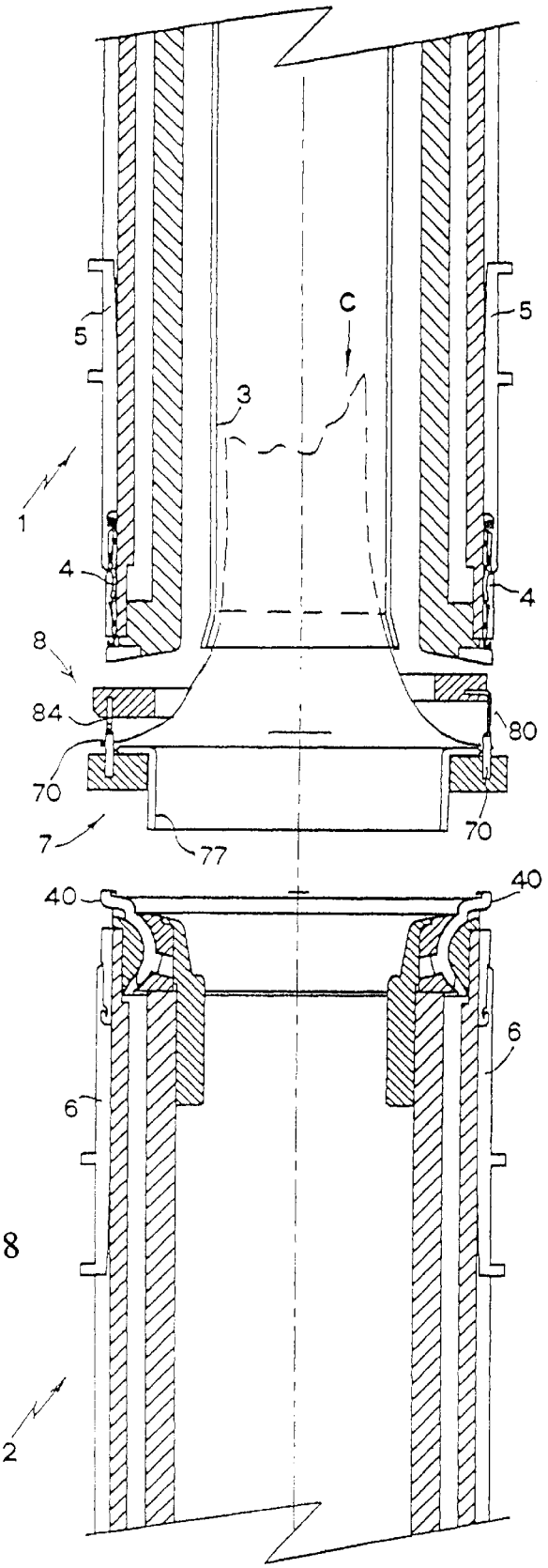
Figure 9:
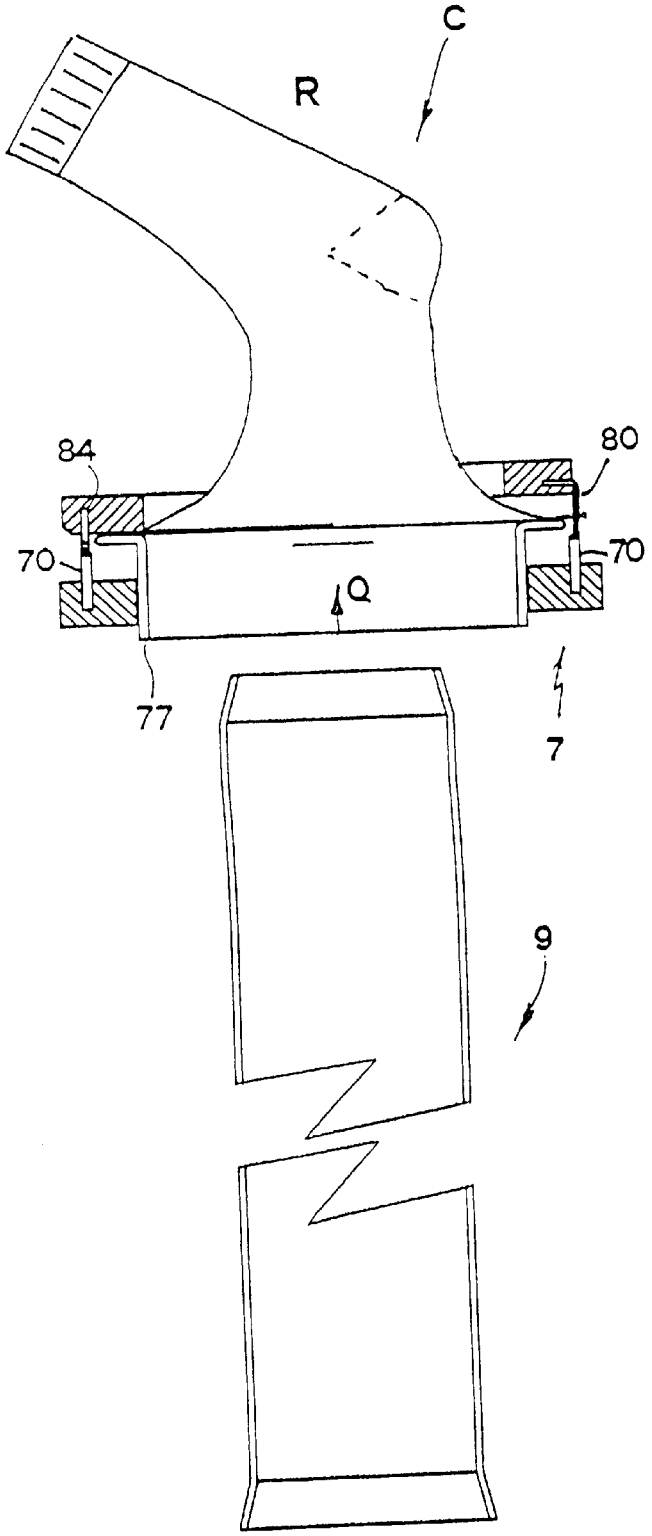
Figure 10:
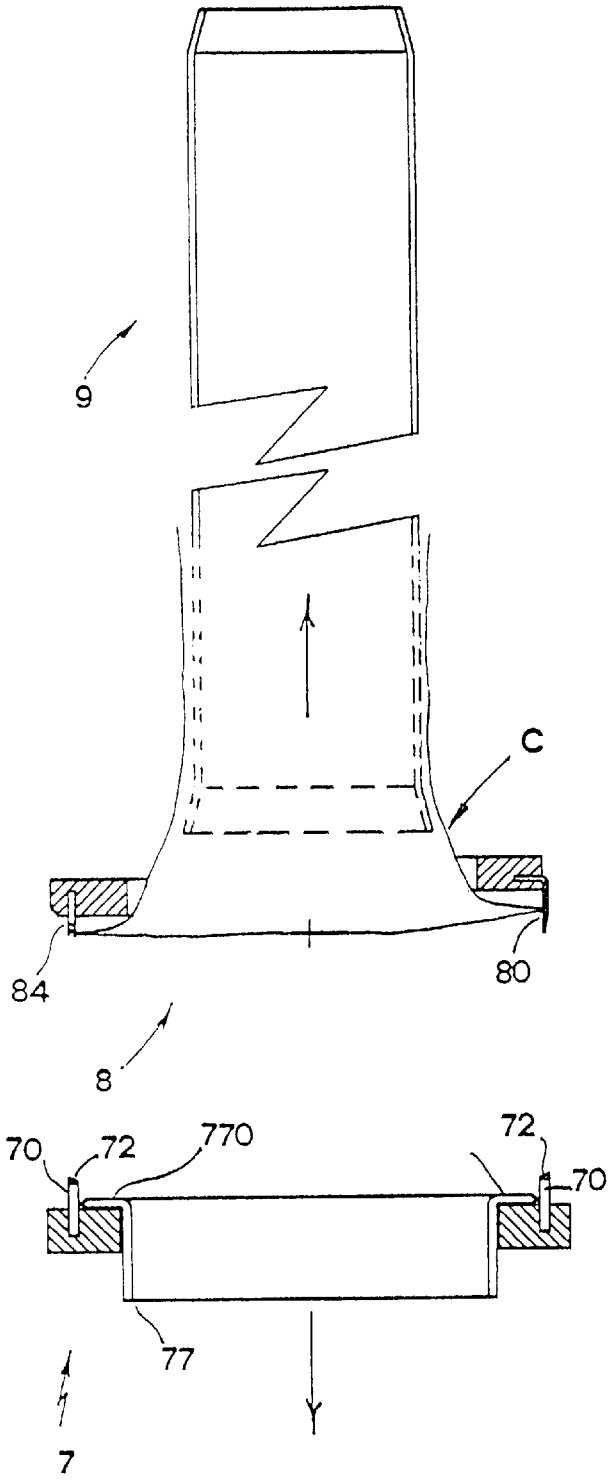
Figure 11:
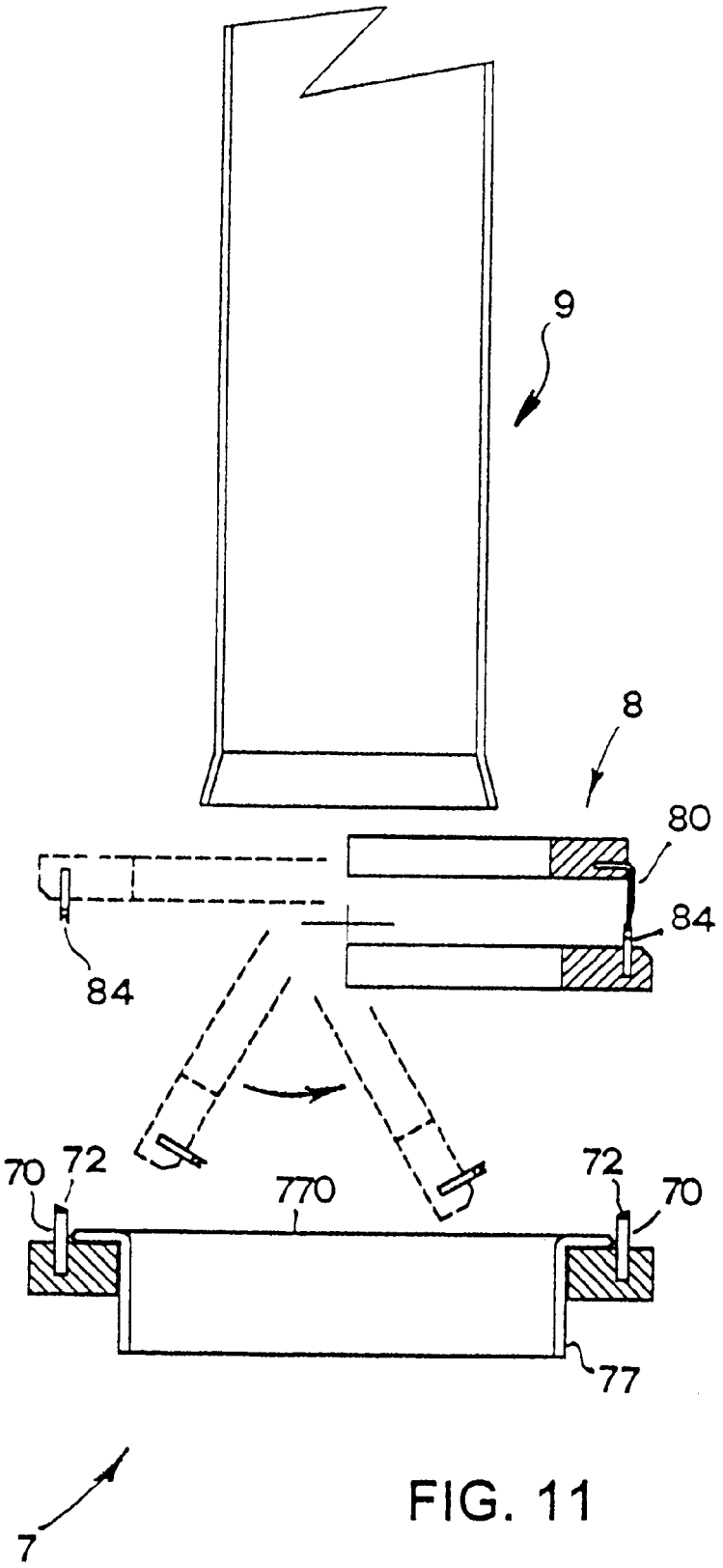
Figure 14:
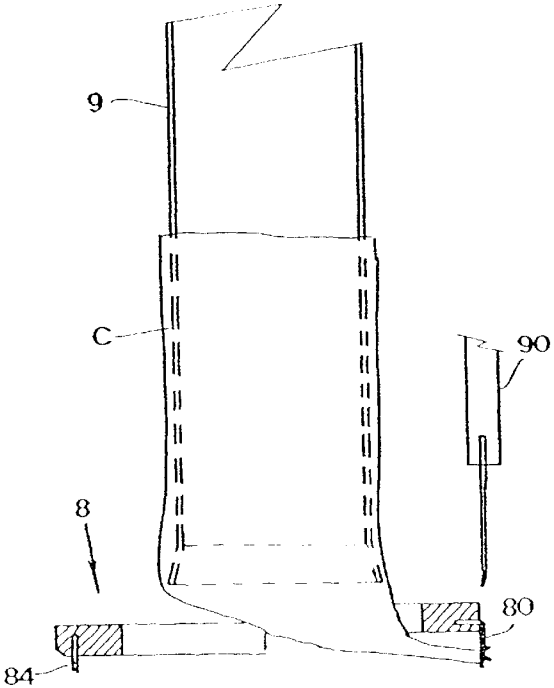
Figure 14:
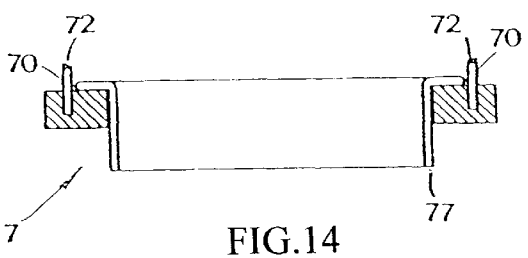
Figure 15:
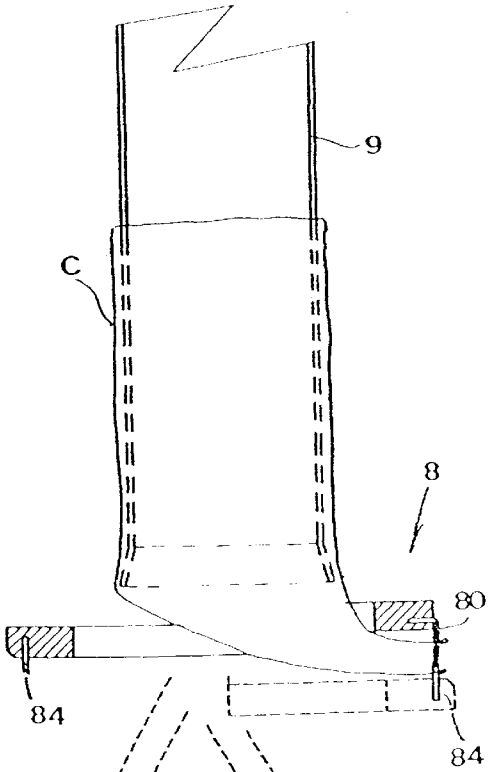
Figure 15:
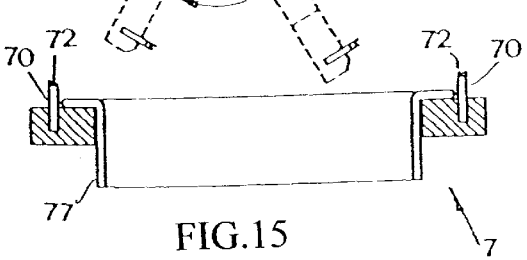
Figure 16:
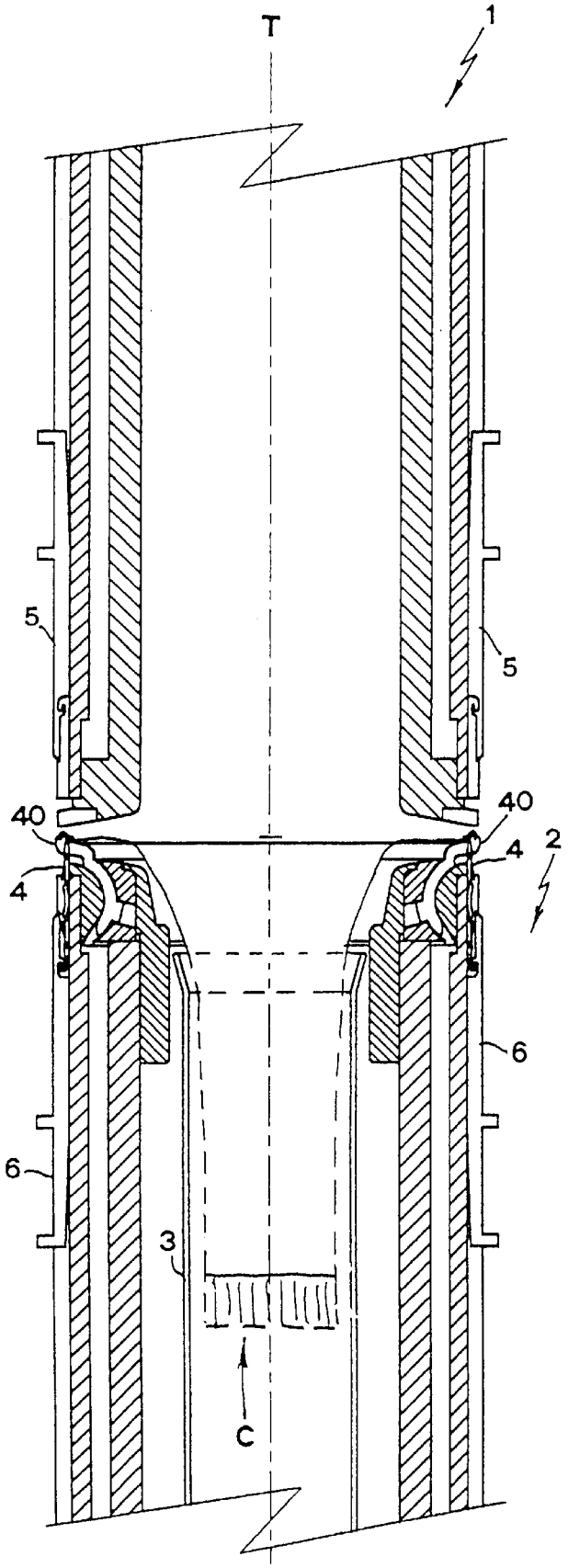
FIGS. 16–29 relate to a further example of implementation of the operational method according to the invention.
Figure 17:
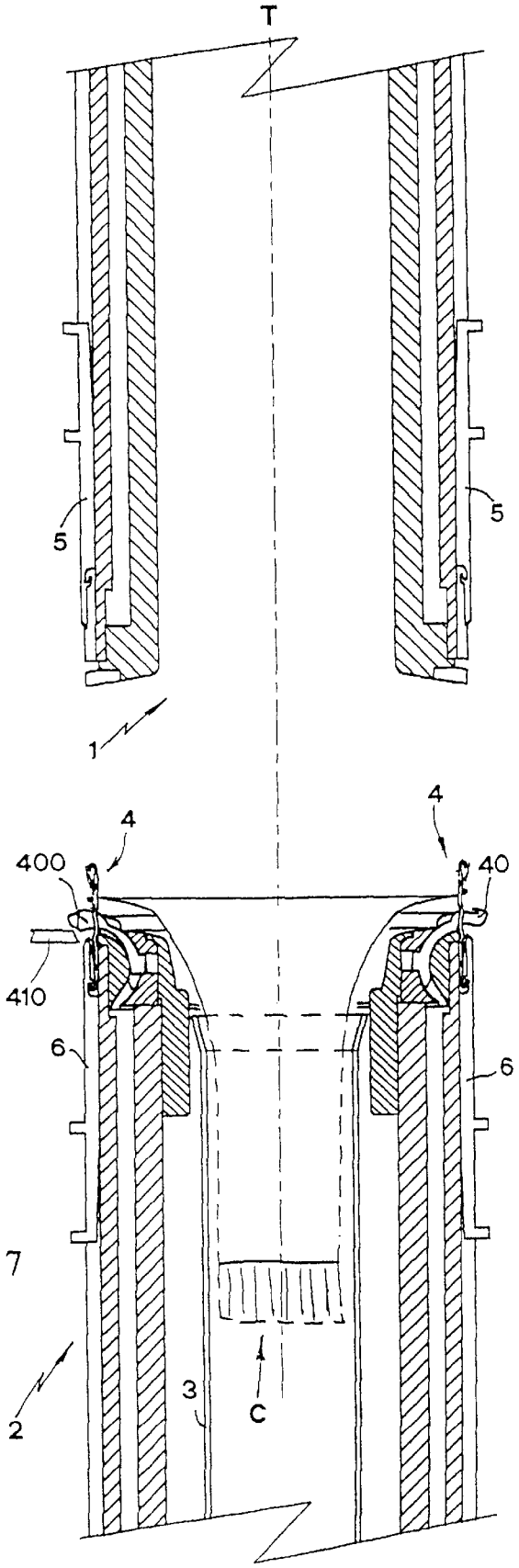

Upon completion of knitting, the stocking (C) (represented only in some of the figures of the accompanying drawings for the sake of clarity) results engaged to the needles (4) supported by the lower cylinder (2), said needles having thereon the stitches of the last rank (FIG. 1). Accordingly, provision is made for lifting the stitch-forming needles (4) firstly by means of the corresponding sinkers (40) disposed in closing condition to allow same stitches to take up the so-called "unloaded" position, that is, the position below the free end of the latch of said needles, and then by means of the sinkers (40) disposed in opening condition, until the heads of the needles (4)—lifted further up—will result hooked by sliders (5) of the upper cylinder (1) (FIG. 2). Under this condition, the needles (4) and the article engaged with the latter through the stitches of the last knitted rank, will result engaged to the upper cylinder (1) by the relevant sliders (5) and disengaged from the sliders (6) of the lower cylinder (2), which sliders, after the transfer of the needles (4) from the lower cylinder (2) to the upper cylinder (1), are lowered down to a level allowing them not to interfere with the operations to be performed afterwards. Later on the upper and lower cylinders (1, 2) are driven apart from each other (FIG. 3). It is understood that of said cylinders (1, 2), at least one is associated to means, not shown in the drawings, which drive it into motion in axial direction. Thereafter, provision is made for bringing a movable unit (7) close to the lower base of the upper cylinder (1), said unit having mounted thereon means intended to remove the stitches of the last rank of needles (4), which stitches are still fitted thereon (FIG. 4). Afterwards, said stitch-removal means are moved close to the heads of needles (4) (FIG. 5) and the stitches of the last rank of needles (4) are transferred to means for the withdrawal of the movable unit (7) by the combined motion of the latter and of needles (4) which support the stitches (FIG. 6). For this operation, the stitches plane, defined by the sinkers of upper cylinder (1), acts as a contrasting means which, in practice, is intended for pushing the stitches of the respective needles (4) towards the means for the removal of unit (7). It is understood that it is also possible to move the upper cylinder (1) and relevant sinkers therealong by keeping the needles (4) and said removal means stationary, in order to obtain the same effect. The stitches-removal means are moved away from the upper cylinder (1), in an axial direction of the cylinder, together with the article whose last rank of stitches is now fully disengaged from said needles (4) (FIG. 7). During this operation, the suction tube (3) may be made to cooperate by driving it suitably towards the movable unit (7) so as to dispose it with its mouth (30) in a position allowing it to push the article fabric portion hooked by the removal means and prevent it from being spontaneously disengaged from said means until a next disengagement step, to be described later on, is performed. Afterwards, a second movable unit (8) is disposed in the area between the first movable unit (7) and the lower base of the upper cylinder (1), on said second movable unit (8) means being mounted intended to operate the overturning of the stitches of the first semirank (as described later on) and means intended to to support the stitches to be subjected to a next hooking-up step. At this point, the said means mounted on said movable units (7) and (8) are moved close to each other, and the suction tube (3) is moved back to its starting position inside the upper cylinder (1) (FIG. 8). In a step immediately following this, both first and second movable units (7, 8), and the article (C) therealong, are transferred outside the machine's textile head, that is, moved on as far as to reach a separate hooking-up station (R) (FIG. 9) wherein the stitches removed from the needles (4) are transferred onto the members of the second unit (8) and in such a a way that the stitches of the first semirank are as a result disposed on said means intended to operate the overturning thereof, and those of the second rank are as a result finally positioned on the support means for the hooking-up. The transfer of stitches from the first to the second unit may take place also before the article reaching the hooking-up station (R) . Thereafter, the suction tube (9) provided in the hooking-up station (R) is so driven as to penetrate the article whose toe is kept open by the members of the second movable unit (8) (FIG. 10), and the first movable unit (7) is driven away. Afterwards, the stitches of the first semirank are overturned through 180° about the axis (m—m) (FIG. 11), so that each stitch of the first semirank will be as a result, at the end of this step, coaxially positioned with respect to a corresponding stitch of the second semirank. Thereafter, the stitches of the first semirank are transferred onto the members of unit (8) which already supports the stitches of the second semirank (FIG. 12) so that, to each stitch of the first semirank will correspond one stitch of the second semirank; accordingly, the members for overturning the stitches of the first semirank are brought back to the starting position (FIG. 13) where the hooking-up of the stitches of first and second semirank is carried out by a hooking-up machine (90), said stitches being in coaxial and juxtaposition relationship and fitted on the support members for the hooking-up (FIG. 14). Then, the article can be released (FIG. 15). By aspirating the article within the tube (9) of the hooking-up station (R), there is obtained the eversion of the same article and its ejection in right-side out condition. In this way there is operated the union of the edges of stocking (C) corresponding to the stitches of said first and second semiranks which the last knitted rank can be considered subdivided into.

In the figures of the attached drawings, the seam or hooking-up line of said fabric edges is indicated by (LR).

A further examplary embodiment of the present invention relates to case D to be described with reference to FIGS. 16–29 of the drawings.

This example refers to the manufacturing of a stocking with the toe hooked-up on the external side and knitted on a two-cylinder circular knitting machine. Accordingly, the conditions stated in the previous example hold true also in this case. It is however possible to retain the stocking in the upper cylinder (1), as usually done, and then introduce it into the lower cylinder (2) upon completion of knitting. This can be obtained by means of the suction system commonly provided in the upper cylinder (1).

Figure 18:
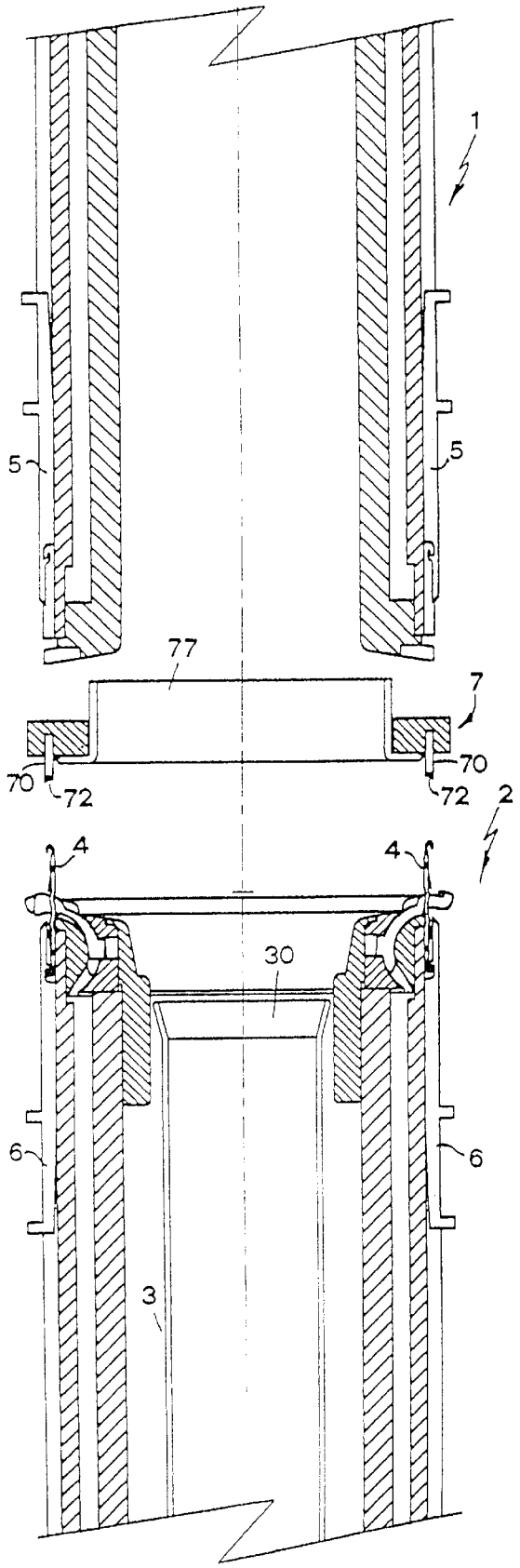
Figure 19:
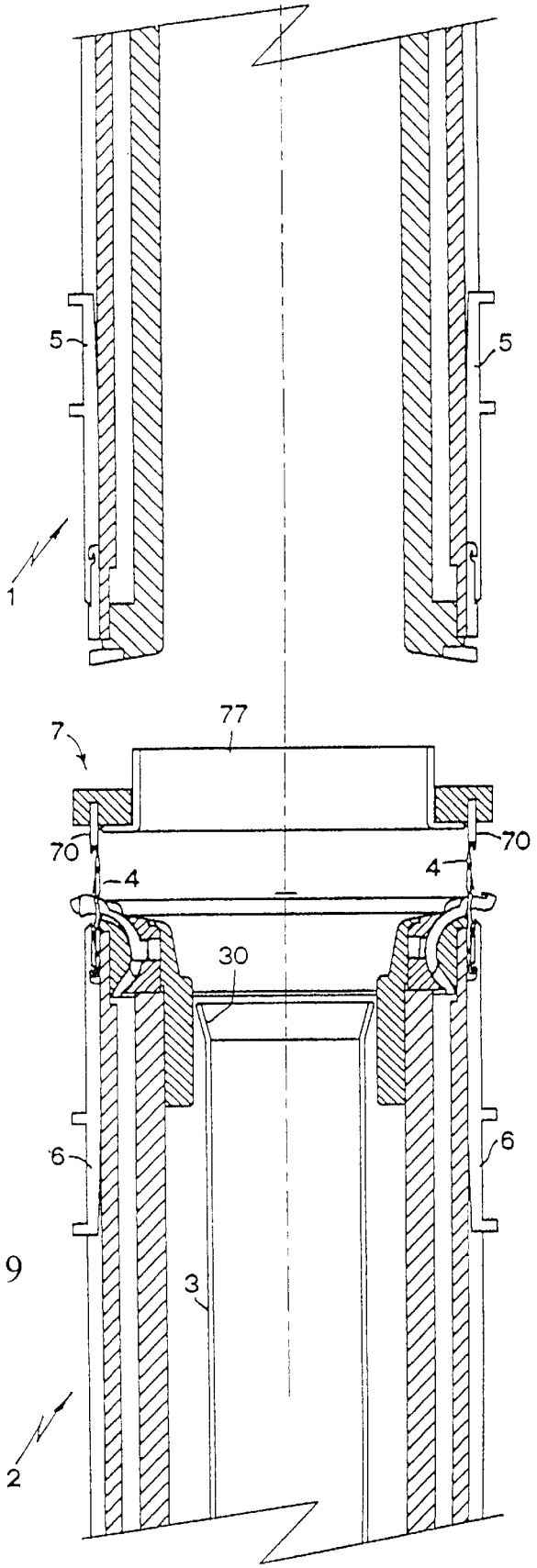
Figure 20:
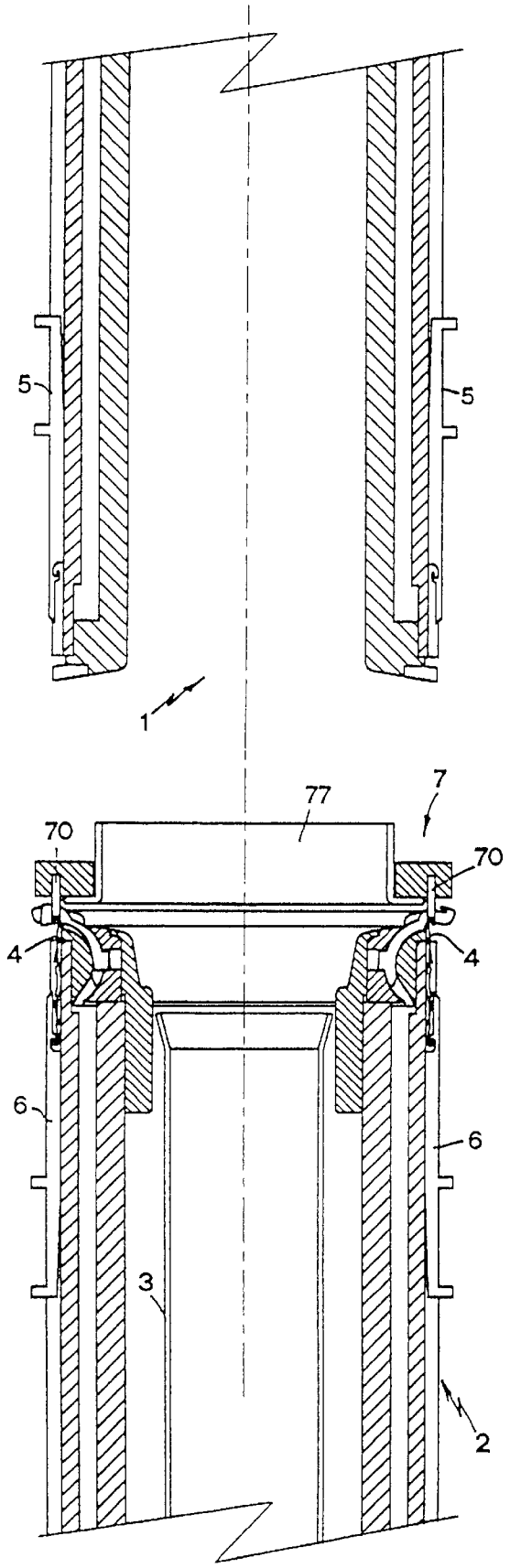
Figure 21:
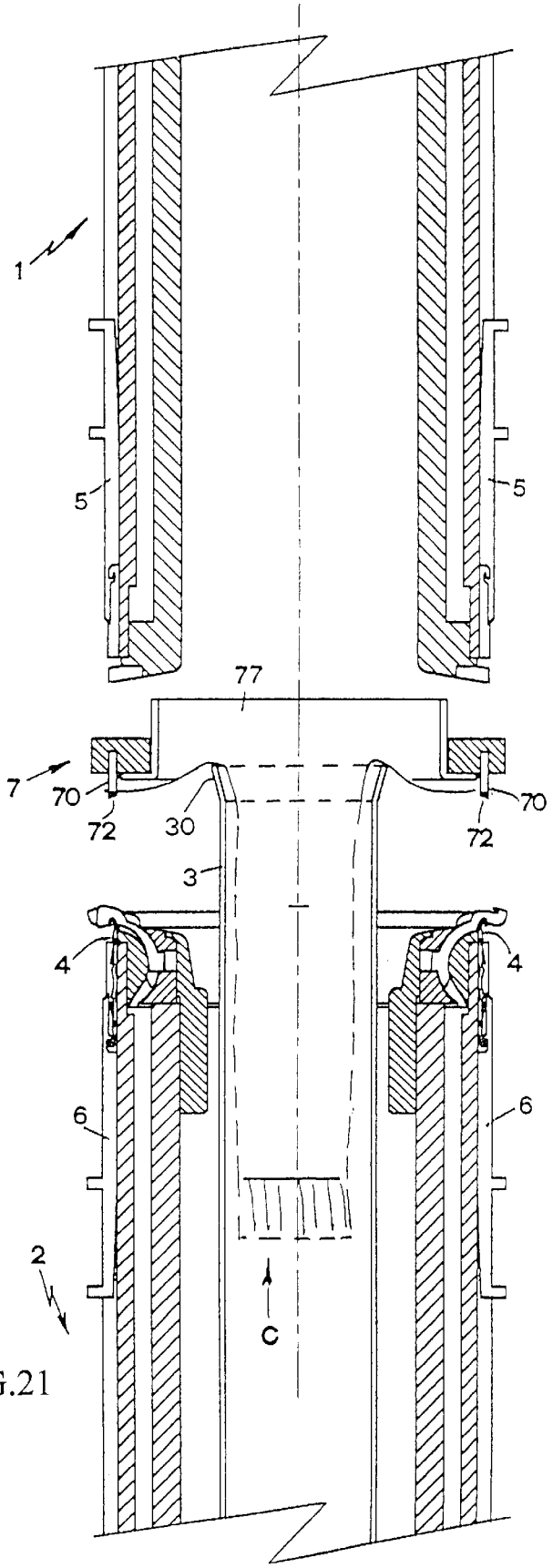
Figure 22:
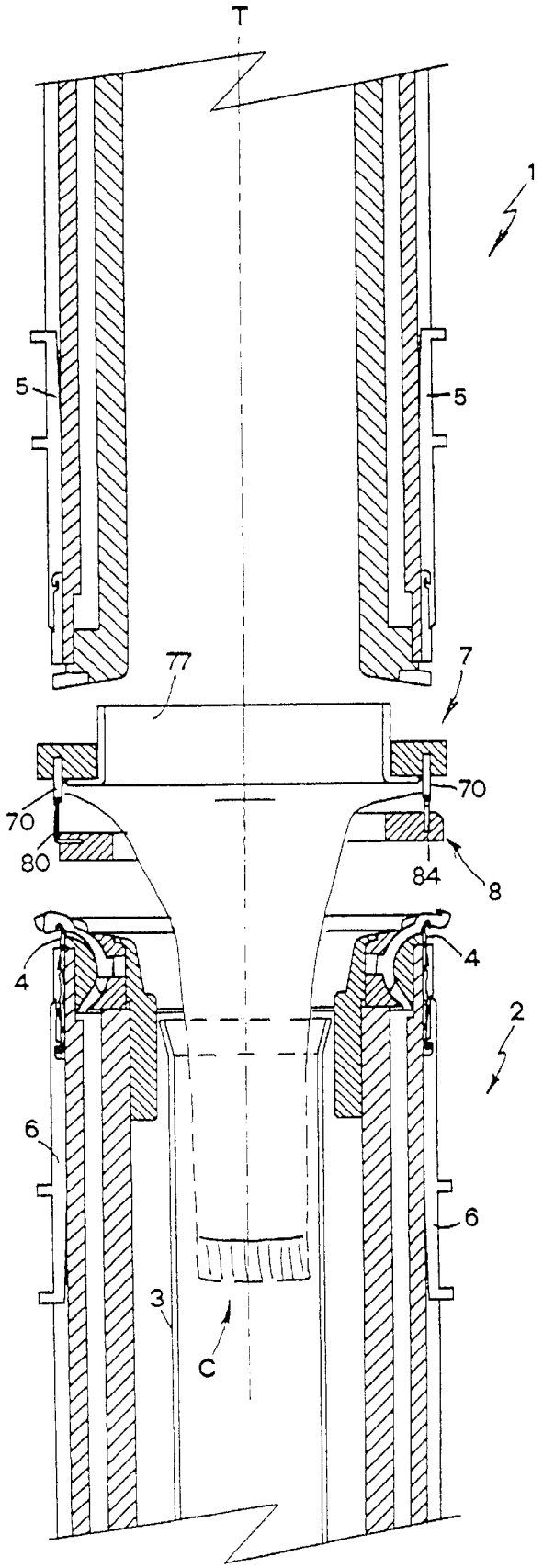
Figure 23:
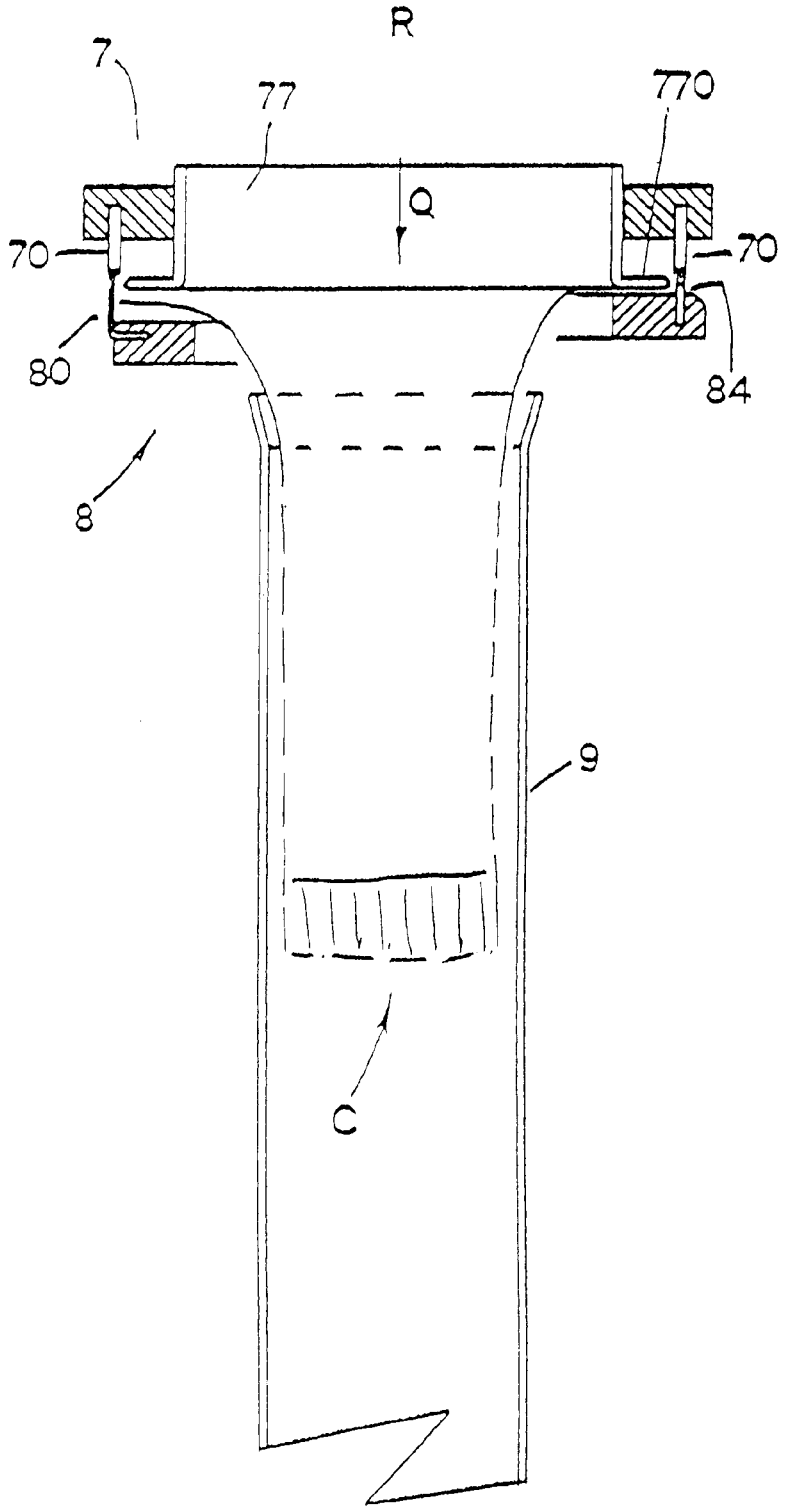
Figure 24:
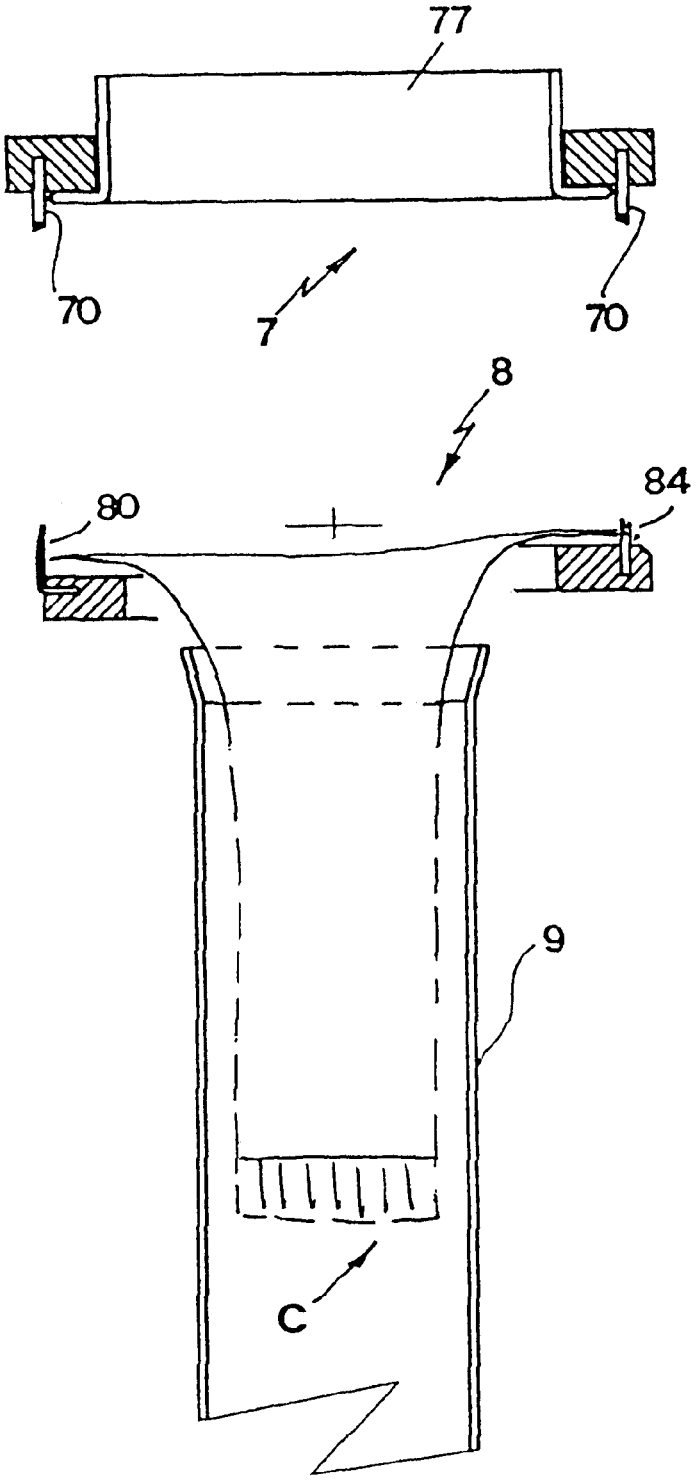
Figure 25:
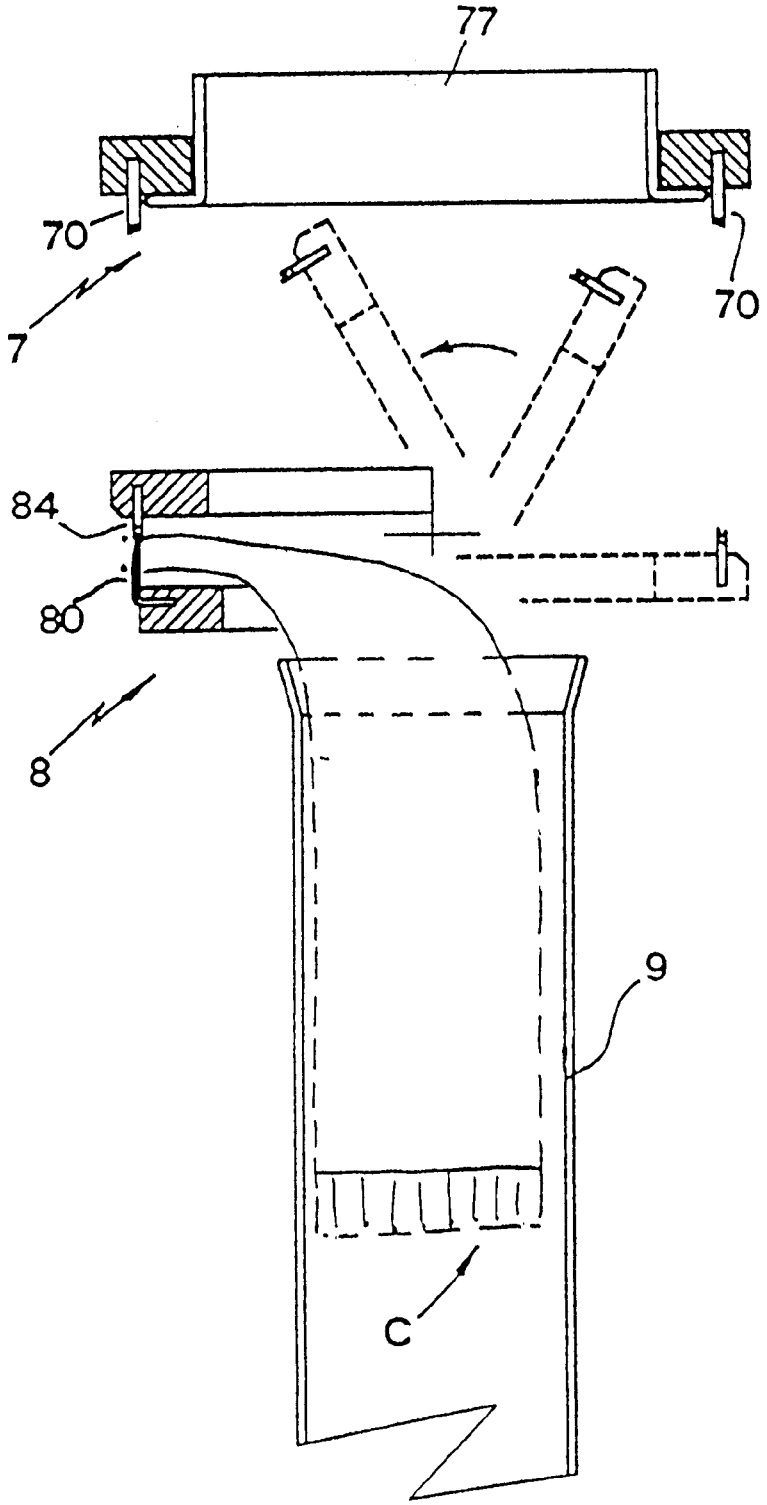
Figure 27:
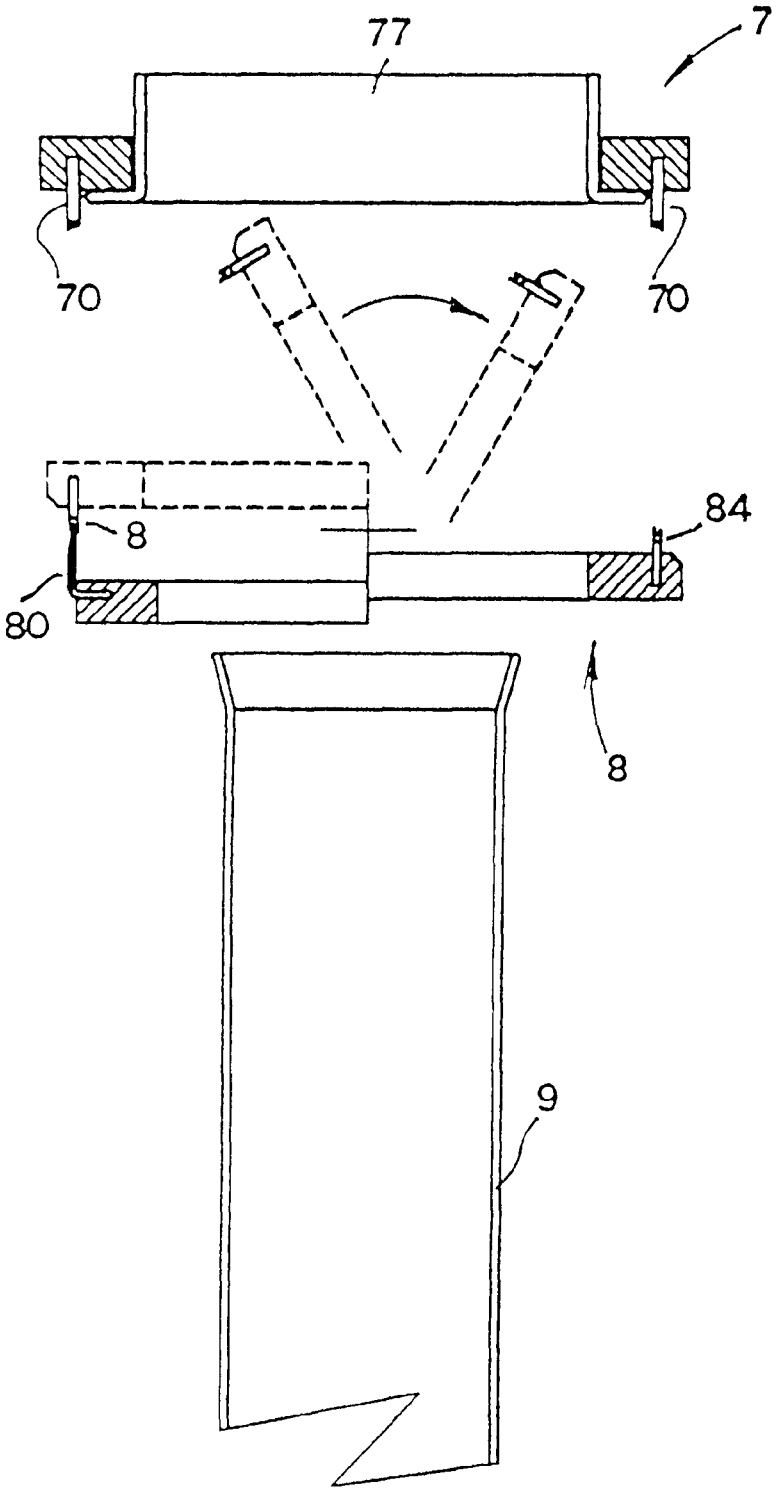
Figure 28:
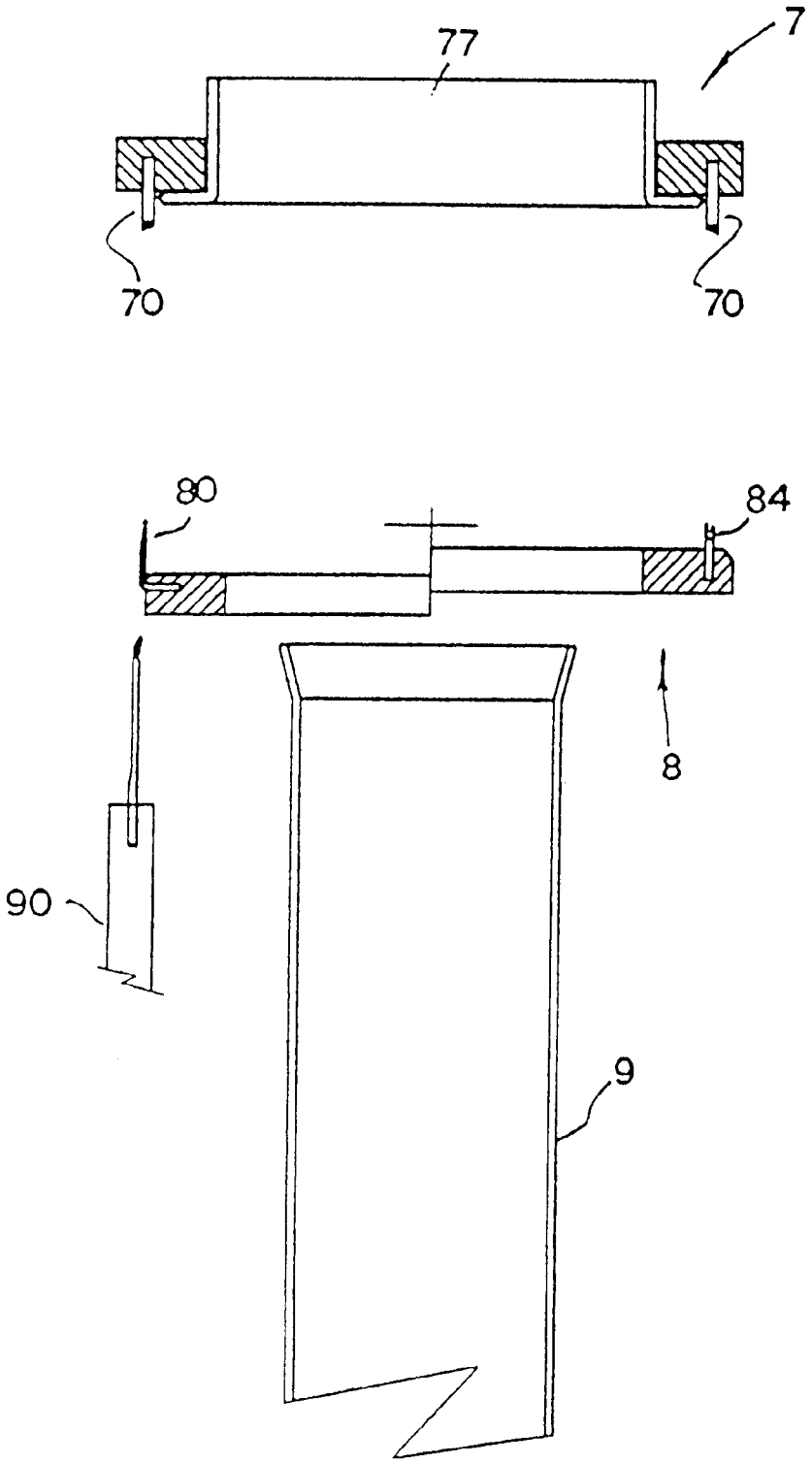
Figure 29:
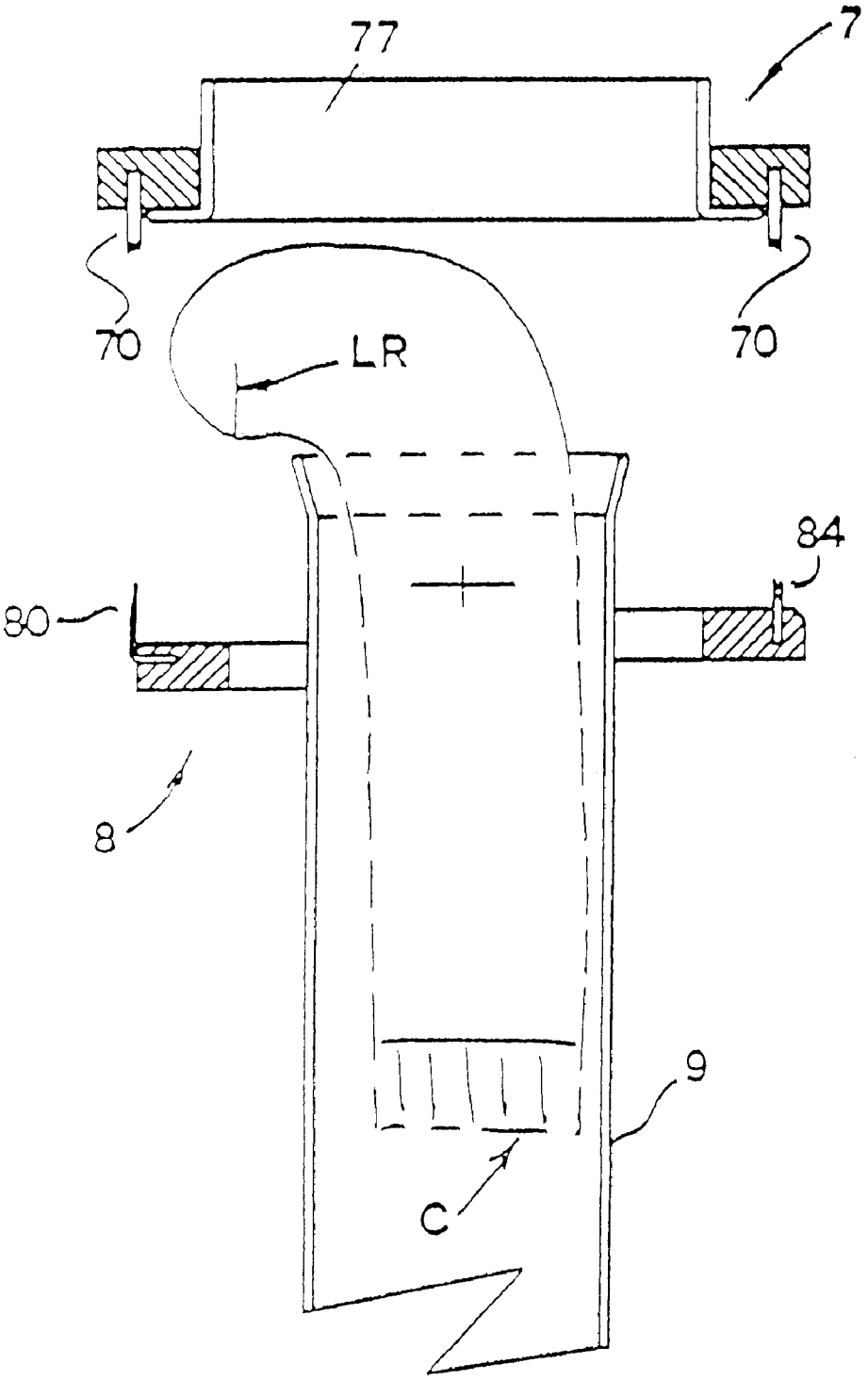

Once the knitting has been completed, the stitches of the last rank result engaged to the needles (4) supported by the lower cylinder (2) (FIG. 16) and the cylinders (1, 2) are suitably spaced apart to allow the execution of the next steps; thereafter, said needles (4) are lifted up (FIG. 17), with the sinkers (40) disposed in closed condition, until each stich results in the so-called unloaded position, that is, below the latch of the corresponding needle (4) (the lifting of the needles (4) being possibly operated also before spacing apart the cylinders of the knitting machine). Therefore, with the sinkers being open, the needles (4) are lifted further up so as to dispose the stitches of the last rank in a position above the upper plane of the sinkers. At this point, provision is made for lifting the sinkerbluffs (400), at least in the regions where the sinkers are open, to prevent the stitches from spontaneously disposing themselves again below the upper plane of the sinkers. It will be worth remembering that the sinkerbluffs are members, known to those skilled in the art, associated to the sinkers and intended to cover the recess under the beak thereof thereby preventing the stitches from becoming entangled thereto. This operation is necessary inasmuch as the two-cylinder circular machines this example refers to do not provide for the closing nor the simultaneous opening of all the sinkers, the movement of the sinkerbluffs (400) being controlled by a suitable external cam (410). Afterwards, a first movable unit (7) is located in the work region of needles (4), said unit having mounted thereon the means intended to remove the stitches of the last rank present on said needles (FIG. 18). Then, said stitches-removal means are moved close to the heads of the needles (4) (FIG. 19). Subsequent to this, the stitches-removal means are lowered, along with the needles (4), so that each stitch is transferred onto the corresponding removal member—owing to the fact that the support plane provided by the sinkers forces the stitches to dwell thereon while they are penetrated by the removal members and abandoned by the needles (FIG. 20). As an alternative, the lower cylinder (2) may be driven, along with the respective sinkers (40), with respect to the unit (7), thereby achieving the same effect. Afterwards, the unit (7), together with the removal means on which the stitches of the last knitted rank are now loaded, is moved away from the machine's lower cylinder (2) (FIG. 21). During this step, use may be made of the tube (3) to prevent any accidental disengagement of the stitches from said removal means. To this end, the tube (3) may be suitably raised along with unit (7) so as to dispose it with its mouth (30) pushing the article fabric portion hooked to the removal means. Following this, to said first movable unit (7) there is associated a second unit (8) on which means are mounted intended to overturn the stitches of the first semirank, as well as means supporting he stitches in a successive hooking-up step (FIG. 22), and the suction tube (3) is lowered until its mouth (30) results below the whole of the two movable units (7, 8) to allow positioning them, along with the thus engaged stocking (C), in a separate hooking-up station (R) (FIG. 23) wherein the transfer of the stitches from the members of first unit (7) to those of second unit (8) takes place. This latter operation may also be performed in advance, that is, upon said units (7, 8) coming in correspondence of the knitting machine, or during the motion thereof. The suction tube (9) of the hooking-up station (R) may advantageously aspirate the fabric of the article (C) for a best control of the next step and for conveying the ejection of same article after the hooking-up. Then, the first movable unit (7) is moved away (FIG. 24) and the stitches of the first semirank are overturned through 180° about that axis which virtually subdivides the last rank into a first and second semiranks (FIG. 25). At the end of this step, each stitch of the first semirank results coaxial to the corresponding stitch of the second semirank. Afterwards, the stitches of the first semirank are pushed onto hook-up support means, which already accomodate the stitches of the second semirank (FIG. 26), and the said overturning means are moved back to their starting position (FIG. 27). Then the hooking-up of said first and second semiranks is carried out. (FIG. 28). Afterwards, the now finished article is unloaded from the means having carried out the hooking-up on the external side. To this end, provision is made for driving the suction tube (9) upwards above the stitch-support means for the hooking-up (FIG. 29). By aspirating the stocking inside the tube (9) there is obtained its ejection in right side out condition.

What has been described above with reference to FIGS. 16–29 is directly applicable also for the treatment of a stocking manufactured by means of a one-cylinder machine under the conditions of Case F.

Figure 30:
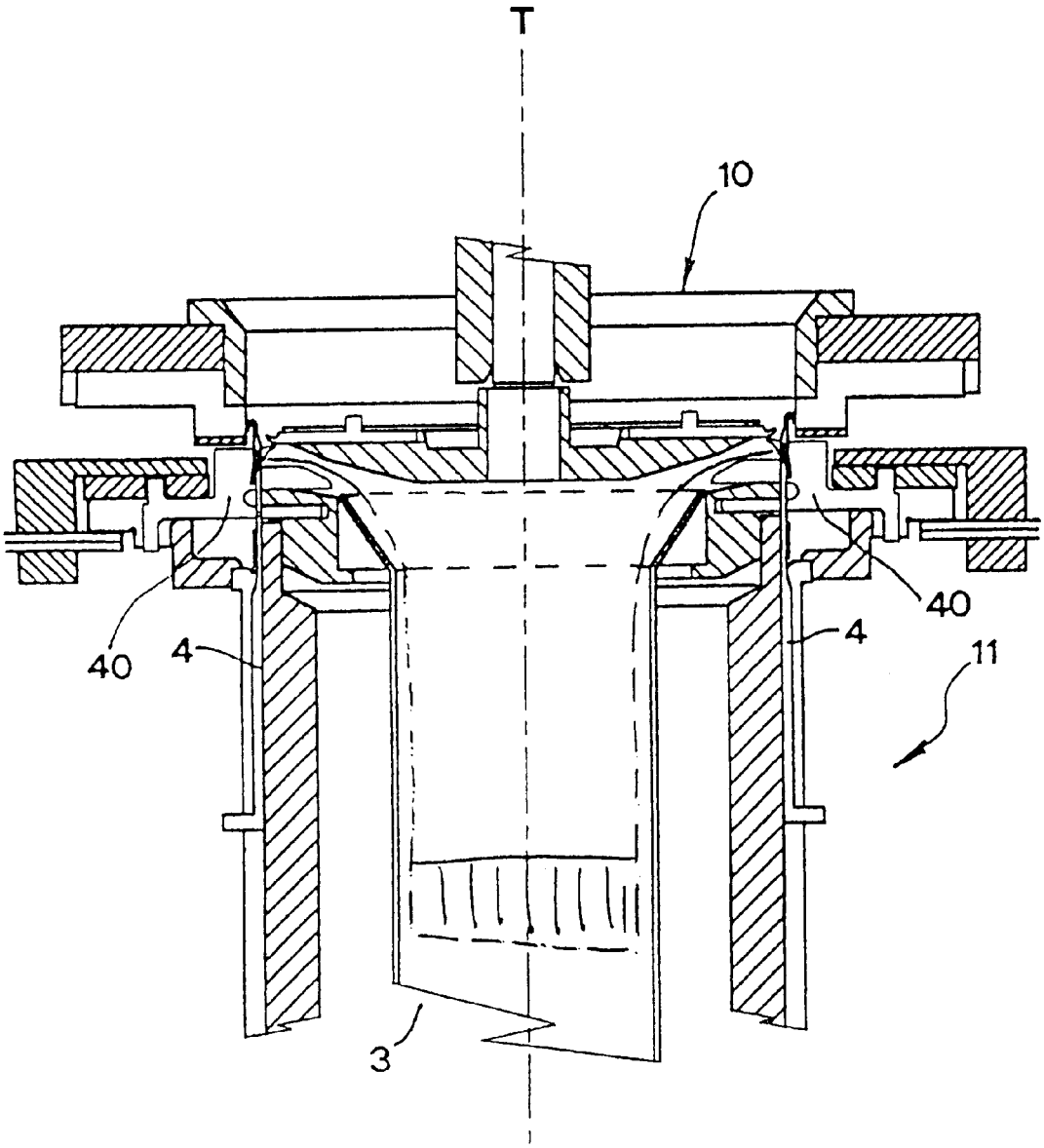
FIGS. 30–45, also to be described in greater detail later on, relate to a third example of implementation of the operational method according to the invention.
Figure 31:
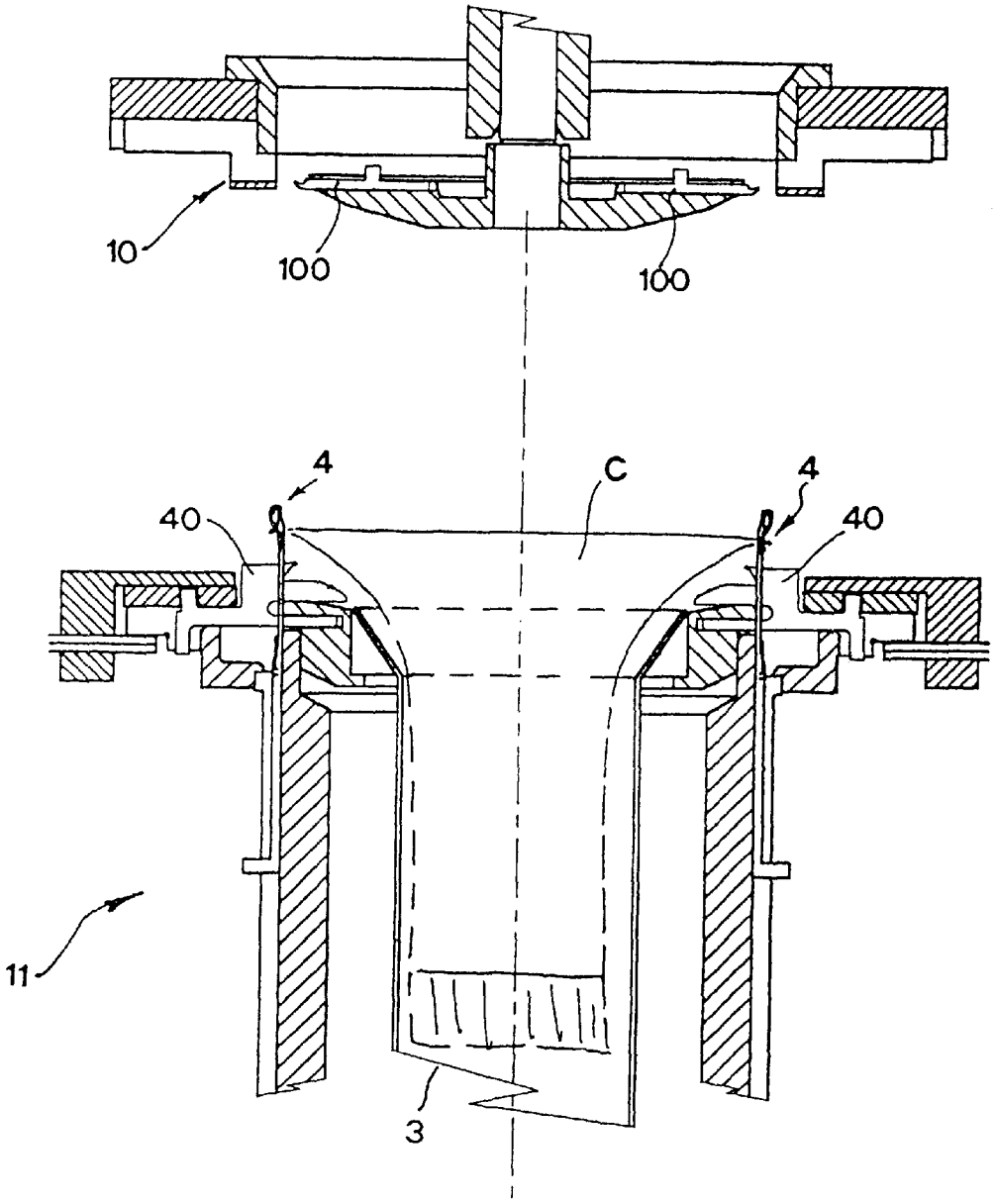
Figure 32:
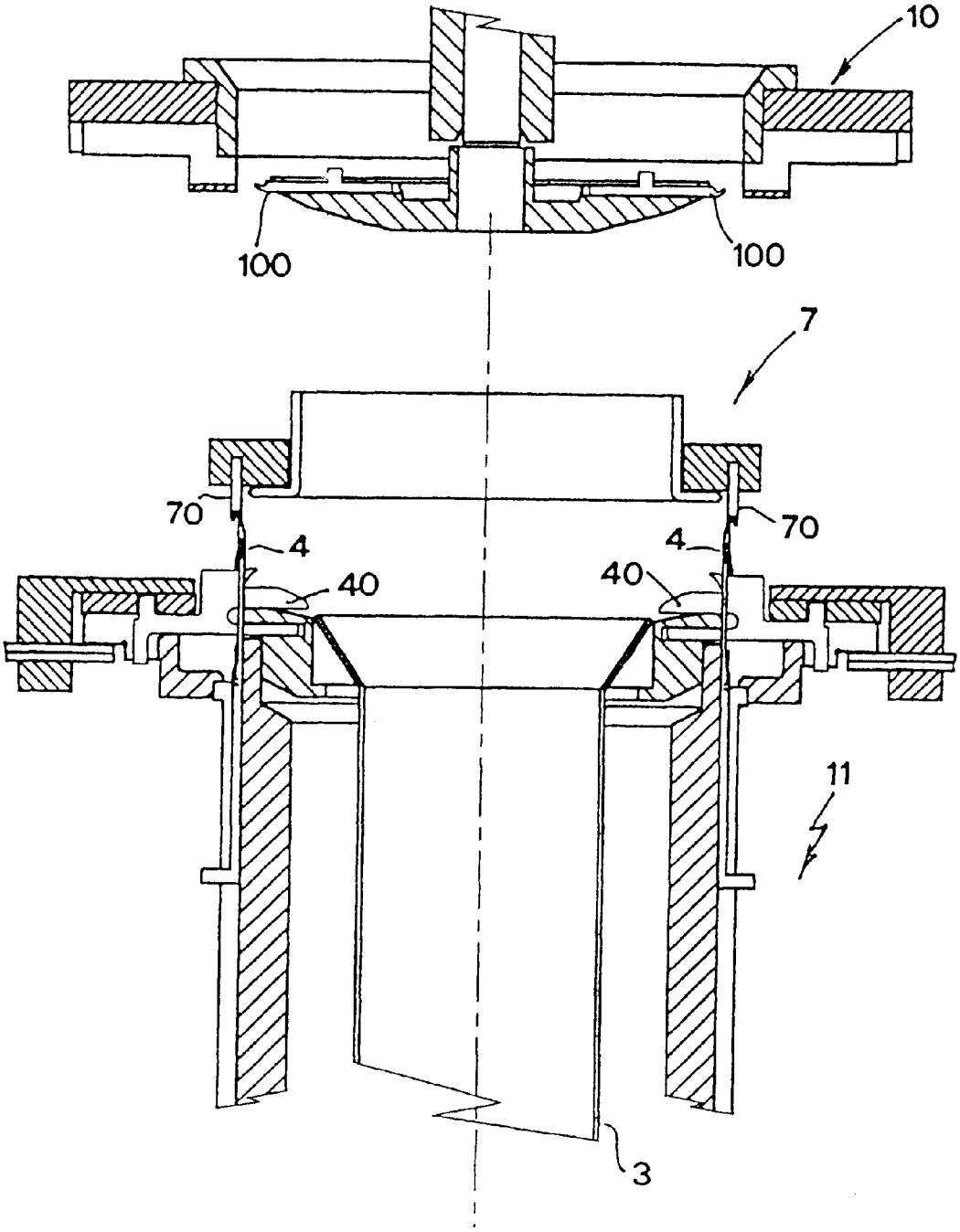
Figure 33:
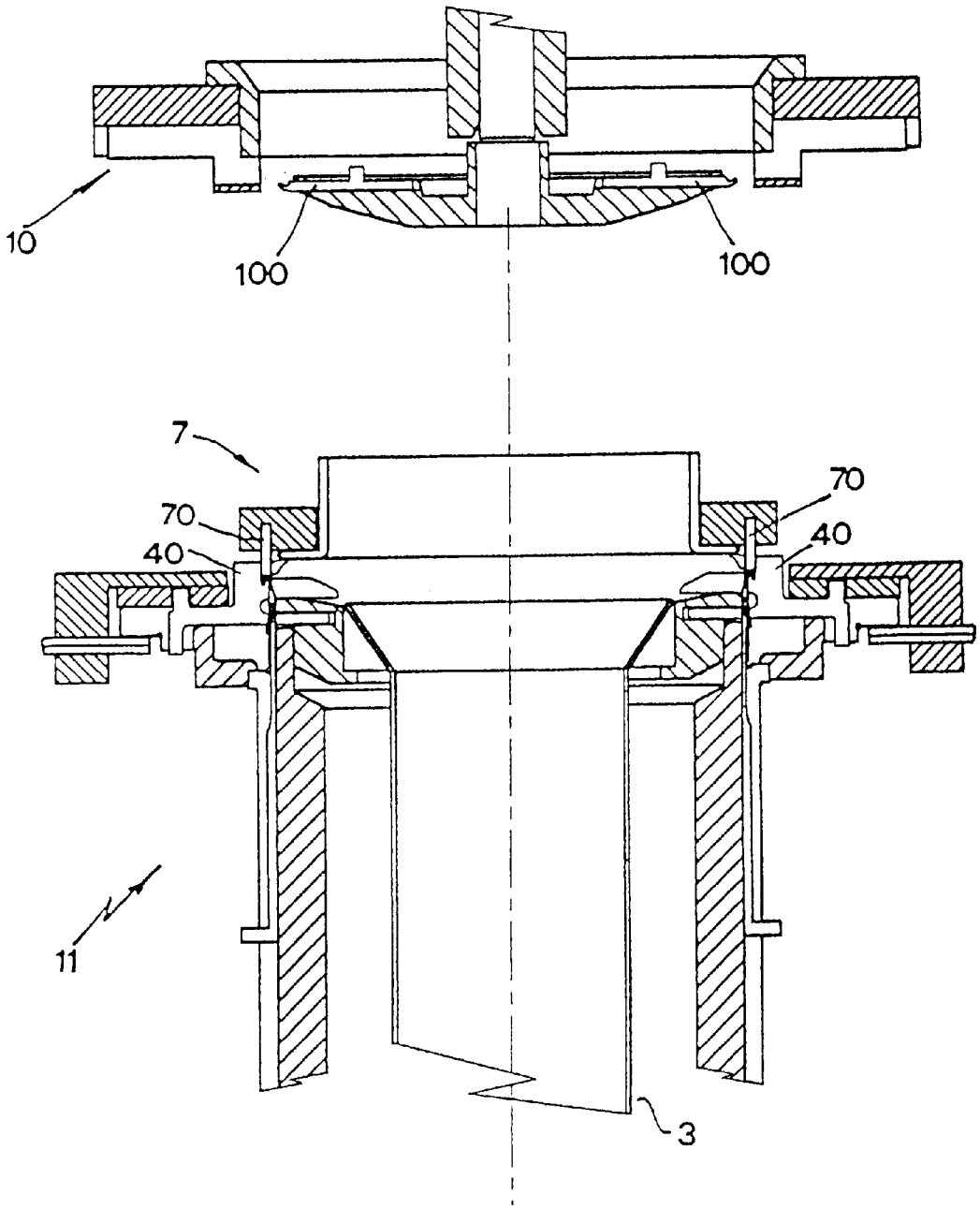
Figure 34:
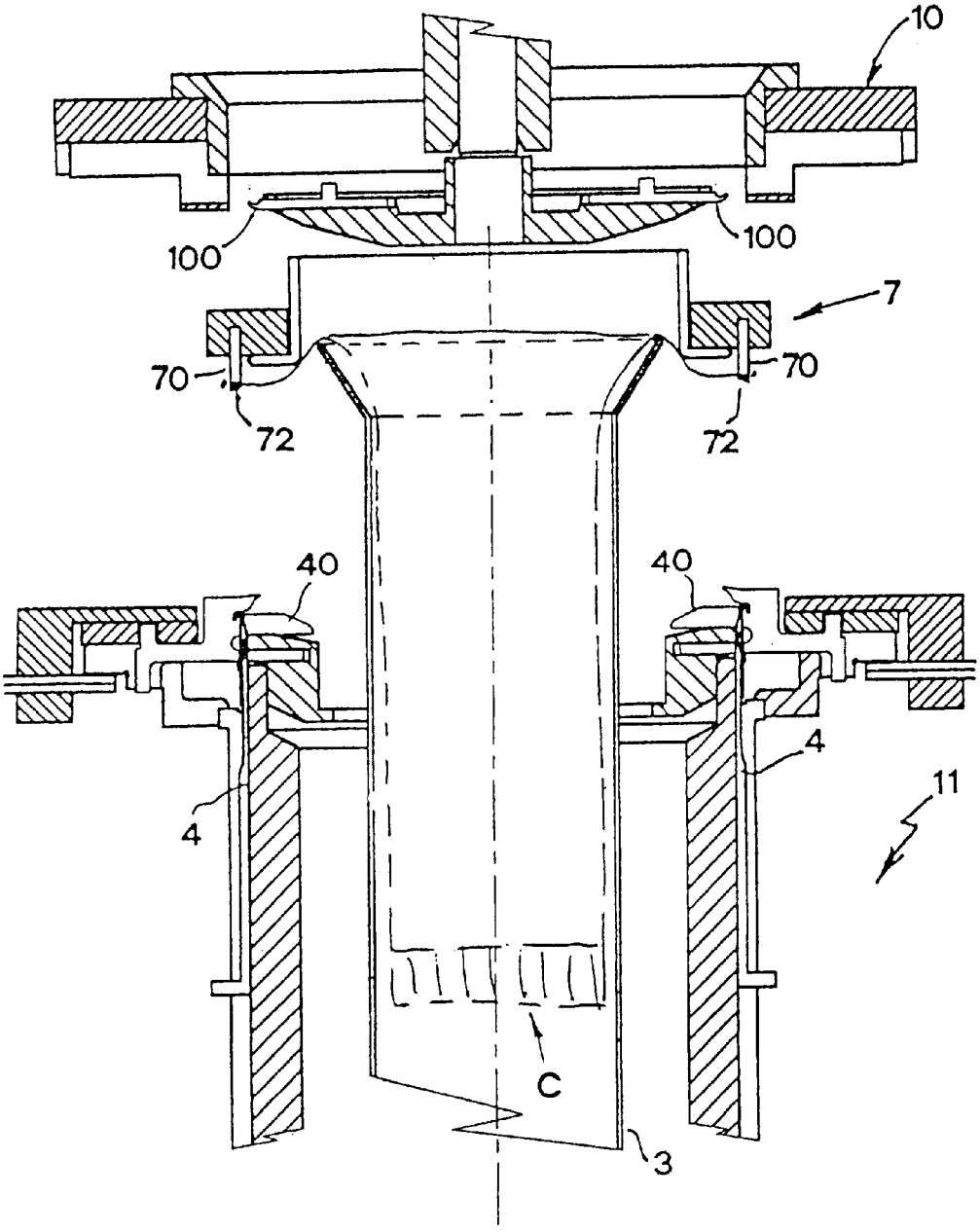
Figure 35:
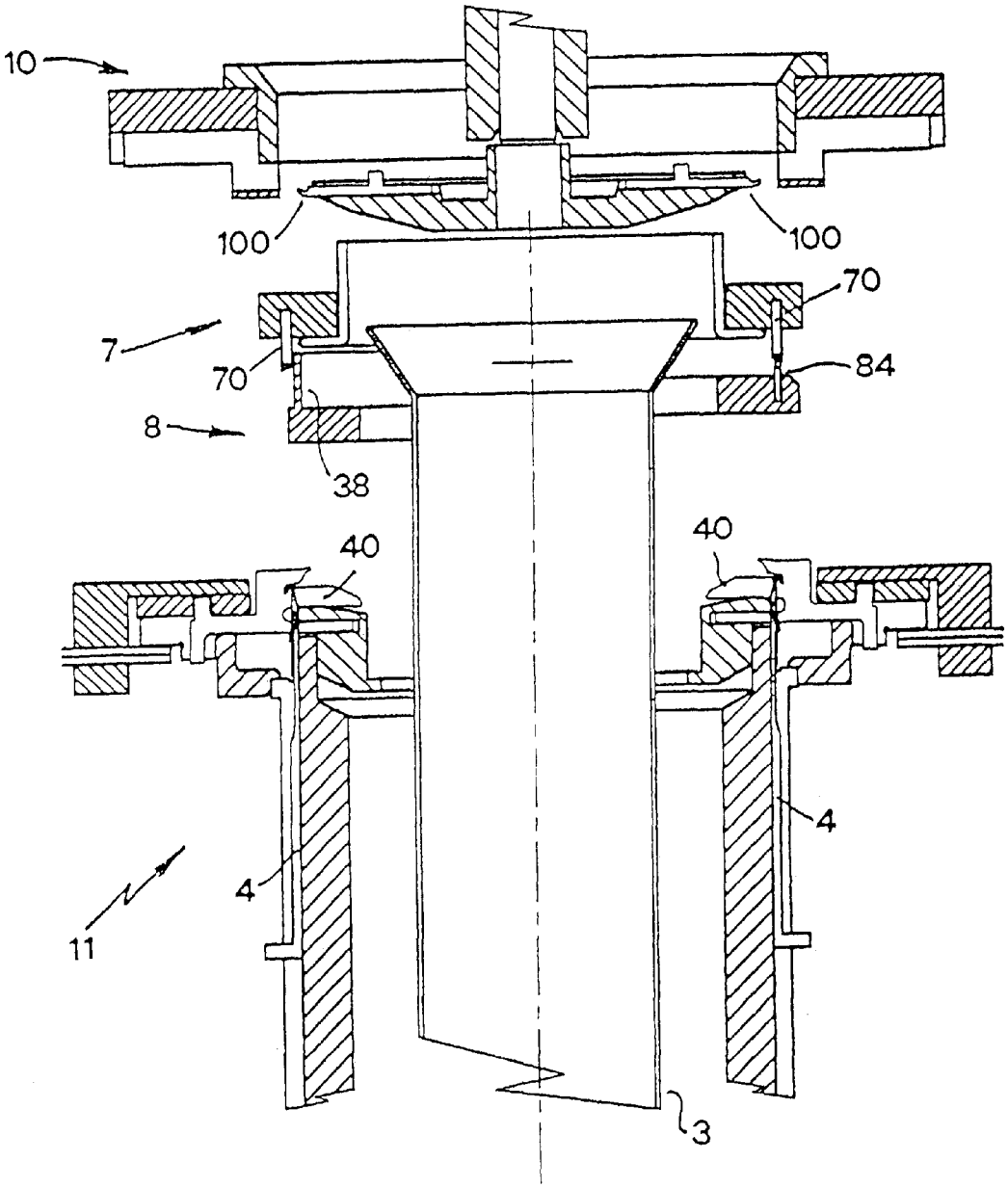
Figure 36:
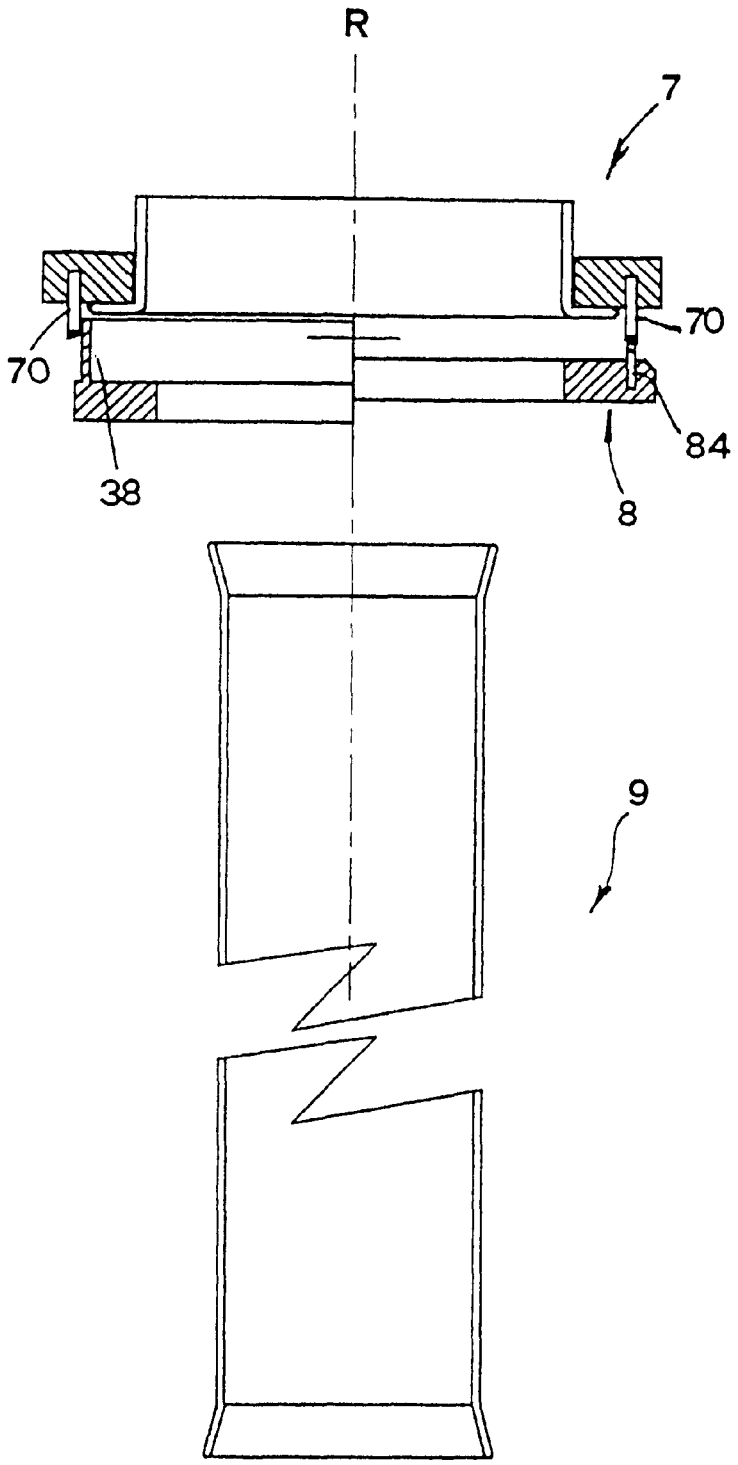

A further example will be described herebelow with reference to FIGS. 30–45, relative to the Case I of a stocking produced by means of a one-cylinder machine and whose final toe's hooking-up is operated on the internal side. The knitting of the stocking starts from the edge or hem and terminates on the side of the toe that remains open, with the stitches of the last rank being fitted on the needles (4) that have formed them. Upon completion of the knitting, the stocking is engaged to the needles (4) on which the stitches of the last knitted rank are present (FIG. 30). The plate group (10) with respective crooks (100), is moved away from the cylinder (11) to allow the regular execution of the next steps (FIG. 31). Thereafter, the needles (4) of cylinder (11) are lifted up, with the sinkers being closed, until the stitches result in the unloaded position. Then the needles (4) are lifted further up, with the sinkers (40) being open, so that all the stitches of the last knitted rank will result in a position above the sinkers. At this point, all the sinkers (40) are caused to close up. A first movable unit (7) is moved close to the work region of needles (4), on said movable unit means being mounted for the removal of the stitches of the last rank from the respective formation needles (4) (FIG. 32) and, following this, said removal means are moved close to the heads of the needles (4) of cylinder (11). At this point, the needles (4) of cylinder (11) are driven into motion and the said removal means are made to move with respect to cylinder (11) and sinkers (40) so as to transfer the stitches from the needles (4) to the removal means (FIG. 33). Afterwards, the removal means, with the stitches of the last knitted rank thus loaded thereon, are moved away from cylinder (11) (FIG. 34) and, to prevent he stitches from being accidentally disengaged from the removal means, it is possible to correspondingly drive the suction tube (3) of knitting station (T) into motion likewise the Cases B and D above described. Then, to said first movable unit (7) there is associated a second unit (8), on which means are mounted able to receive and retain the stitches of the first semirank as weel as means for retaining the stitches of the second semirank on the respective removal means of the first unit (7) (FIG. 35). Provision is then made for transferring said two movable units (7, 8), along with the article (C), to a separate hooking-up station (R) (FIG. 23) wherein the article is aspirated inside the tube (9) provided in this station (FIG. 36) . At this point, the stitches of the first semirank are transferred onto said receiving and retaining means of the second unit (8) (FIG. 37), so as to keep them upon the same plane of the stitches of the second semirank to avoid an excessive stretching of the fabric. This operation may however be carried out also before the two units (7, 8) coming in correspondence of the hooking-up station (R). Afterwards, said means for the removal of the stitches of the first semirank are moved away (FIG. 38) and their place is taken by means supporting the stitches to be hooked-up (FIG. 39) and provided on a third movable unit (14). After that, the suction tube (9) is driven into motion to be disposed above said movable units and be inserted inside the article (C) in the course of formation (FIG. 40). This implies the article being turned inside out and outside the tube (9). Thus, the stitches of the first semirank are transferred onto hook-up supporting means of the third movable unit, said stitch-supporting means for a subsequent hooking-up step being also provided for overturning the stitches of the first semirank. A detail description of a feasible embodiment of these means is given later on. The next step is for 180°—overturning the first semirank of stitches about the axis which virtually subdivides the stitches of the last knitted rank into stitches of first and respectively second rank, after the means associated to the second movable unit (8) are moved away (FIG. 41). Upon completion of this step, each stitch of the first semirank will result coaxial to a corresponding stitch of the second semirank. Afterwards, the stitches of the second semirank are transferred onto hook-up supporting means of the third movable unit (14) very close to those of the first semirank (FIG. 42). Then, the means for the removal of the stitches of the second semirank are moved away to join those provided for the removal of the stitches of the first semirank (FIG. 42) and the hooking-up of the stitches fitted on the hook-up support means is carried out (FIG. 43). The means which have operated the overturning of the stitches of the first semirank are now brought back to the respective initial position (FIG. 44) and the finished product is released, with the aid of suction tube (9), from the means used for the hooking-up—said tube being suitably driven to have its mouth (30) in a position below the hooking-up means (FIG. 45). By activating the suction inside the tube (9), there is once more obtained the eversion of the article and thus the ejection thereof in right side out condition.

It should be noted that, for each one of the examples above illustrated, the hooking-up may be carried out according to procedures known to those skilled in the art and, accordingly, not to be described in grater detail.

It will be clear from the above description, that the operational method according to the invention, comprises essentially the following steps:

preliminarily knitting the article in a knitting station (T);

removing the stitches of the last knitted rank by stitch-removing means mounted on a first movable unit between said station (T) and a hooking-up station (R);

transferring the stitches of at least one semirank onto means, other than those which operate the above said removal, which support the stitches of said at least one semirank in the successive overturning step;

overturning through 180° the first semirank of stitches about an axis which virtually subdivides the last knitted rank into said first and second semiranks, so as to dispose the thus overturned stitches in correspondence of the stitches of the other semirank;

hooking-up the thus disposed stitches of first and second semiranks.

Described herebelow are feasible embodiments of the means mounted on said movable units and usable for carrying out the method described with reference to FIGS. 1 to 29.

The members for removing the stitches of the last knitted rank from the needles (4) of a circular machine, either of one- or two-cylinder type, are made up of elements (70) having a stem (700) with straight axis associated to the unit (7) through a support comprising two concentric circular crowns (74, 75) connected to the arm (76) of the movable unit (7), and between the facing edges of which the stems (700) of said elements (70) are housed angularly equidistant and with a pitch substantially equal to the centre distance of the stitches to be removed: the free end of the stitch-removing elements (70) exhibiting a seat (72) for the head of a corresponding needle (4) during the stitch-removing step. The arm (76) of said unit (7) exhibits a hole (760) in correspondence of the end opposite to that which accomodates the removal members (70) to allow for the housing thereof onto a support column (99) which, in turn, is received into a sleeve (830): the said sleeve (830) being mounted on a base (990) and the column (99) being kept in vertical position by a collar bracket (900) provided on the opposite side of the base (900). The members intended to support the stitches during the hooking-up step consist of a plurality of hook-up spikes (80) fixed—angularly equidistant and with pitch corresponding to the one of the stitch-removing elements (70)—to a corresponding semicircular support (81) comprising two coaxial and overlapping semicrowns (810, 811) between the facing surfaces of which the stems (800) and spikes (80) are housed at the end of an arm (82) provided with a hole (83) to allow the housing thereof on the above said sleeve (830). Alternatively, the above hooking-up spikes may be associated to said third movable unit (14). For the sake of clarity, the spikes of the third movable unit (14) are indicated with (180) instead of (80) as are those of the second movable unit (9).

The members intended for overturning the stitches of the first semirank over those of the second semirank after being received from the elements (70) of the first movable rank (7), are made up of bodies (84) with straight stems (840) mounted on a corresponding semicircular support (85) comprising two coaxial semicrowns (851, 852) between the facing surfaces of which the stems (840) of bodies (84) are so housed as to result angularly equidistant and with a pitch corresponding to that of the elements (70) solid to the first movable unit (7): the head portion (841) of each of said bodies (84) being suitably shaped to be able to fit into the end seat (72) of a corresponding stitch (70)-removing element and allow the free end of the respective spikes (80) to fit thereinto in order to receive the stitches present thereon, the support (85) of said bodies (84) being coaxial and complementary to that of said spikes (80).

Figure 49:
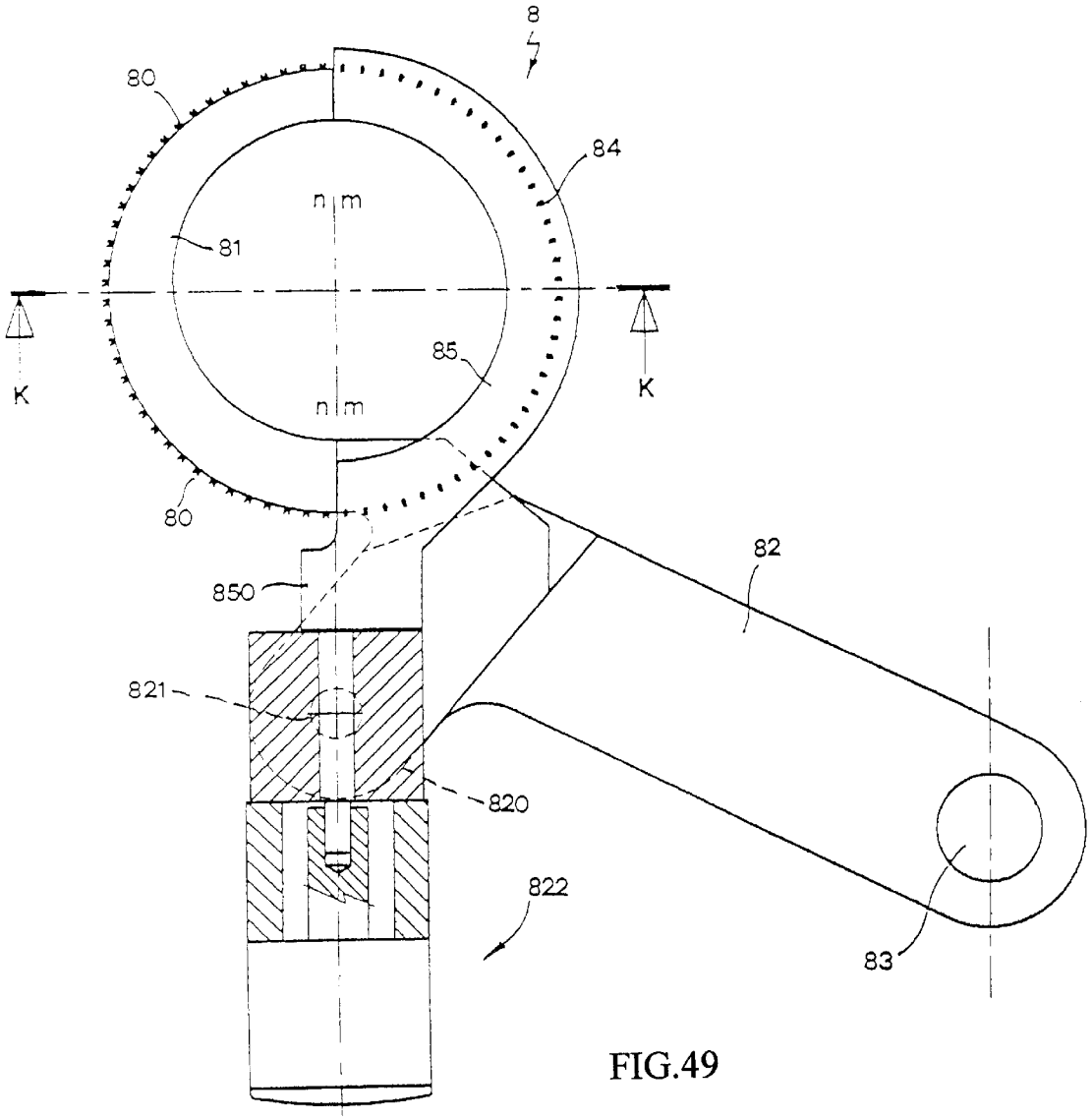
FIG. 49 shows the movable unit of FIG. 48 in closing condition.
Figure 50:
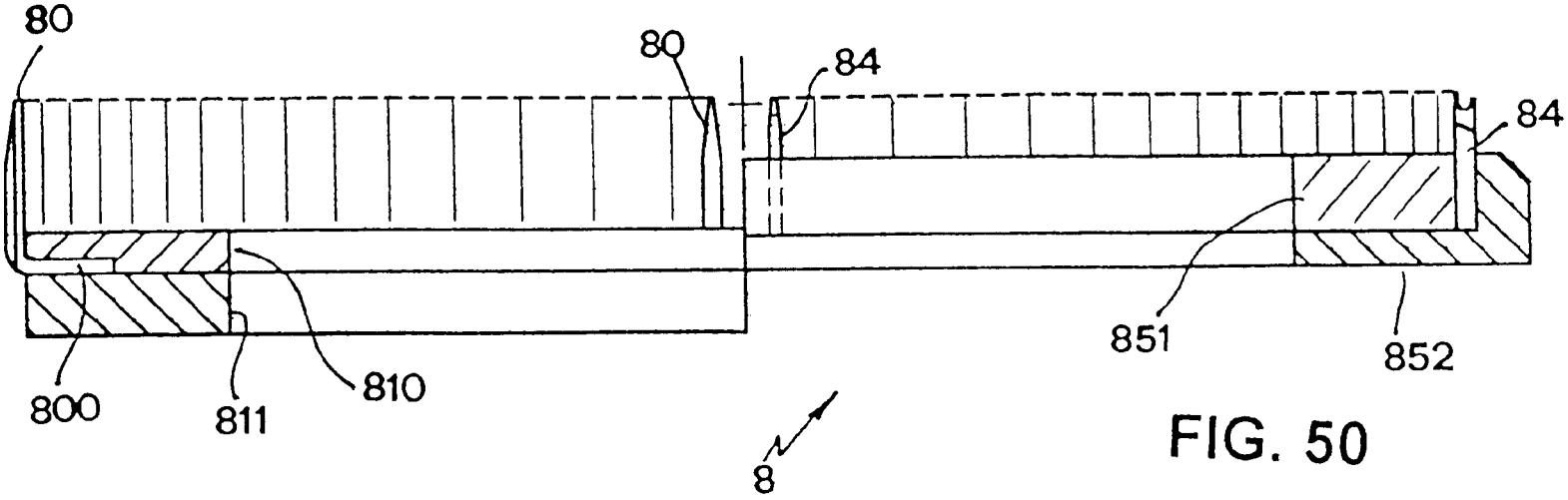
FIG. 50 is an enlarged sectional view taken on line K—K of FIG. 49.
Figure 51:
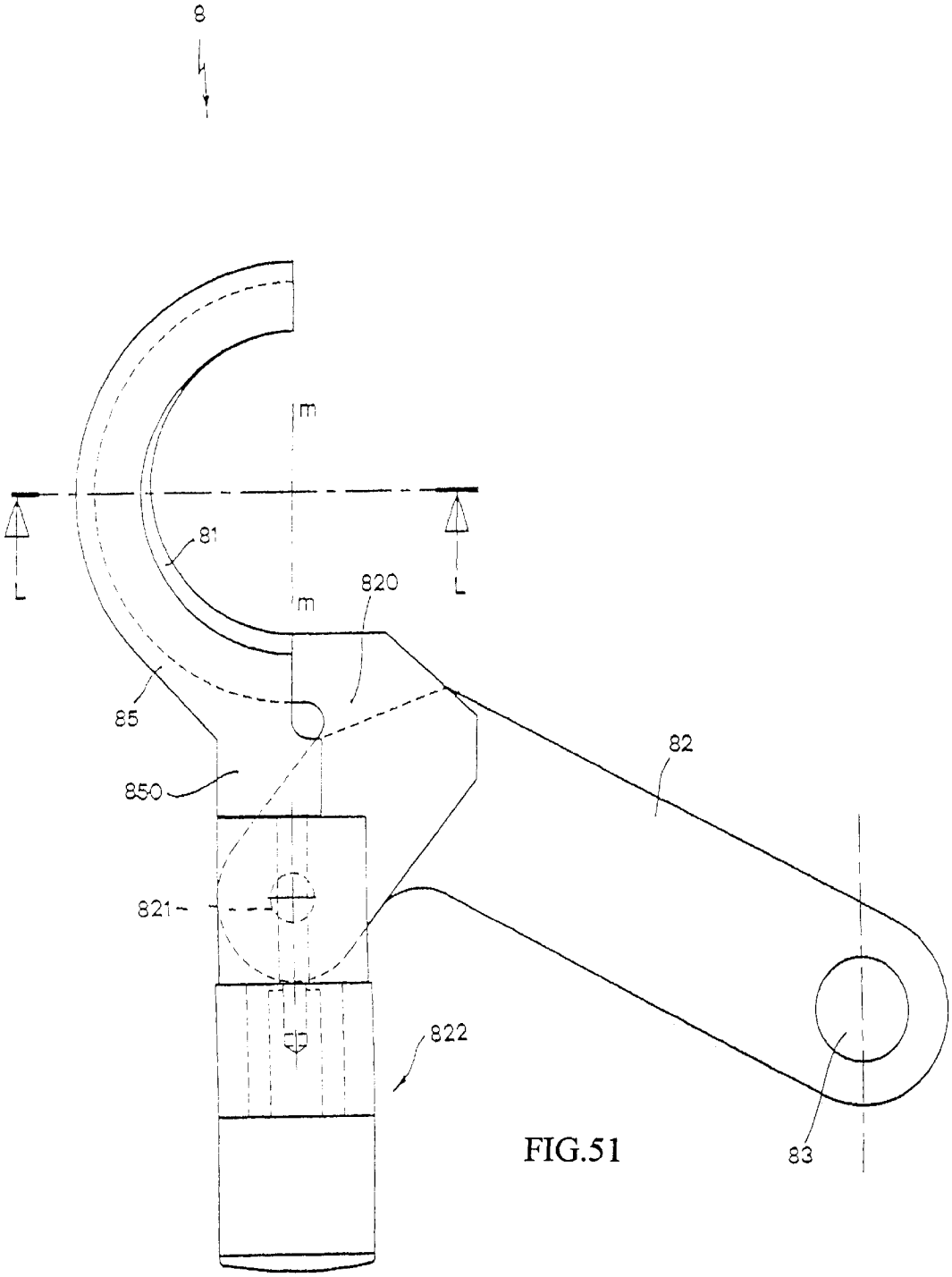
FIG. 51 shows the movable unit of FIG. 49 with the semicrown—relevant to the the means for overturning the stitches of the first semirank—being overturned through 180° about the axis m—m.
Figure 52:
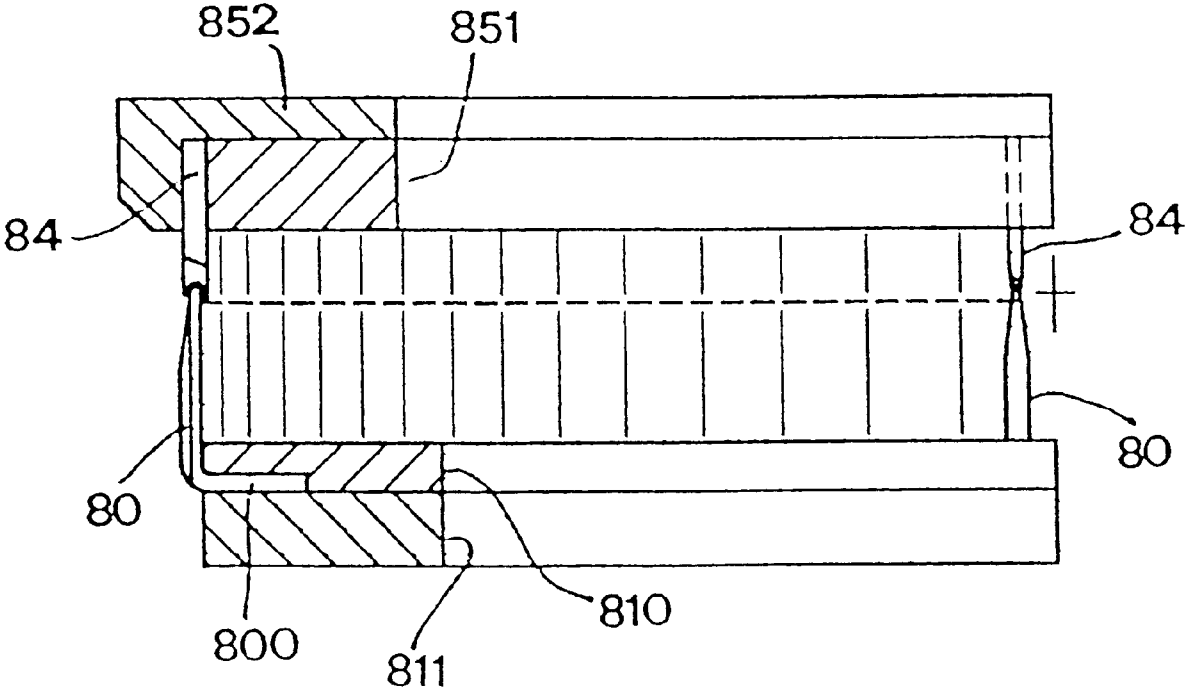
FIG. 52 is an enlarged sectional view taken on line L—L of FIG. 51.
Figure 53:
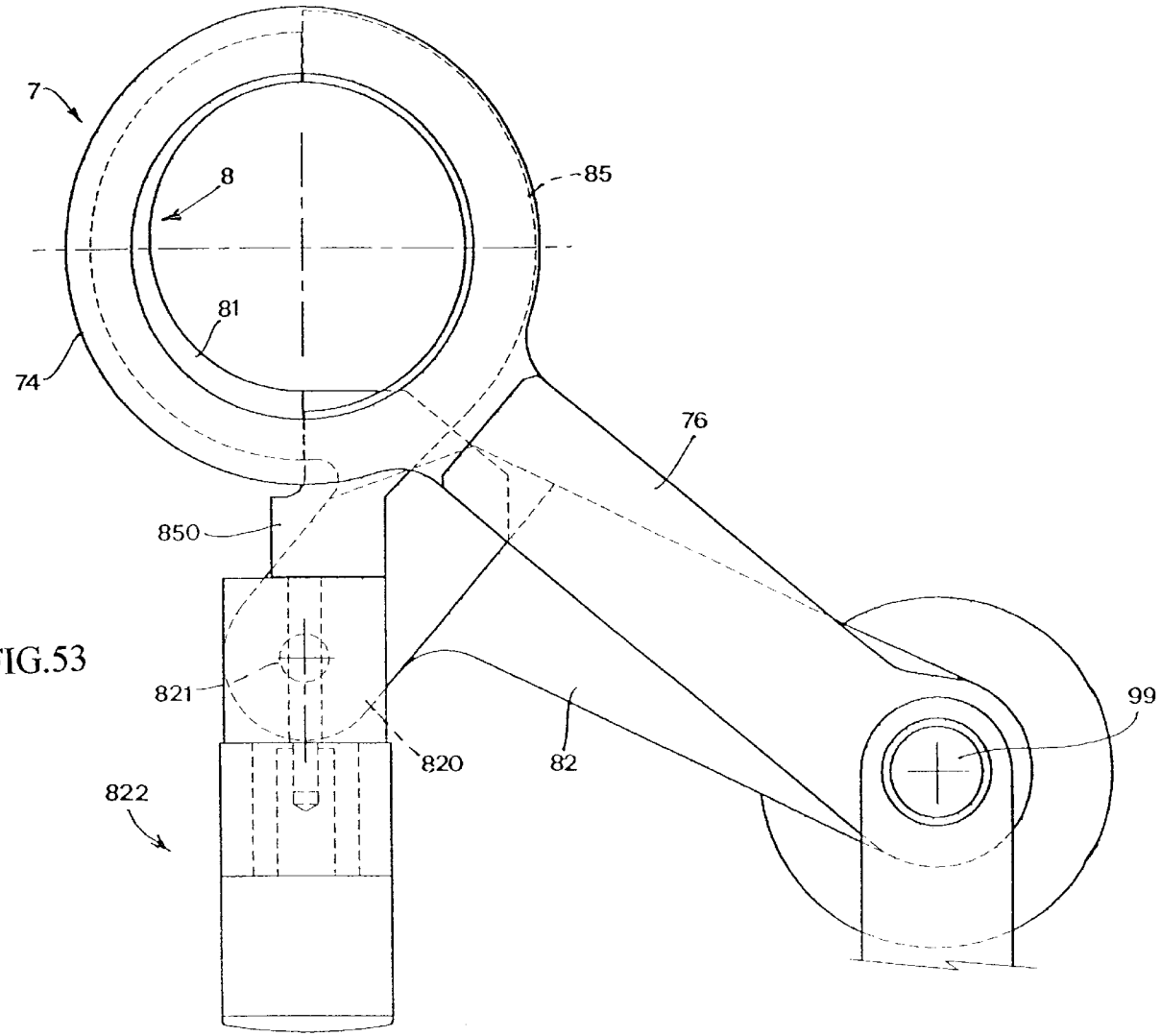
FIG. 53 is a plan view of the two movable units of FIGS. 46 and 49 being positioned in coaxial relationship.
Figure 54:
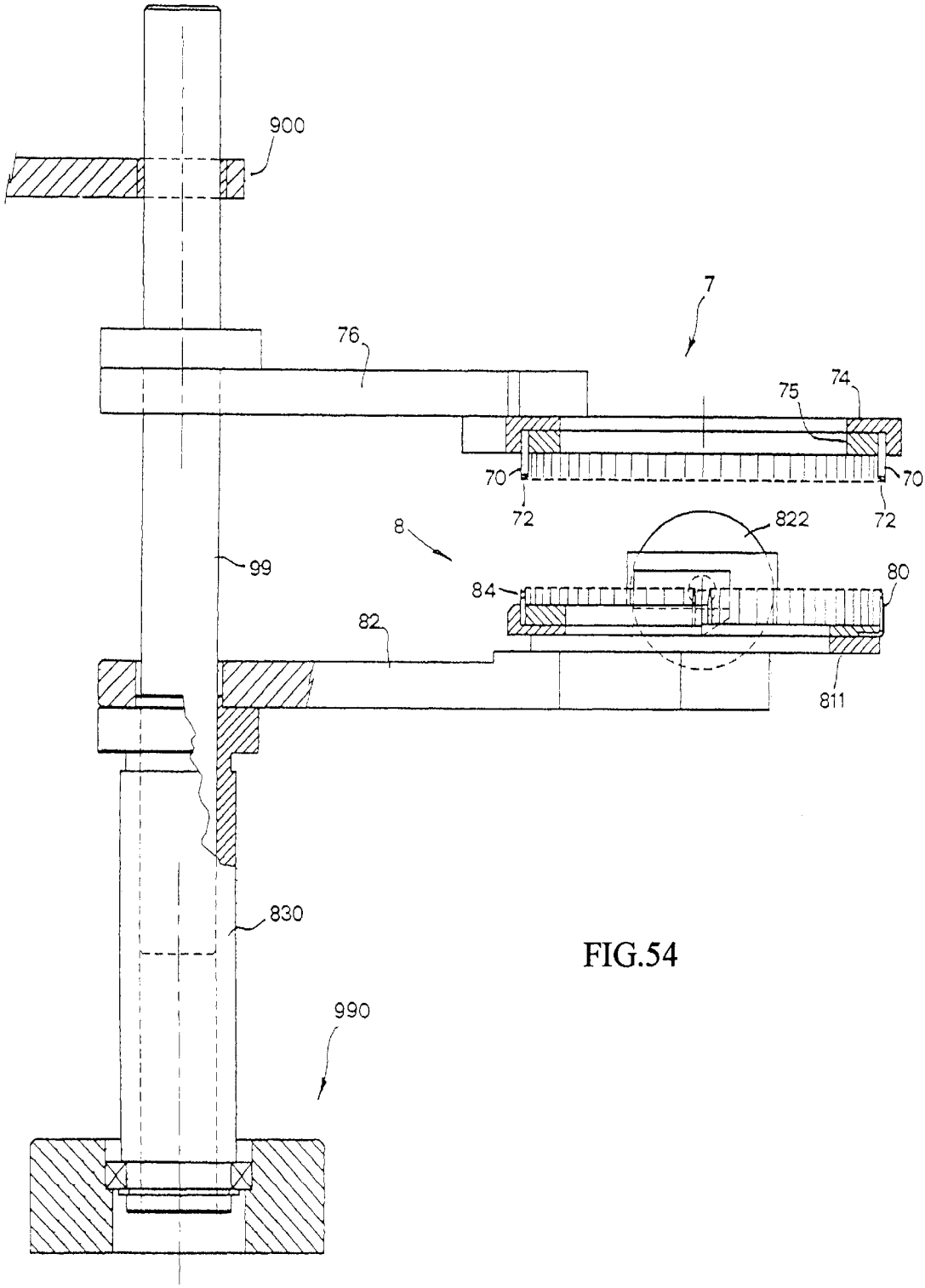
FIG. 54 is a side view of the movable units being positioned as shown in FIG. 53.
Figure 55:
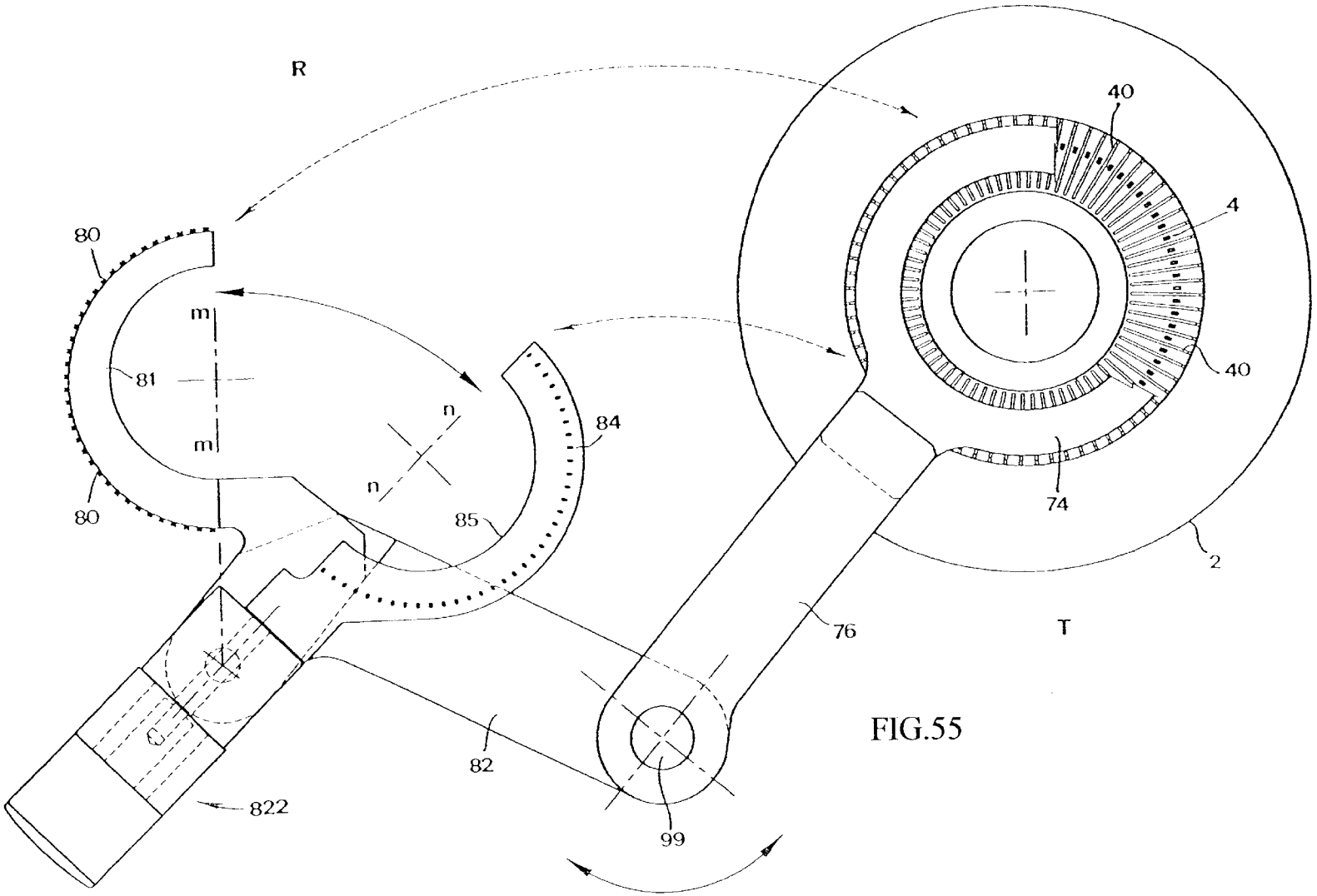
FIG. 55 shows the above said two movable units, with the first unit in operative position on the machine's textile head and with the second unit outside the textile machine, in a condition in which the respective semicrowns, being mounted like gripper jaws, are open ready to be placed in correspondence of the textile head without interfering with the article and suction tube present therein.
Figure 56:
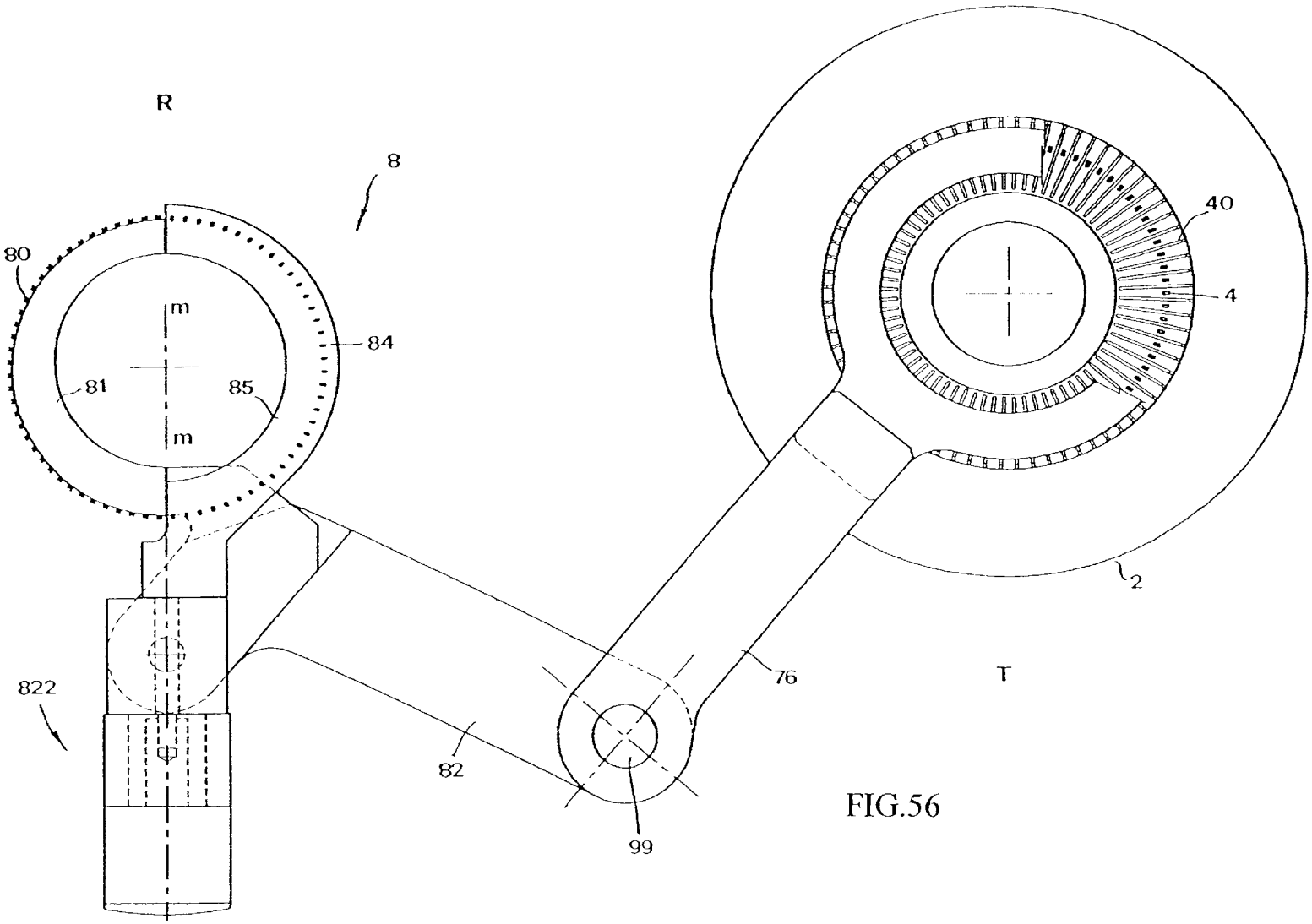
FIG. 56 is a view like that in FIG. 55, with the semicrowns of the second movable unit in closed condition to form a full circular crown.
Figure 57:
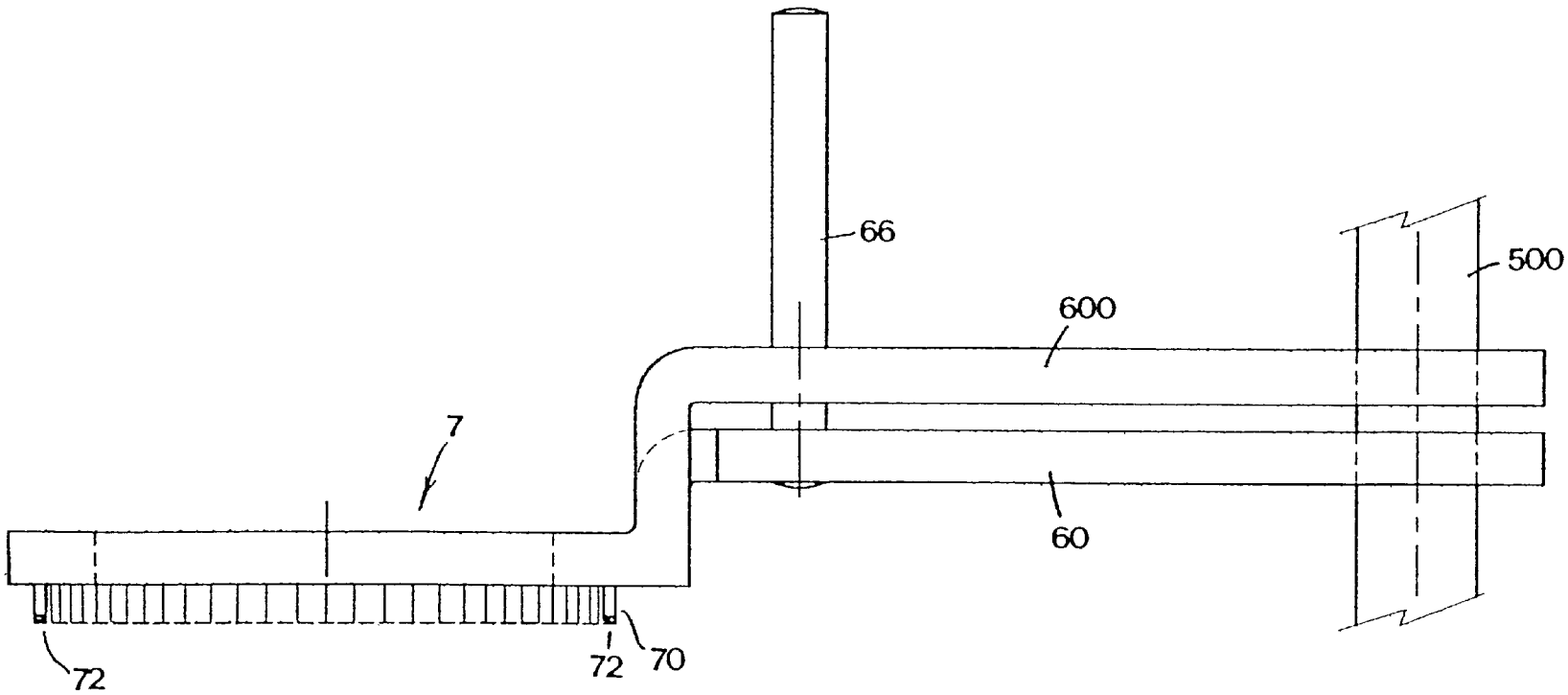
FIG. 57 shows the first movable unit, that is, the unit supporting the stitches-removing means, according to a further embodiment, with two complementary semicrowns able to translate vertically relative to each other in engagement condition.
Figure 58:
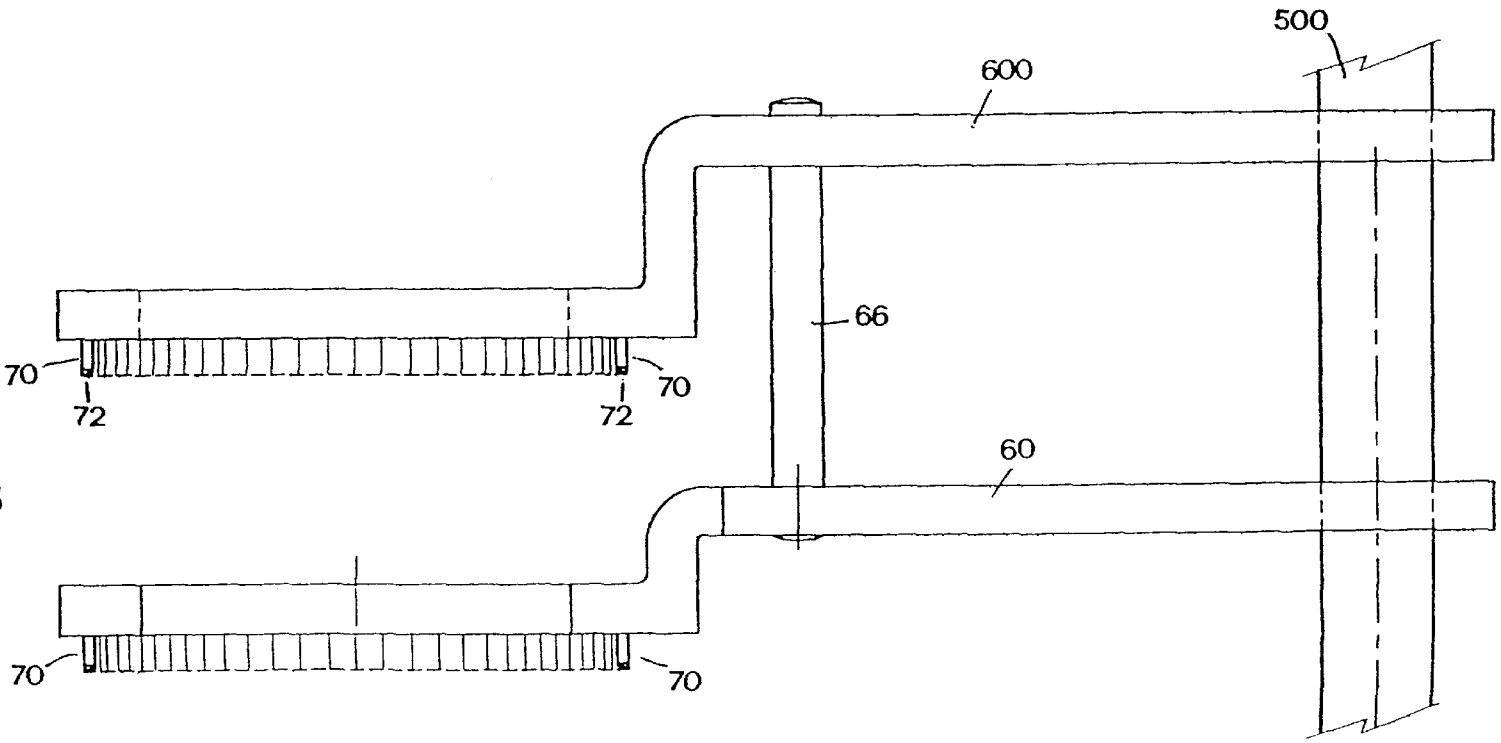
FIG. 58 FIG. 58 shows the means of FIG. 57, with the two semicrowns in spaced apart condition.
Figure 59:
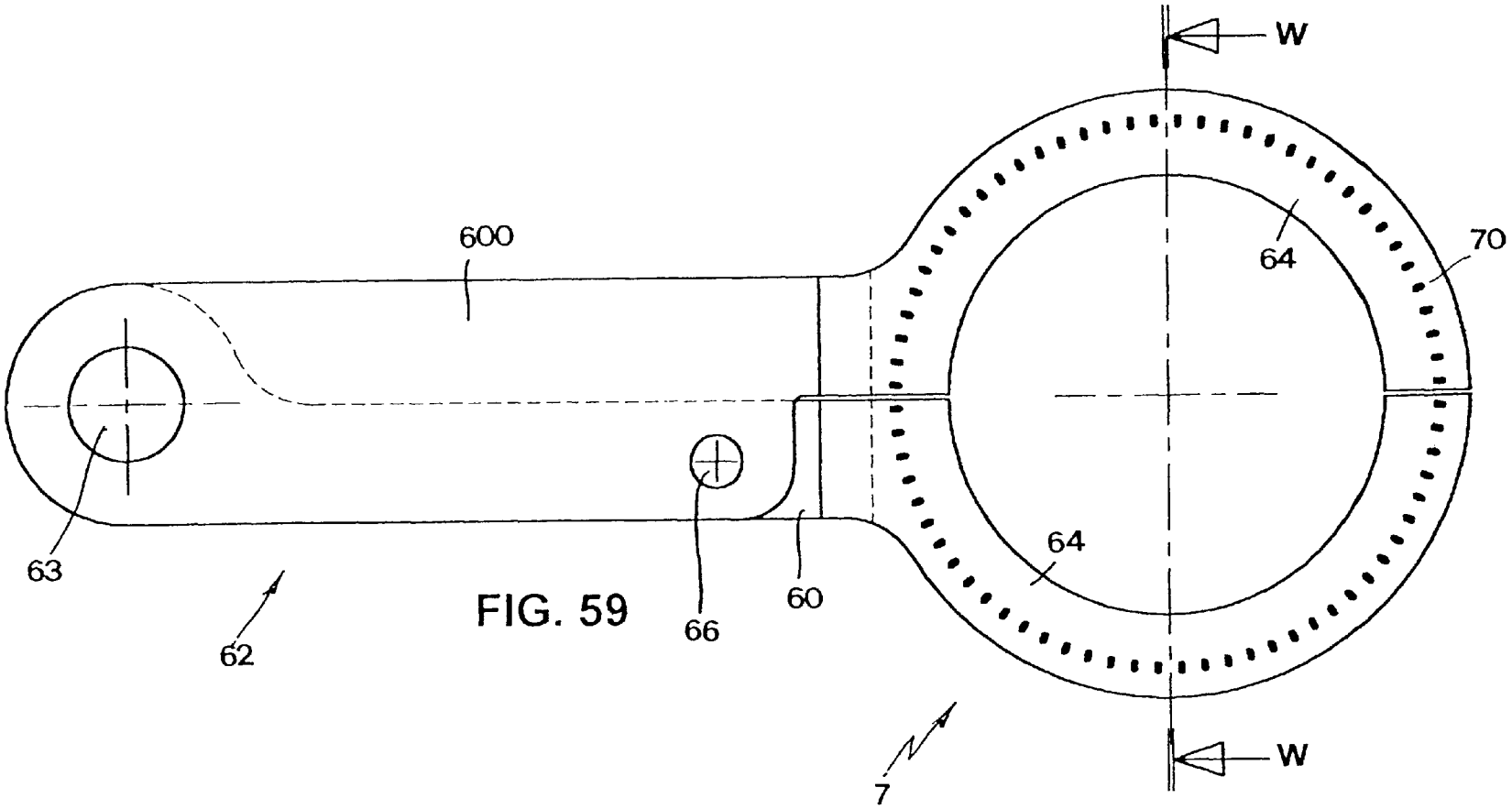
FIG. 59 is a plan view of the details relative to FIGS. 57 and 58.
Figure 60:
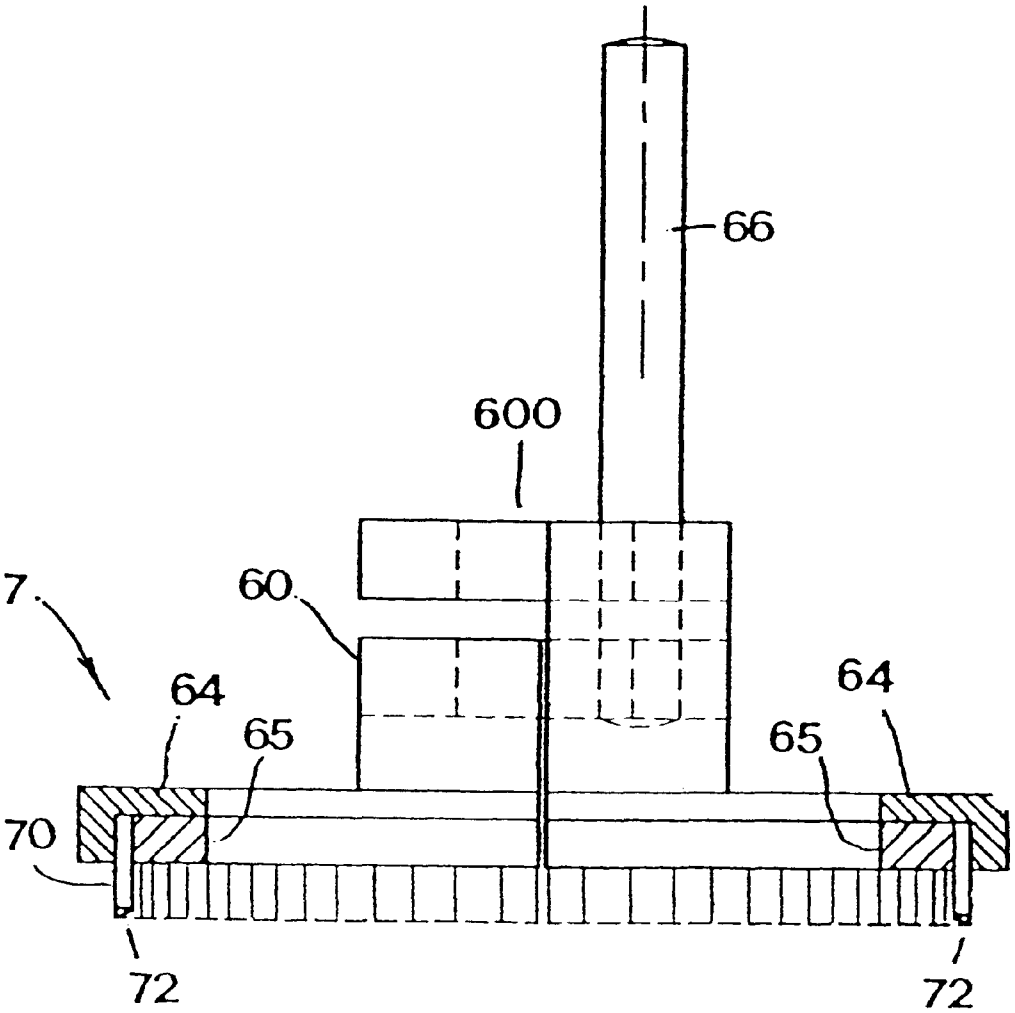
FIG. 60 is a view in section taken on line W—W of FIG. 59 in the condition illustrated in FIG. 57.
Figure 61:
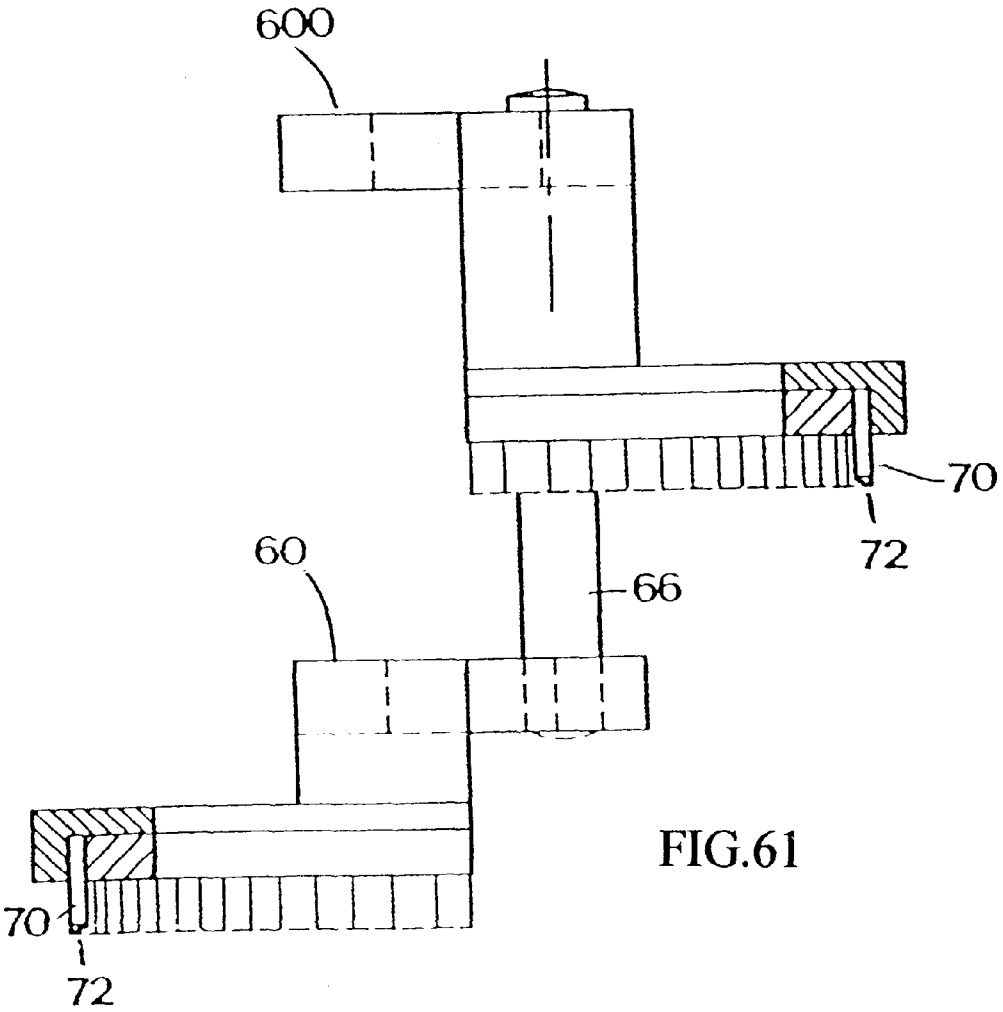
FIG. 61 is a view in section taken on line W—W of FIG. 59 in the condition illustrated in FIG. 58.
Figure 62:
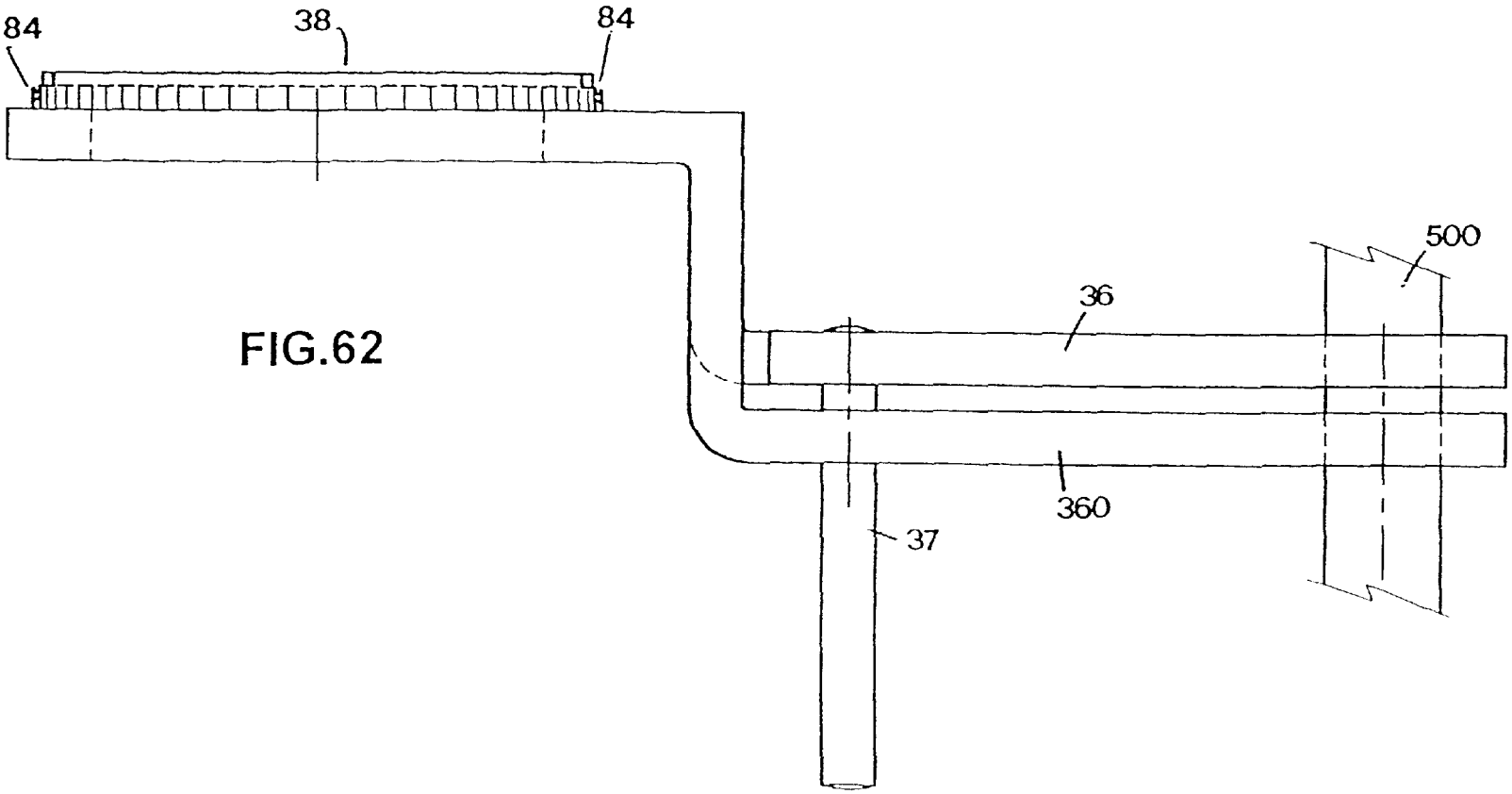
FIG. 62 shows the second movable unit according to a further embodiment.
Figure 63:
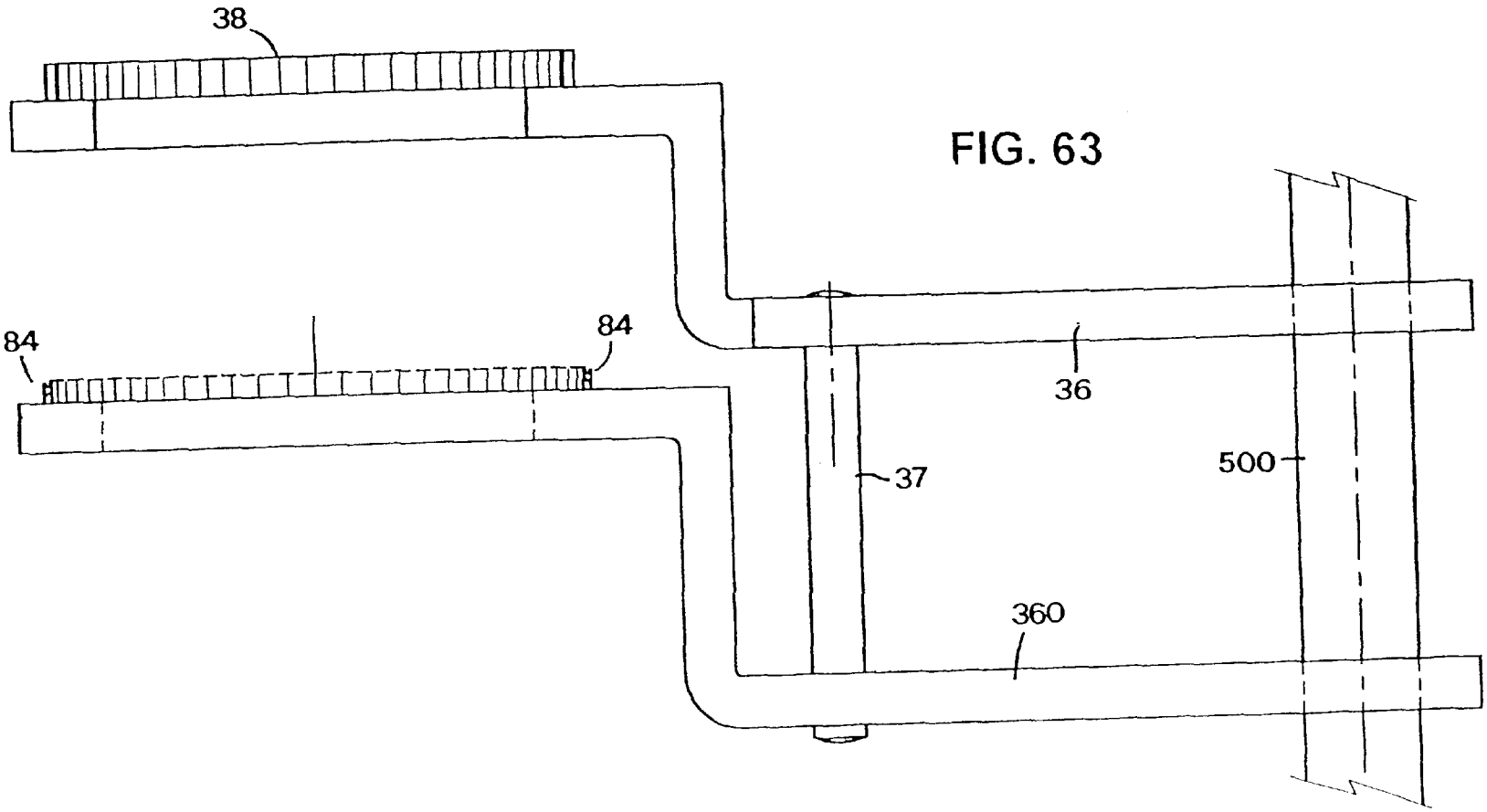
FIG. 63 shows the means of FIG. 62, with the respective semicrowns in spaced apart condition.
Figure 64:
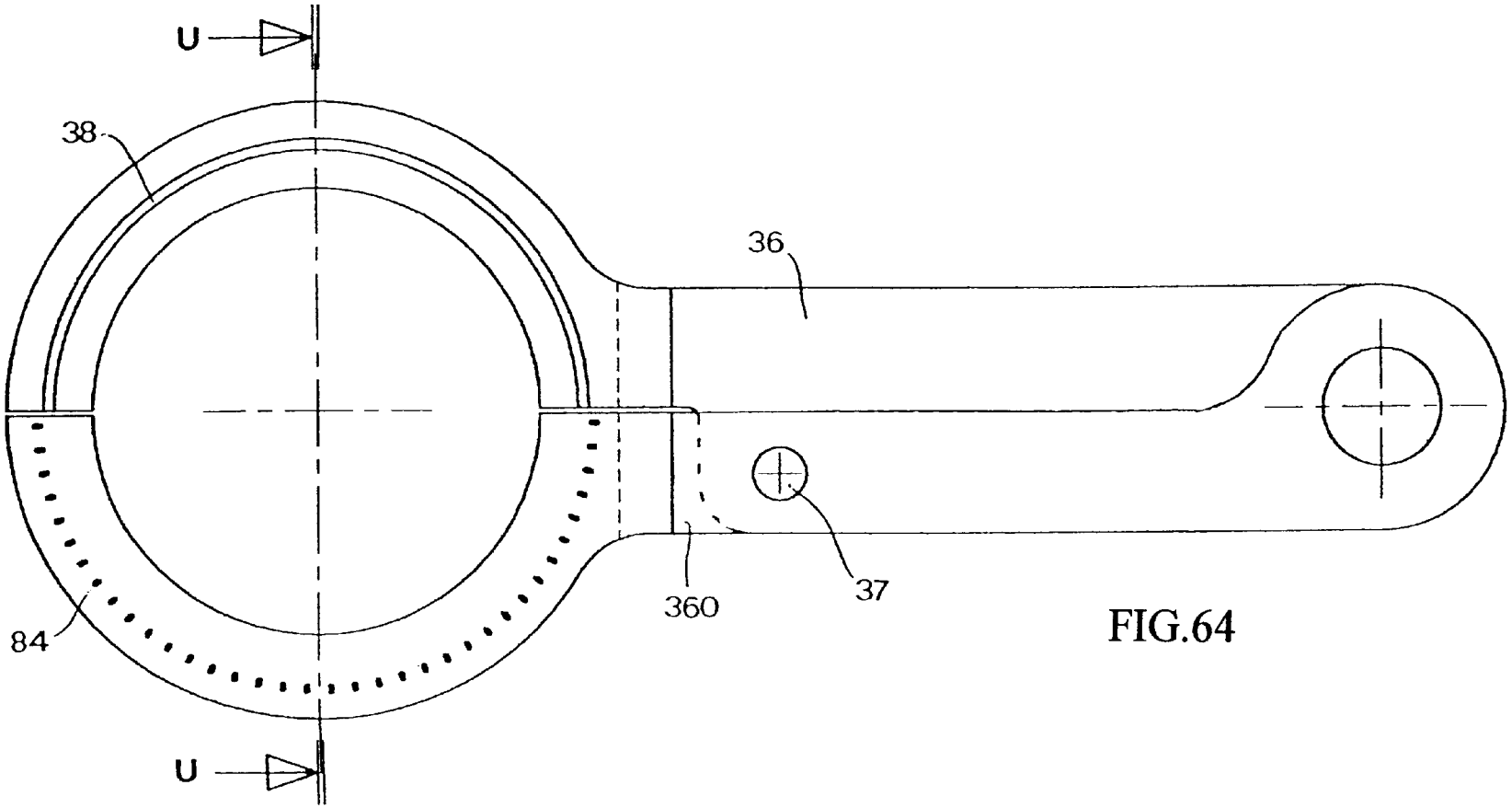
FIG. 64 is a bottom view of the details relative to FIGS. 62 and 63.
Figure 65:
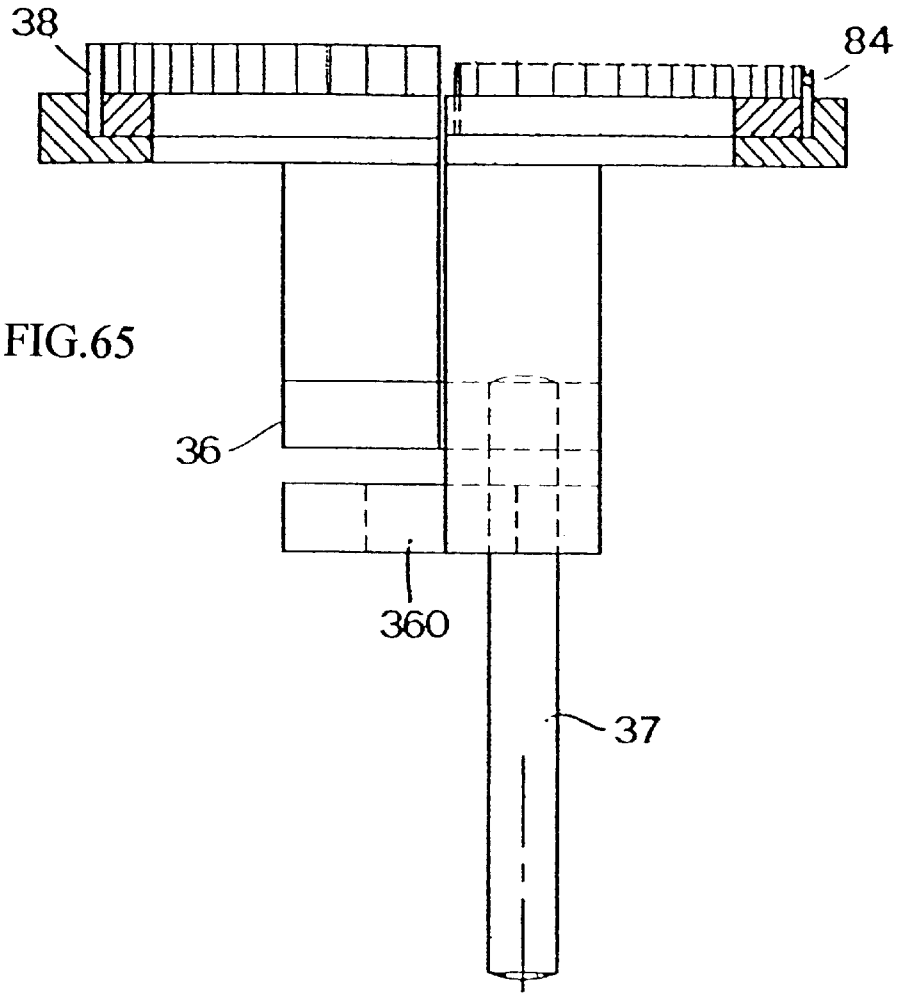
FIG. 65 shows a view in section taken on line U—U of FIG. 64, with the semicrowns coupled as shown in FIG. 62.
Figure 66:
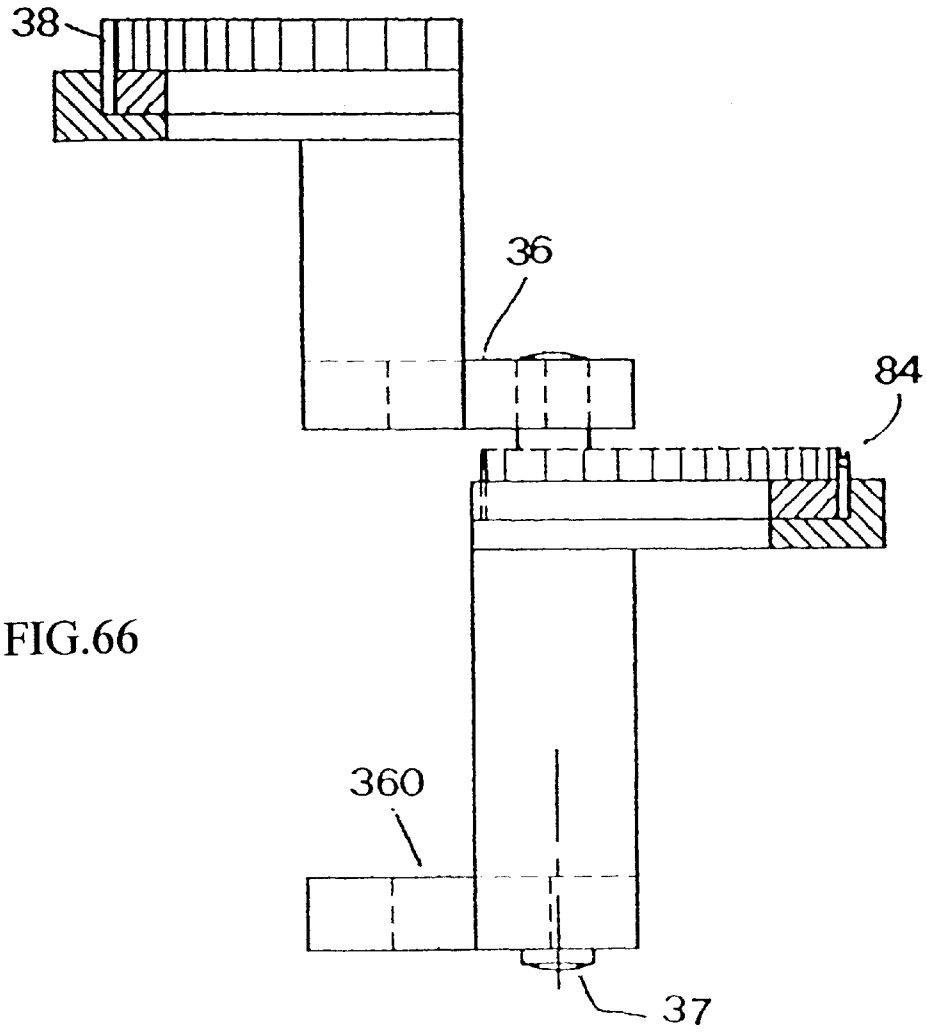
FIG. 66 is a section view taken on line U—U of FIG. 64, with the semicrowns spaced apart as in FIG. 63.
Figure 67:
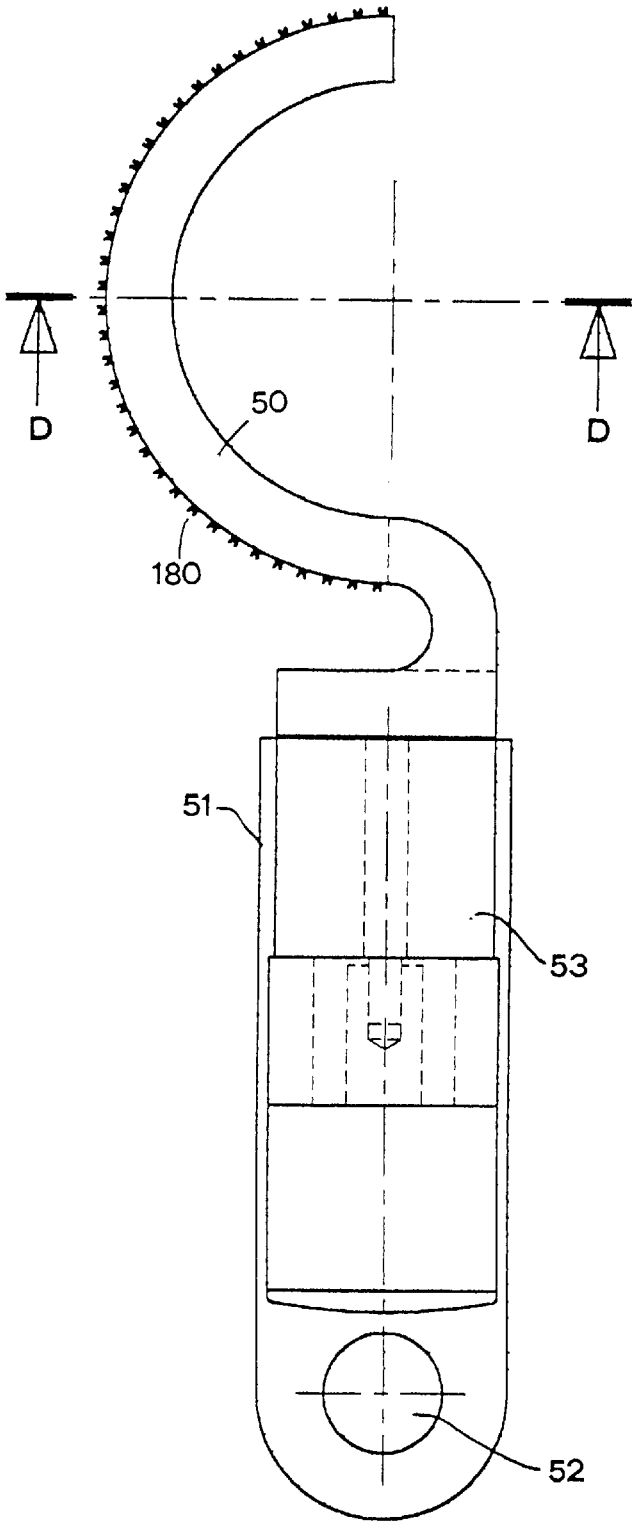
FIG. 67 is a plan view of a third movable unit able to be associated to the units of FIGS. 59 and 64.
Figure 68:
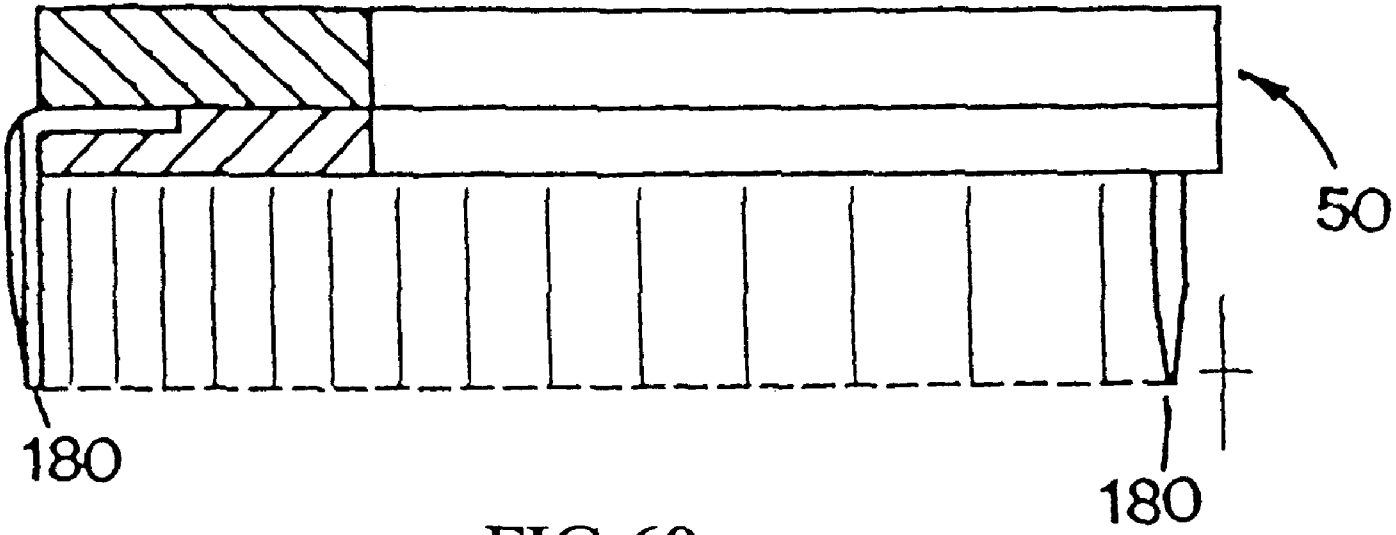
FIG. 68 is a view in section taken on line D—D of FIG. 67.
Figure 69:
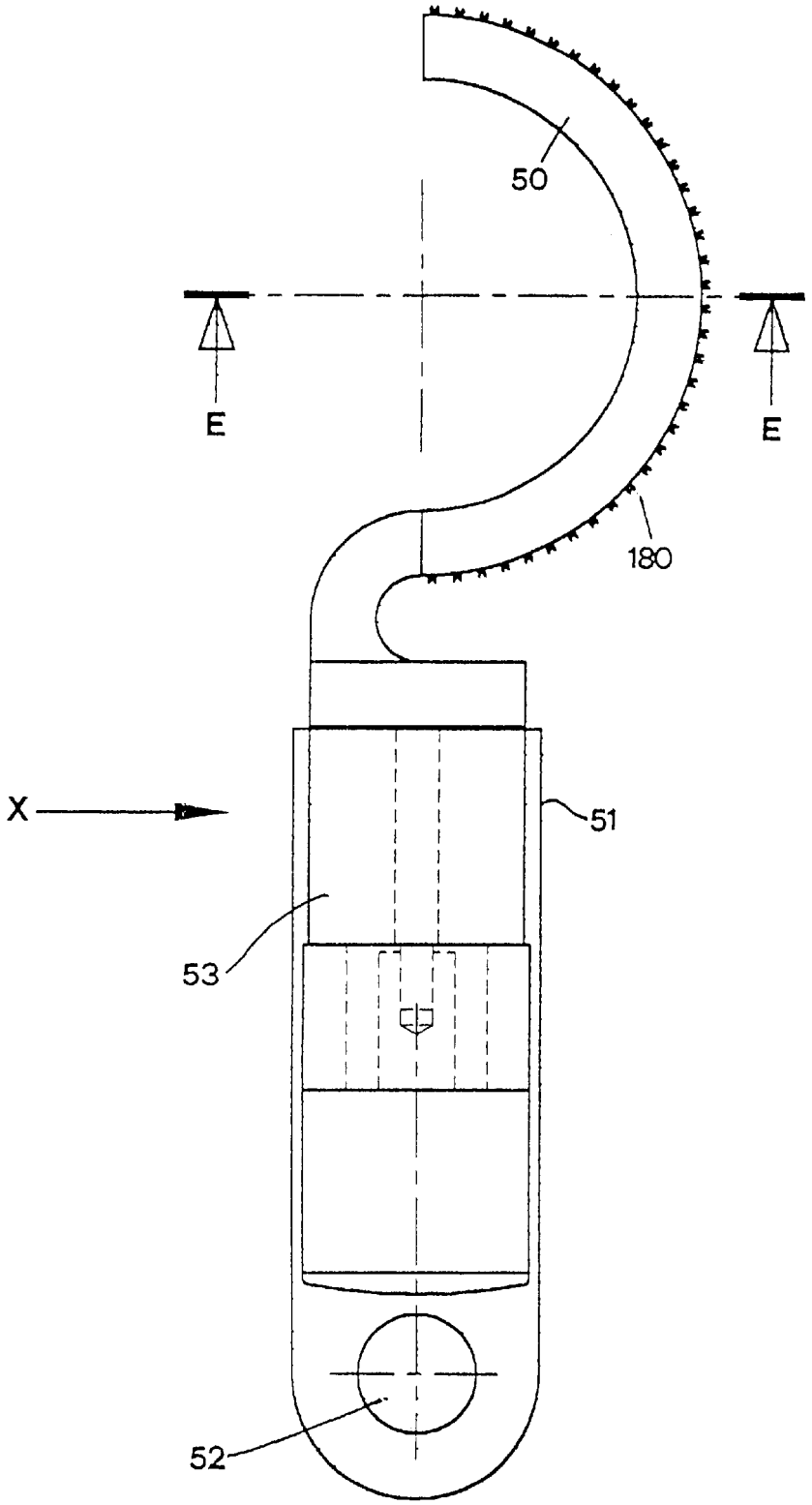
FIG. 69 shows the movable unit, with the respective semicrown overturned through 180° about the axis n—n.
Figure 70:
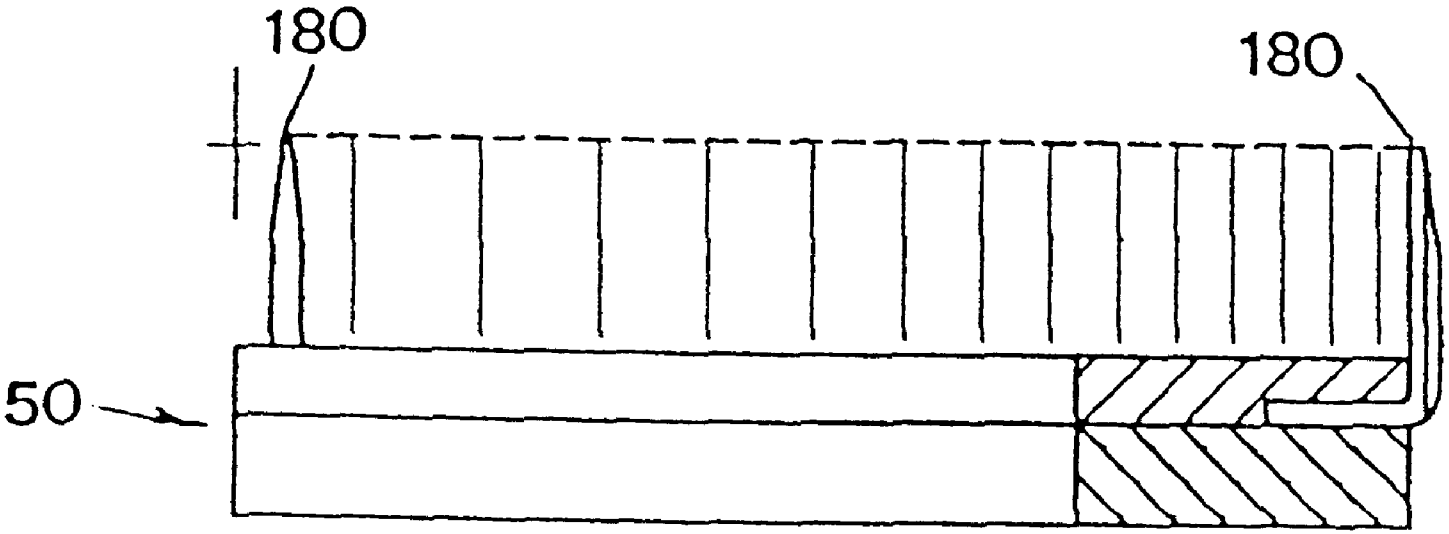
FIG. 70 is a view in section taken on line E—E of FIG. 69.
Figure 71:
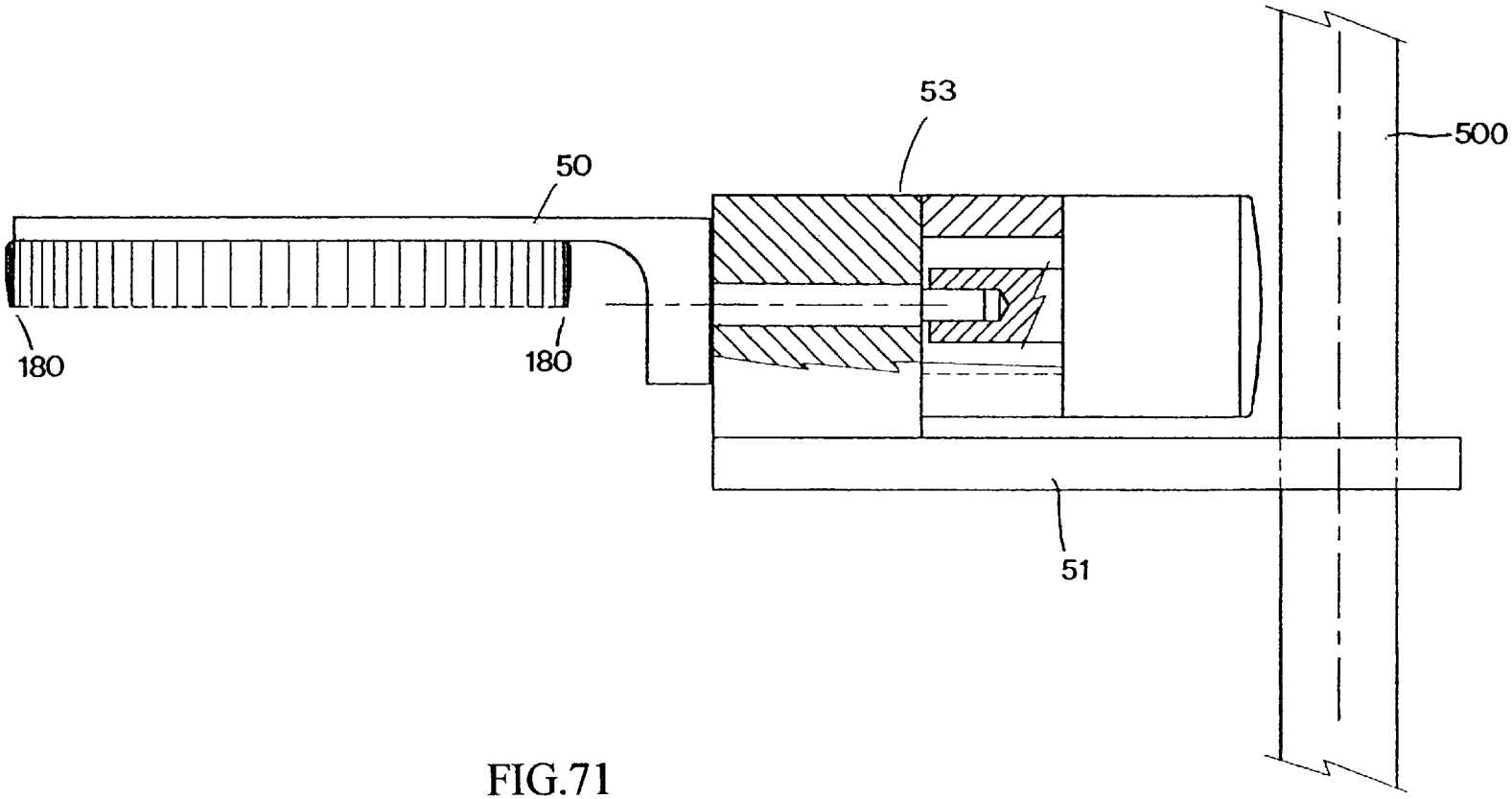
FIG. 71 is a view from "X" of the movable unit of FIG. 69, which shows the relevant rotary actuator and a partial section of the pivot of the relevant semicrown and corresponding support block.
Figure 72:
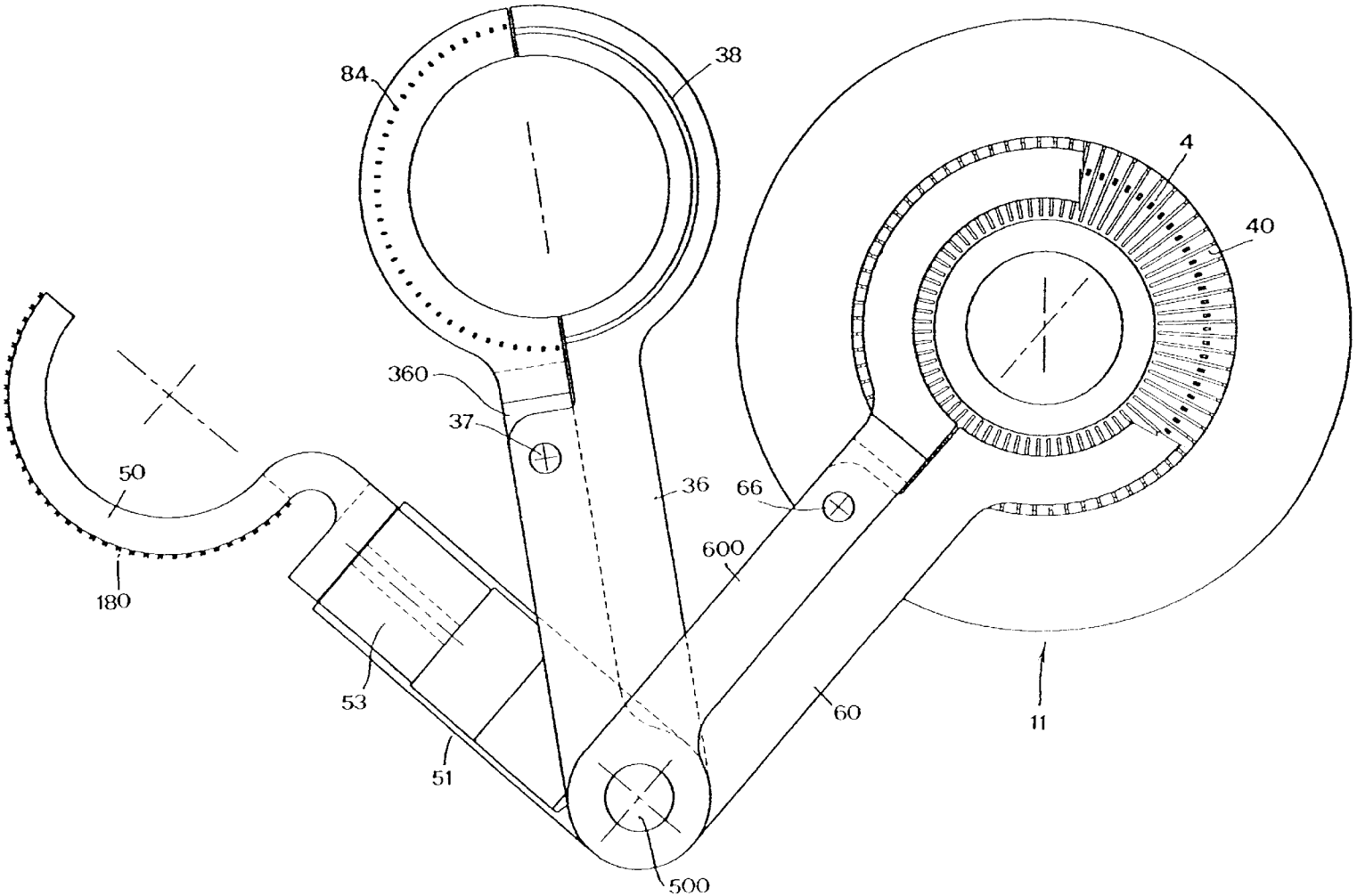
FIG. 72 is a plan view of said three movable units on the common support column.
Figure 73:
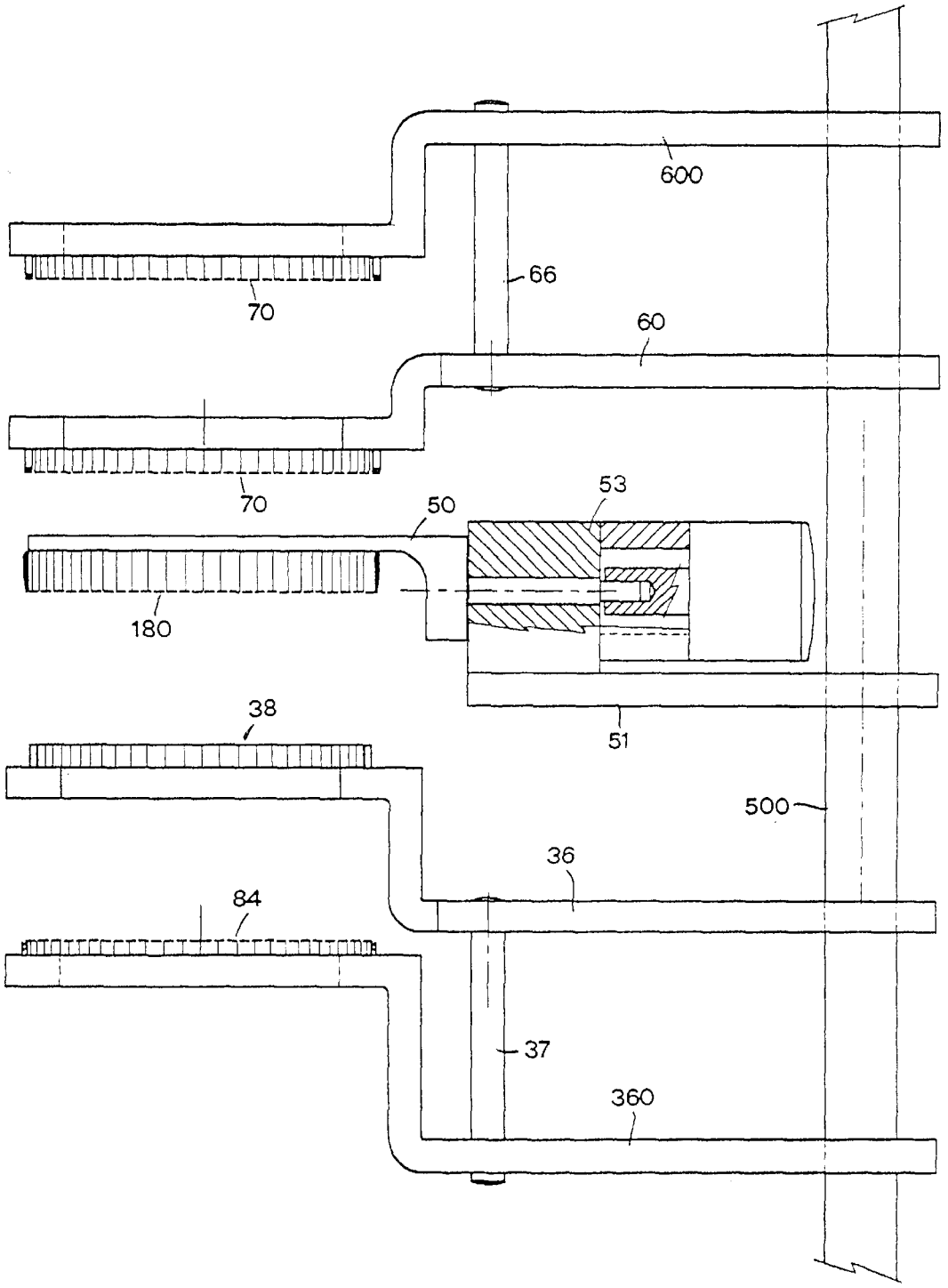
FIG. 73 is a side view of the units of FIG. 72, with the semicrowns of each unit in spaced apart condition.
Figure 75B:
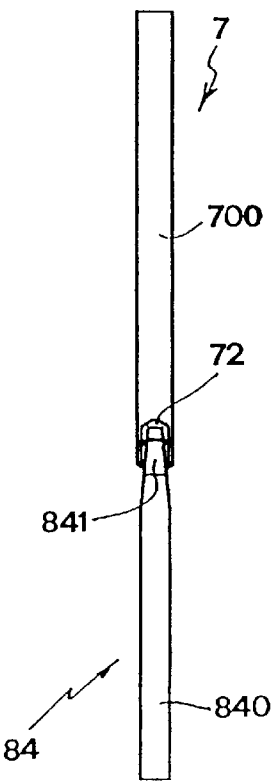
FIGS. 75A and 75B show the members of FIGS. 74A and respectively 74B, in engagement to each other, that is, in a stitch-changeover condition.
Figure 75A:
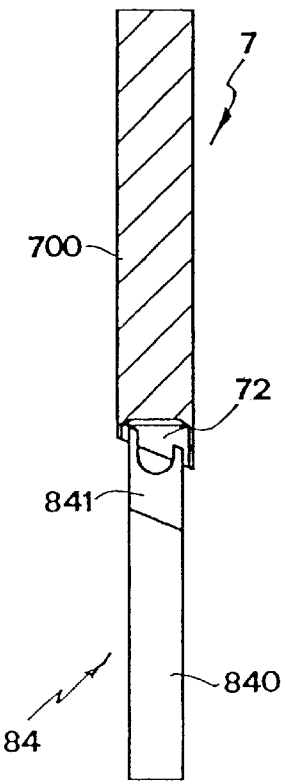
Figure 74B:
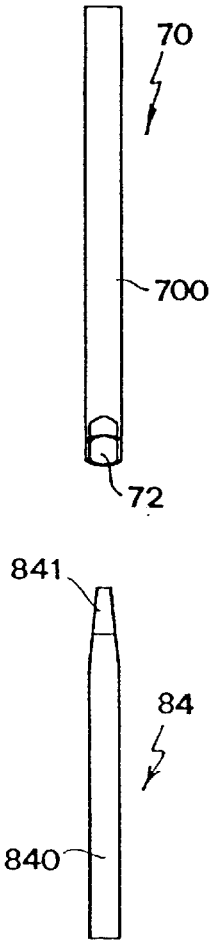
FIGS. 74A and 74B show a removal member (70) and a transfer member (84) in spaced apart condition, respectively in side view and front view.
Figure 74A:
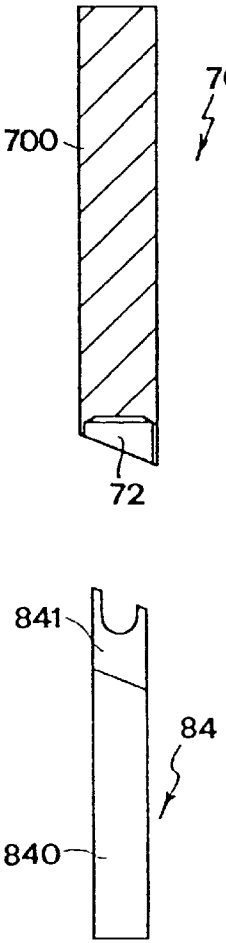
Figure 76A:
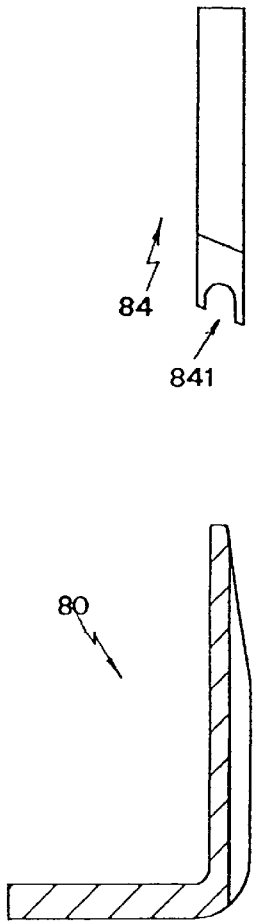
FIGS. 76A and 76B show a transfer member (84) and a spike (80) in spaced apart condition, respectively in side view and in front view.
Figure 76B:
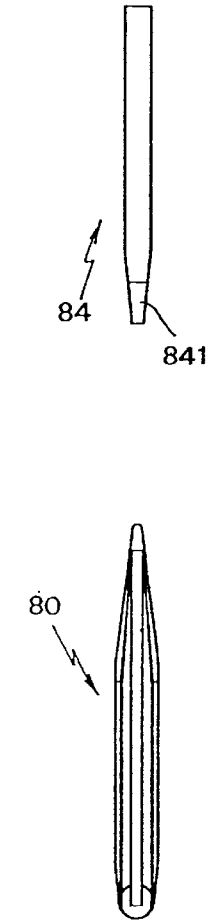
Figure 77A:
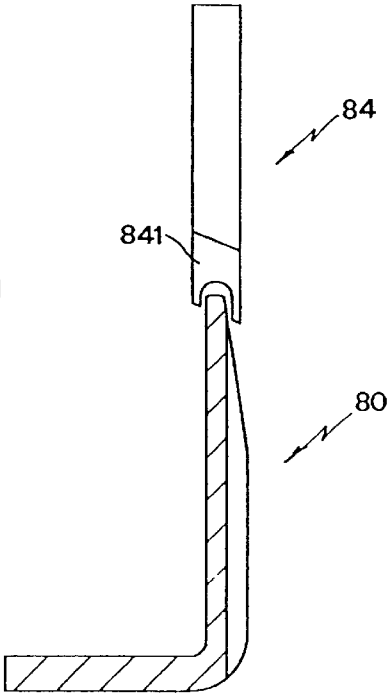
FIGS. 77A and 77B show the members of FIG. 76A and 76B in engagement to each other, that is, in a stitch-changeover condition.
Figure 77B:
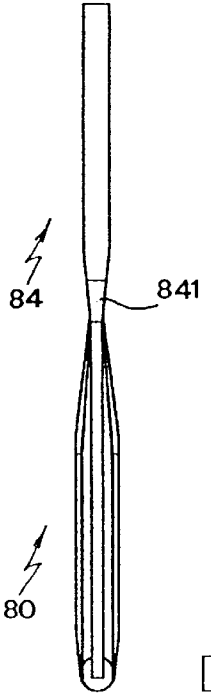
Figure 78B:
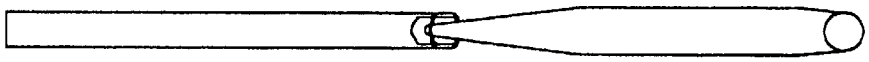
FIGS. 78A and 78B show schematically in front view and respectively in side view, the engagement between a removal member (70) acting as a transfer member, and a hooking-up spike (80).
Figure 78A:
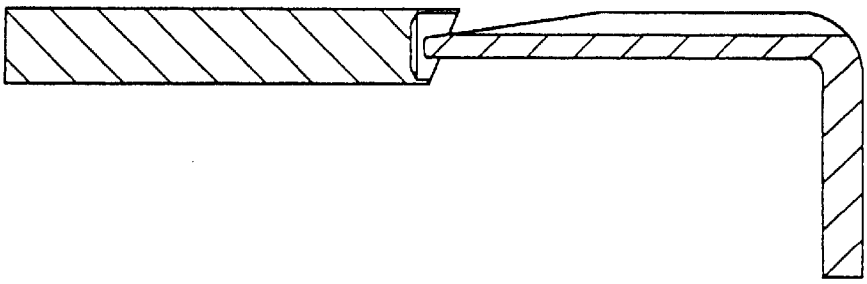

The support (85) of said bodies (84) is provided with a radial appendix (850) connected by a hing (821) to an external side appendix (820) of the arm (82), the hinge axis being orthogonal to the arm so that the two supports (81, 85) associated to this arm will take up the form of two semicircular jaws of a gripper with the possibility of closing up around the tube (3) and/or around the article (C) at station (T) in order to take up, in said closed condition, the configuration of a circular crown corresponding to the support (74, 75) of the removal members (70). To rotate the support (85) about the said axis (m—m), the radial appendix (850) of support 8(5) is associated to a rotary actuator (822) whose axis lies on the extension of the diametrical axis (n—n) of support (85). In the condition shown in FIG. 49, said axes (m—m) and (n—n) overlap.

Figure 37:
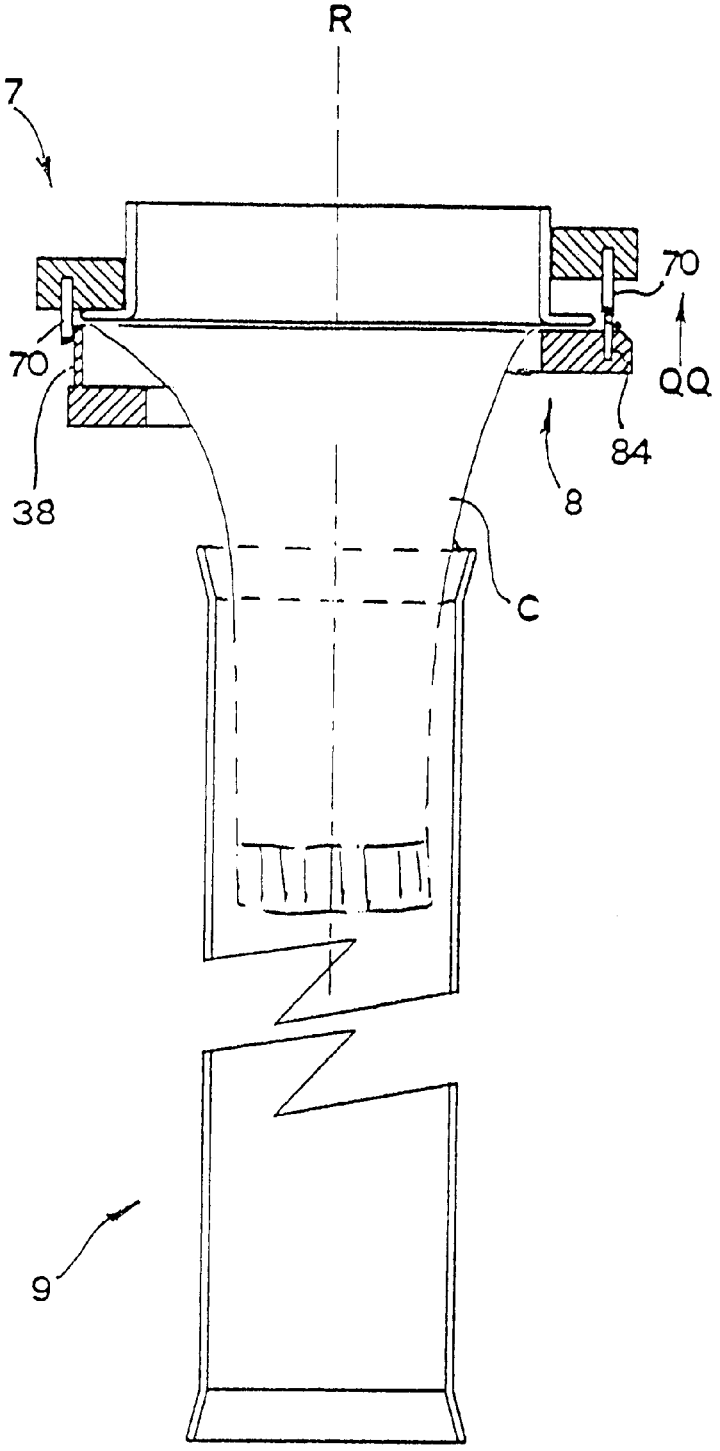
Figure 38:
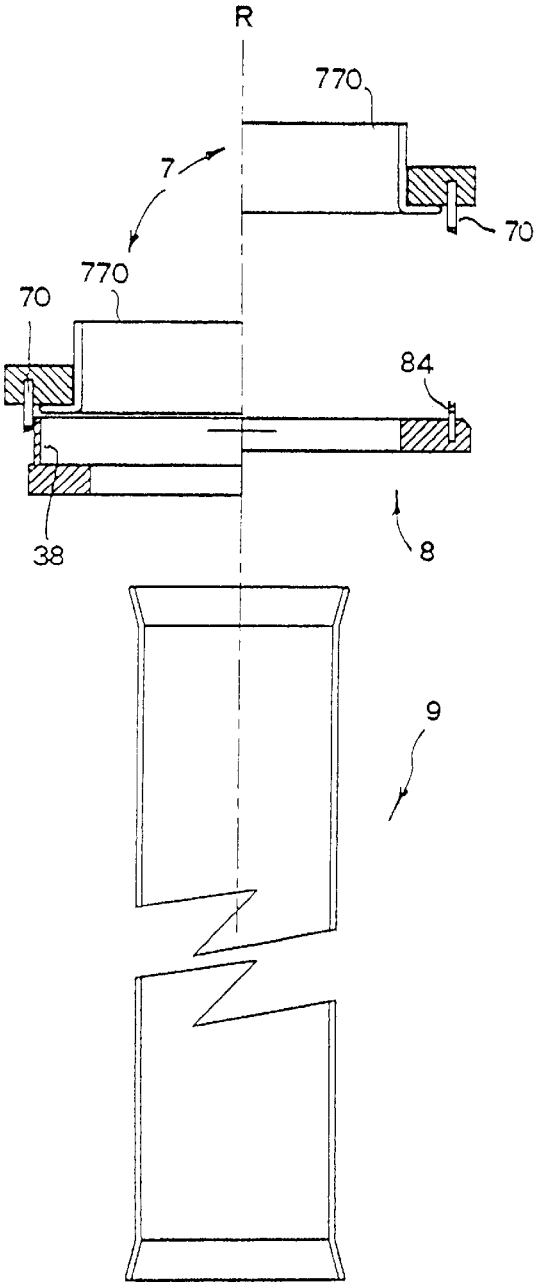
Figure 39:
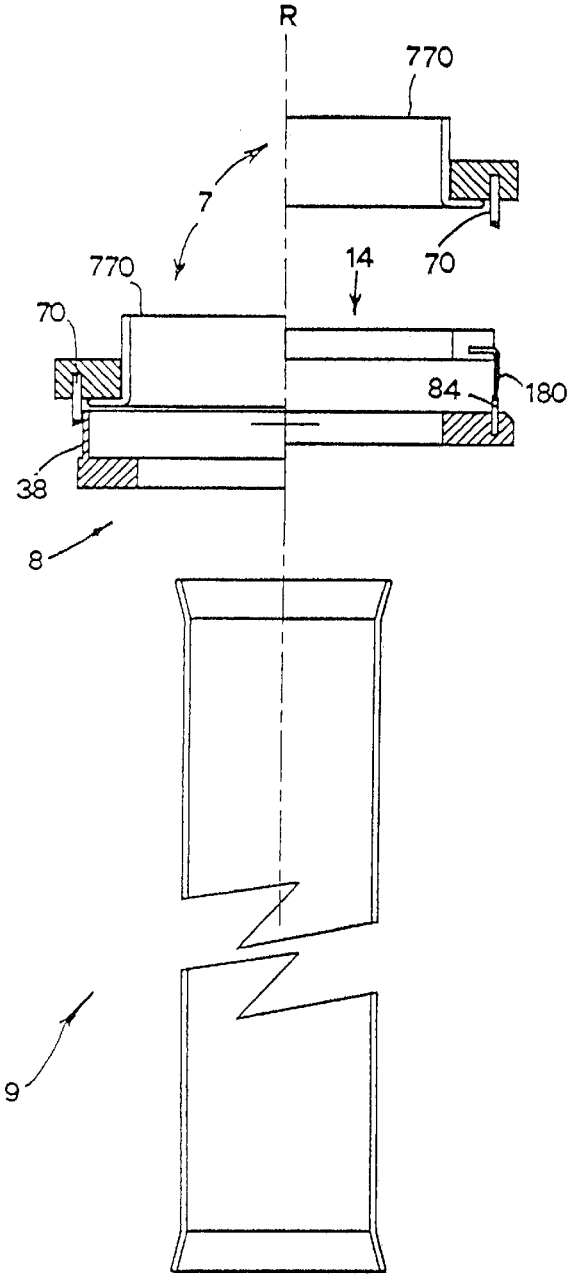
Figure 40:
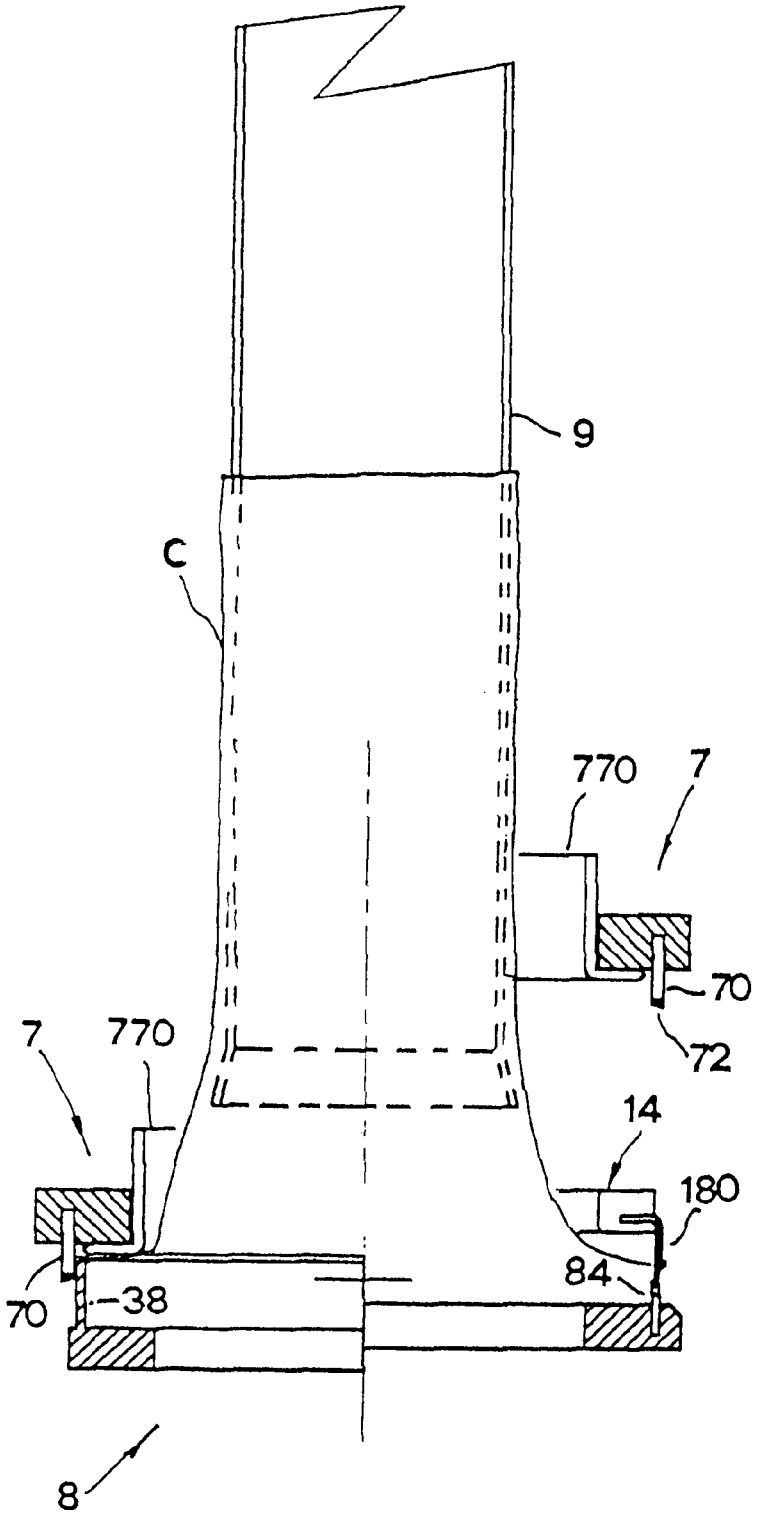
Figure 41:
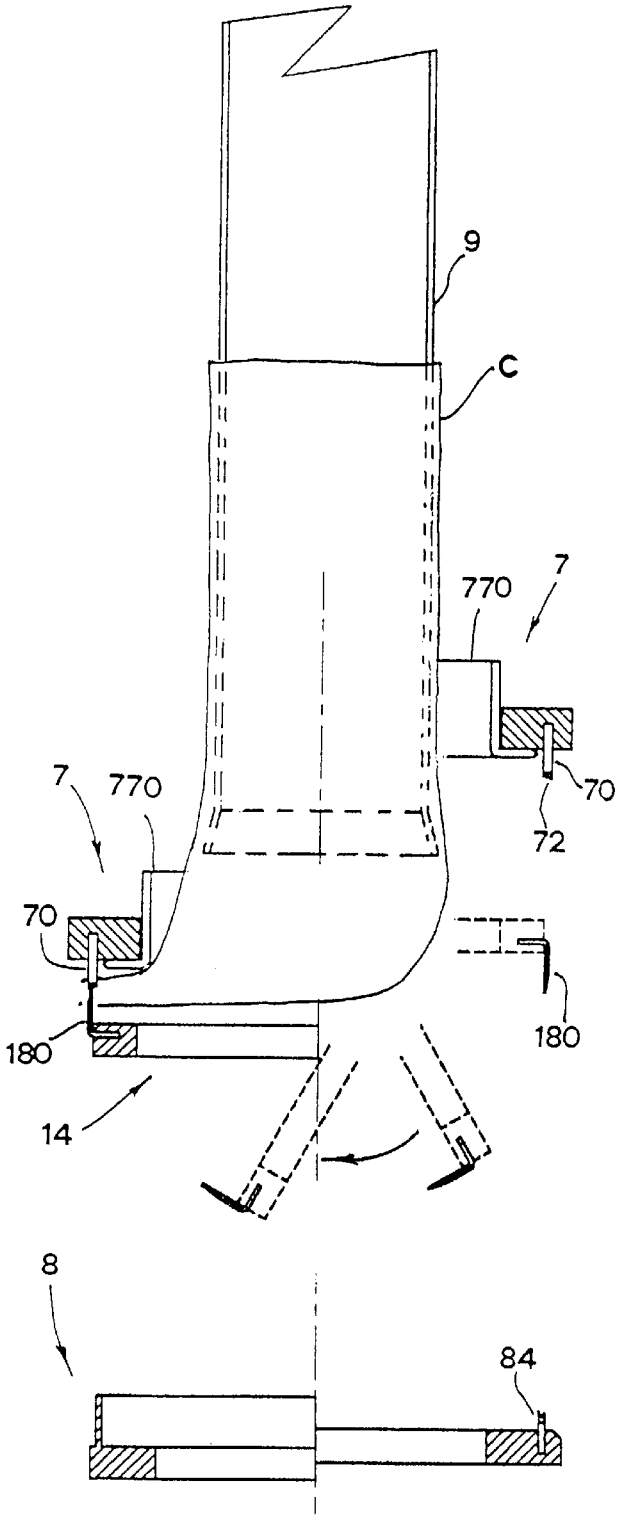
Figure 42:
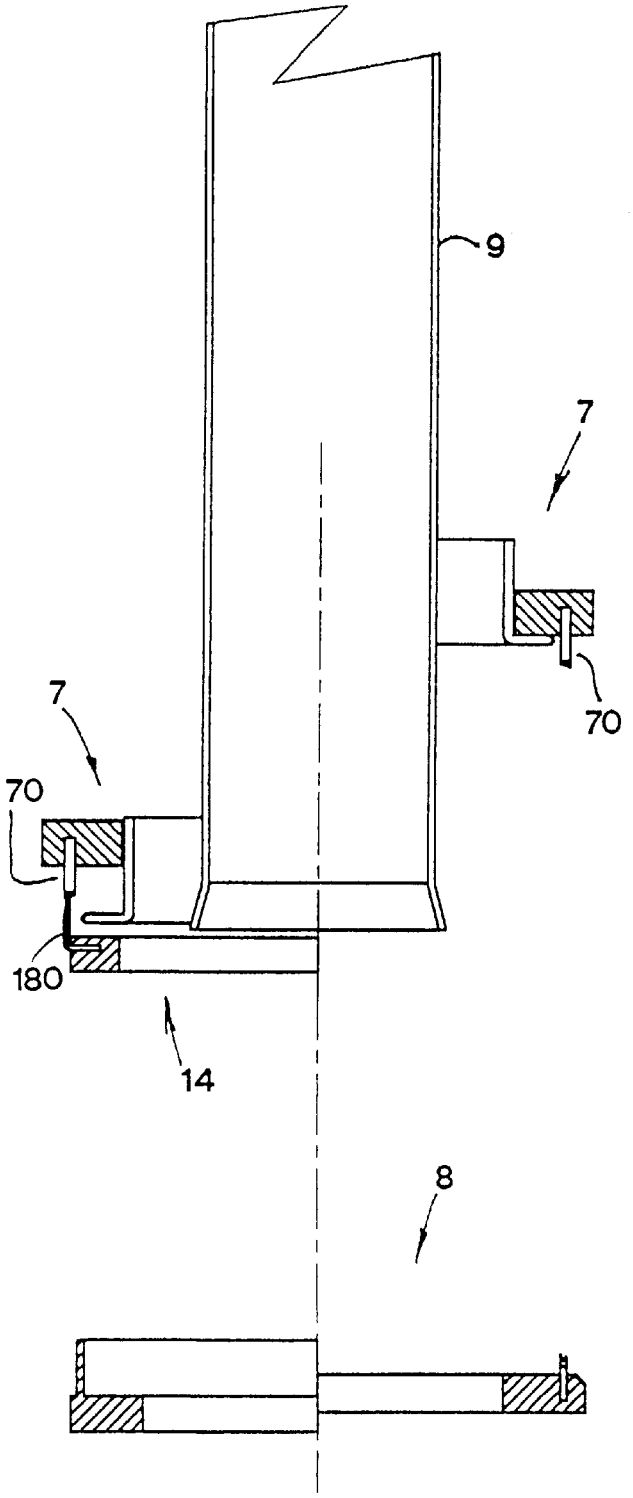
Figure 43:
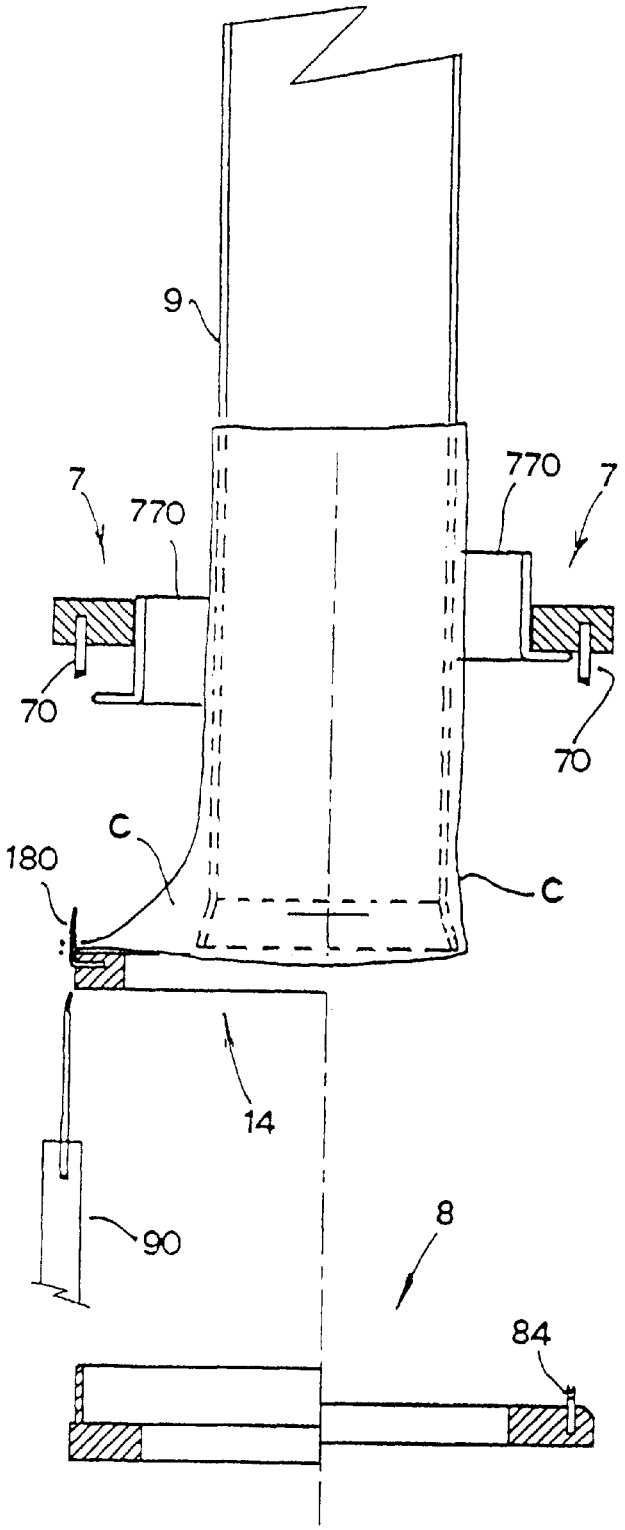
Figure 44:
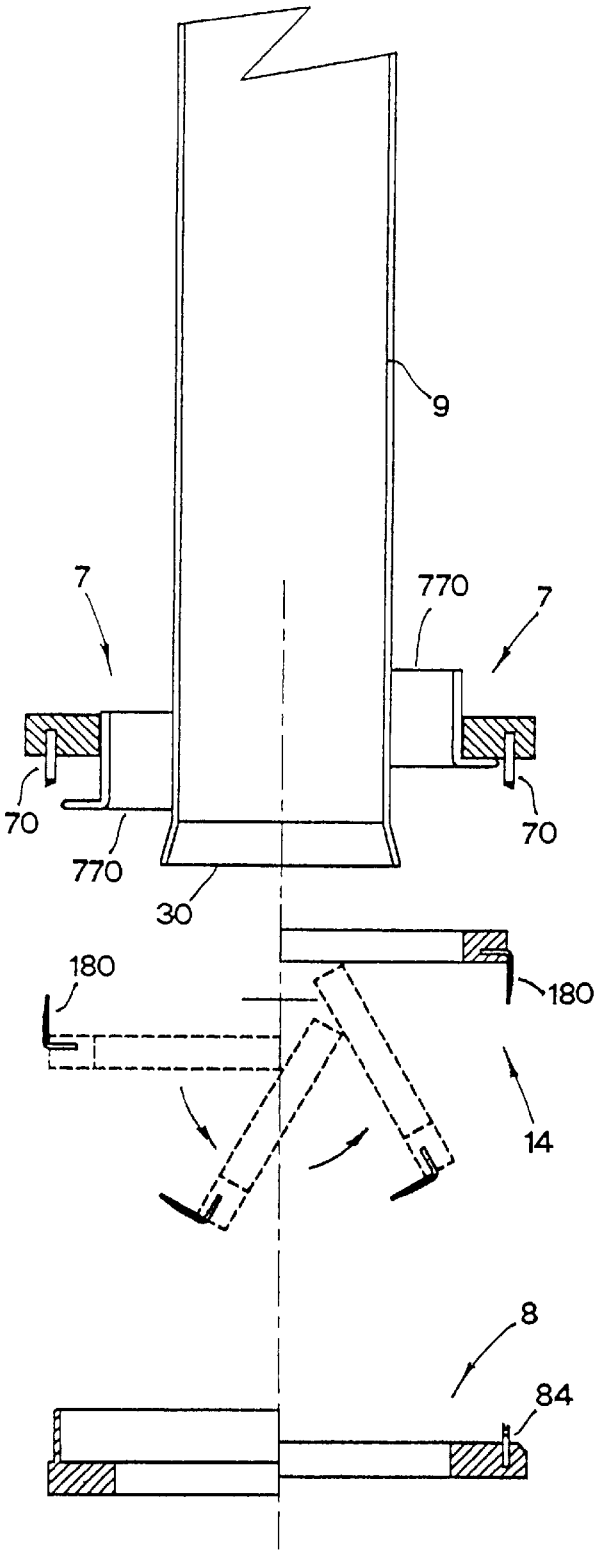
Figure 45:
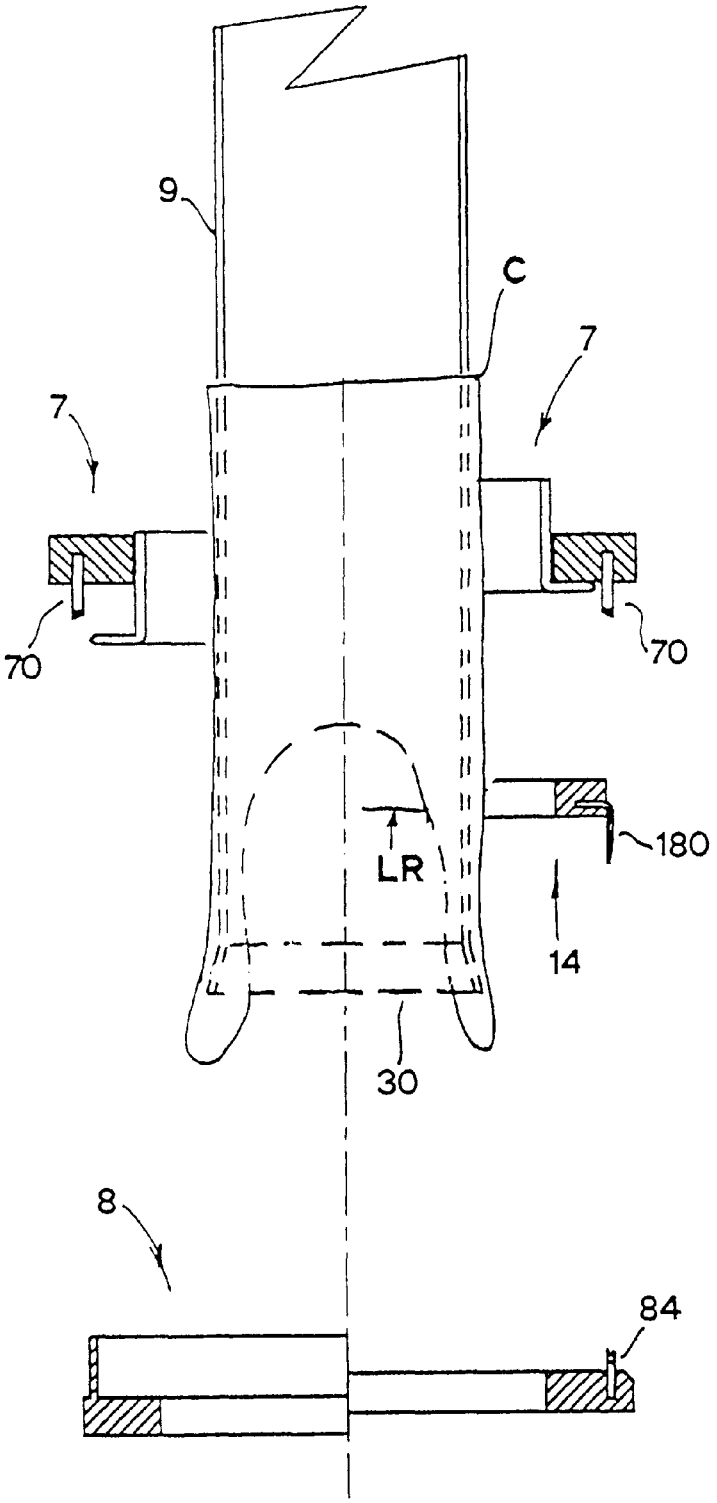
Figure 46:
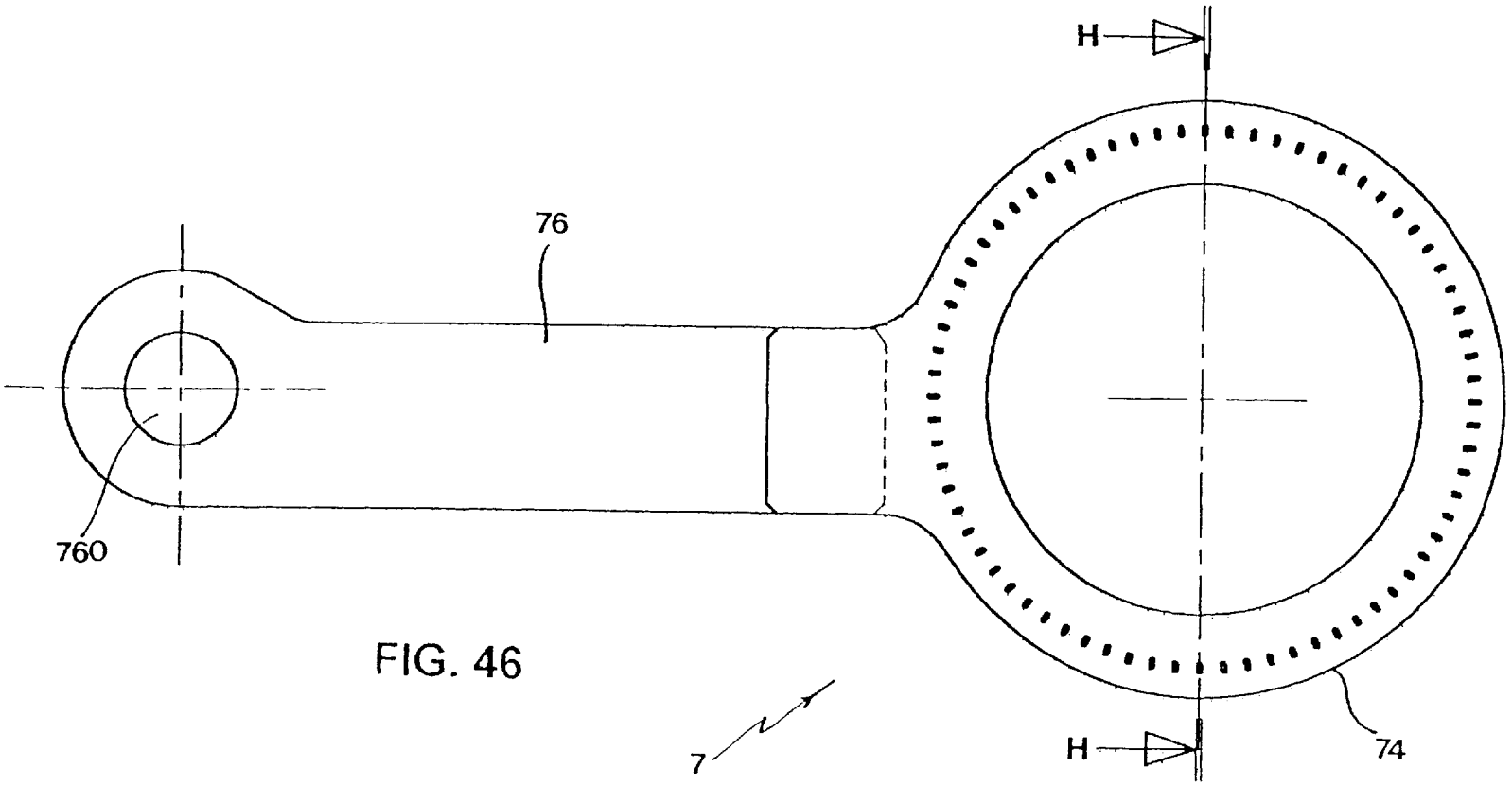
FIG. 46 is a plan view of the first movable unit for the support and motion of the stitches-removing means.
Figure 47:
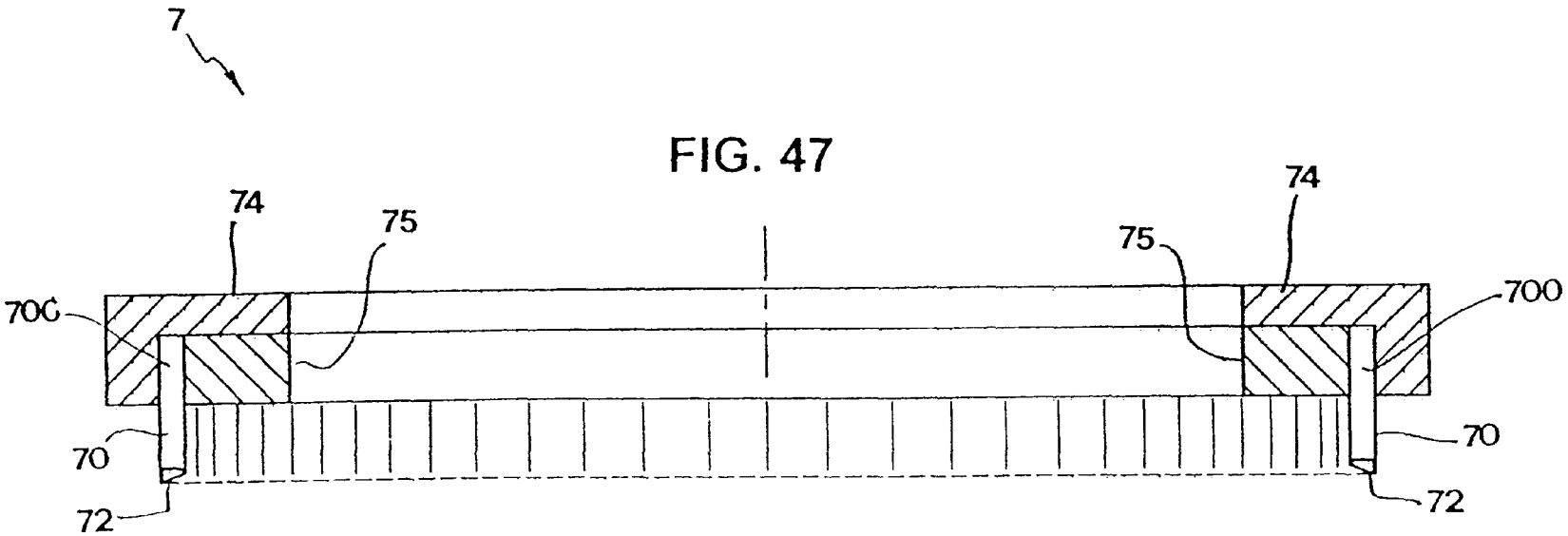
FIG. 47 is an enlarged sectional view taken on line H—H of FIG. 46.
Figure 48:
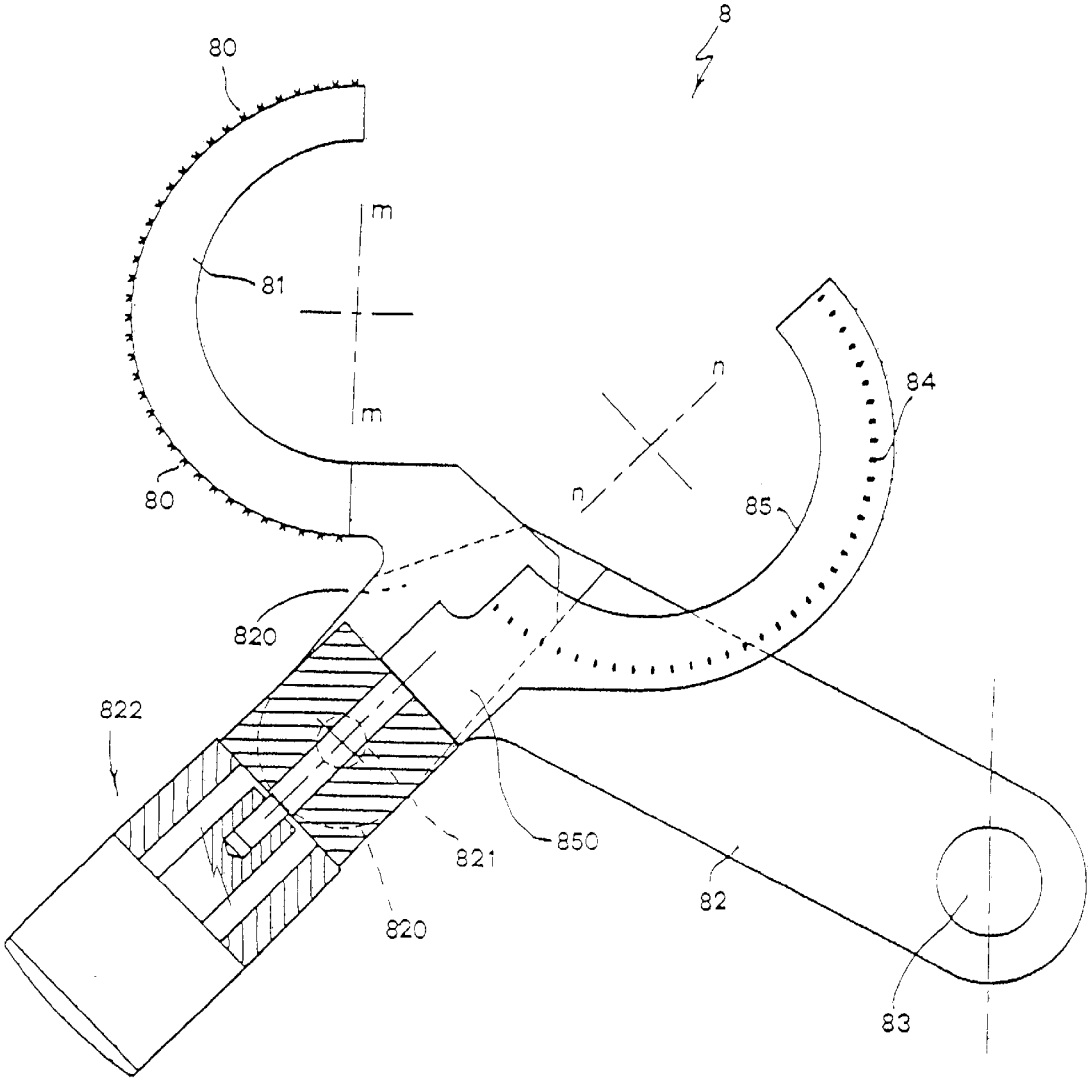
FIG. 48 is a plan view of the second movable unit for the support of means for overturning the stitches of the first semirank, and the hook-up support means, according to a feasible embodiment, said unit being shown in opening condition for the positioning thereof on the textile head of the knitting machine.

For transferring the stitches from the removal members (70) to the transfer members (84) provision is made for means pushing the stitches from unit (7) of removal members (70) towards the unit of transfer members (84), with a tubular body (77), formed in one piece as illustrated in FIGS. 1–15 and 18–29 or in a plurality of separate elements (770) as illustrated in FIGS. 38–45, being carried by the first unit (7): the said tubular body (77) exhibiting an annular edge (770) oriented towards the removal members (70) and so dimensioned as to push from behind the stitches present therein as a result of either its movement towards the second movable unit (8) (as indicated by the arrow "Q" of FIG. 9 and FIG. 23) or of the movement of unit (8) towards the same body (77) (as indicated by the arrow "QQ" of FIG. 37).

Figure 12:
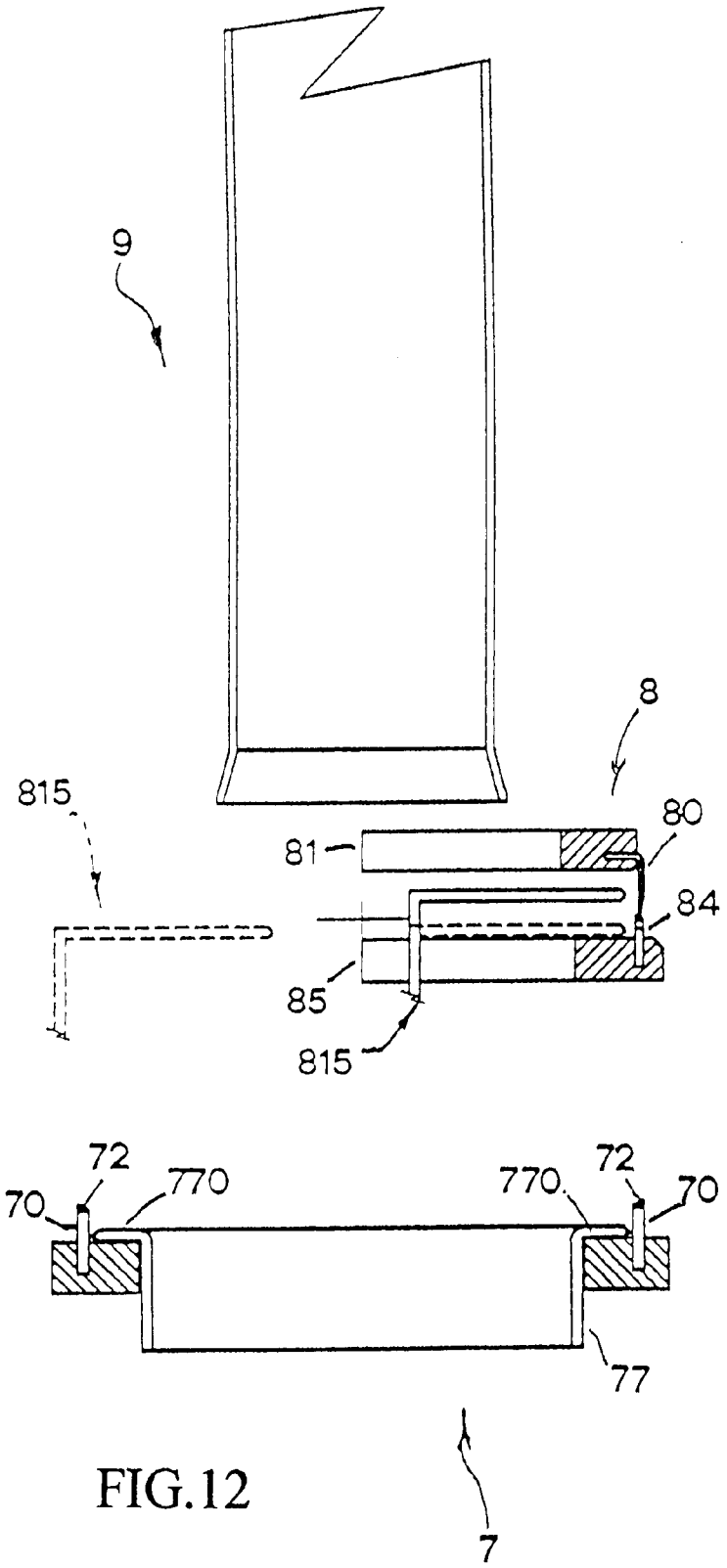
Figure 13:
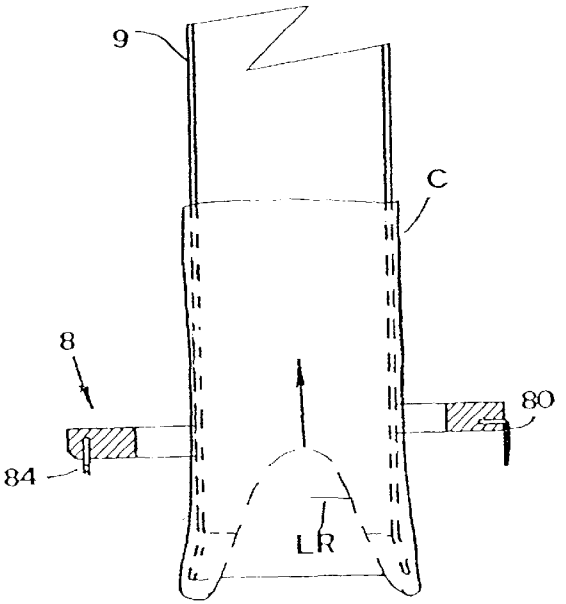
Figure 13:
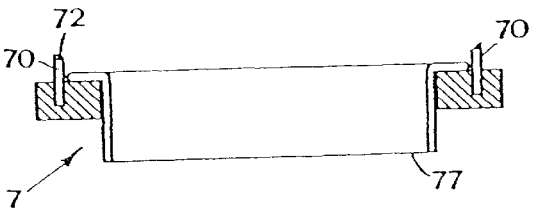
Figure 26:
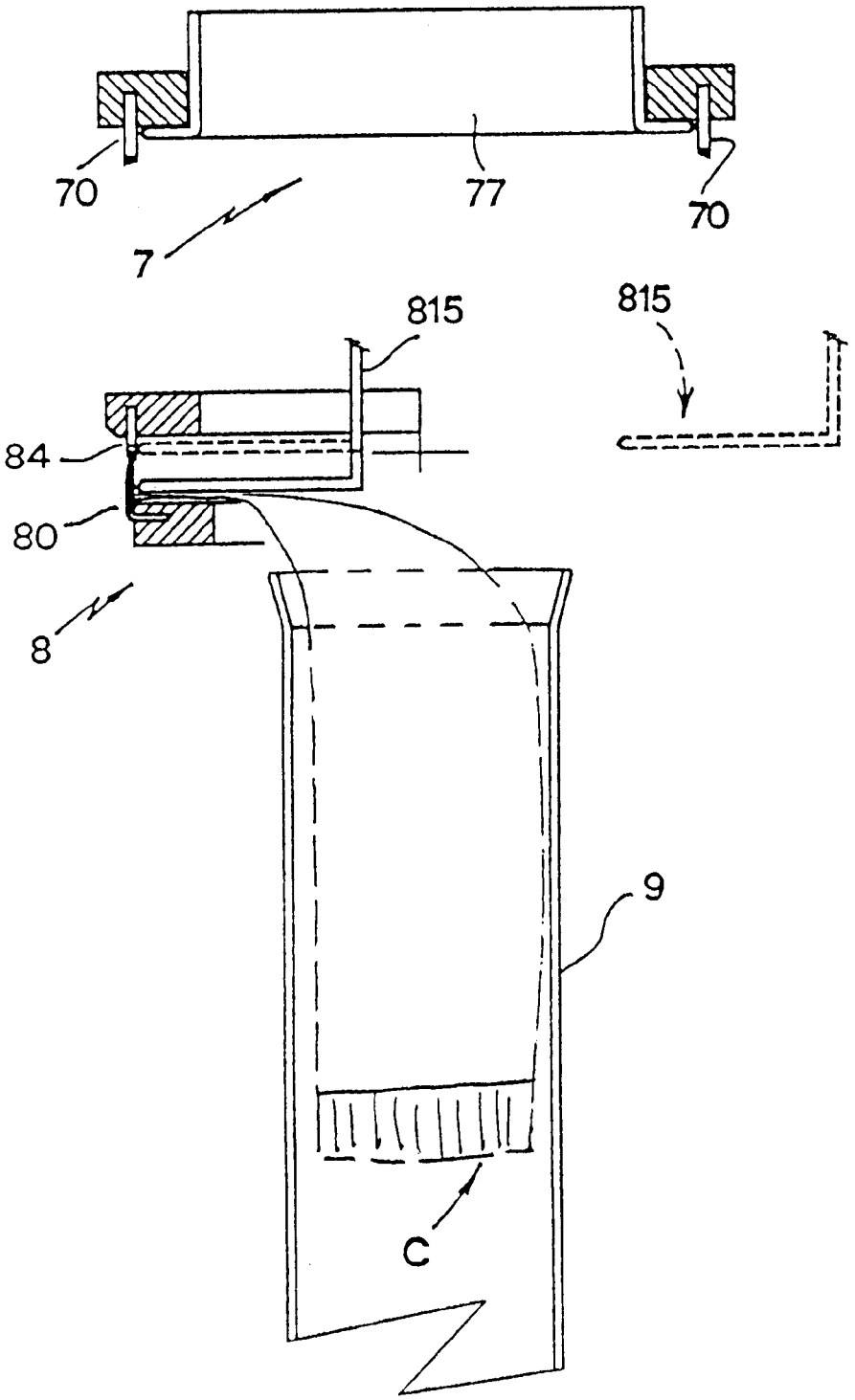

Similarly, to transfer the stitches from the transfer members (84) to the spikes (80) of unit (8), use can be made of a semicircular element (815) able to be positioned between the two semicrowns (81, 85) of this unit (as illustrated in FIGS. 12 and 26): the edge of said semicircular element (815) having the function of pushing from behind the stitches of transfer members (84) to allow same stitches to move onto the spikes (80).

The said arms (76) and (82) are suitably associated to corresponding motor-driven members provided with electrical or pneumatic control, not represented in the figures of the attached drawings.

As far as the means for implementing the method so far described with reference to FIGS. 30–45 are concerned, the unit (7) on which the members (70) for the removal of stitches from the article (C)—knitting needles (4) are mounted, comprises two semicircular supports carried by a corresponding driving arm (62) between said stations (T) and (R): the arm (62) being in two elements (60, 600) connected by a vertical pin (66) to allow the vertical separation of said supports under control of an actuator not represented in the drawings. The two elements (60, 600) of arm (62) are both provided with a hole for their hinge-connection to a supporting column (500). Each one of said supports is made up of two semicircular concentric crowns (64, 65) between the facing edges of which the stems of members (70) for the removal of stitches from the knitting needles are housed. The transfer members (84) are mounted on a corresponding support comprising two concentric semicrowns (33, 34) between the facing edges of which the stems of same transfer members (84) are housed, said support being supported at the end of an arm (35) formed by two elements (36, 360) connected by a vertical pin (37) which guides the relative vertical displacement thereof under control of an actuator not shown in the drawing: fixed to the element (360) of arm (35) is the support of transfer members (84), and fixed to the other element (36) is the support of a body (38) having semicircular development and intended to retain the stitches of the second semirank on the members (70) of unit (7), while the transfer members (84) receive the stitches of the first semirank and the changeover of stitches between the transfer members (84) and the spikes takes place, as illustrated in FIGS. 35–40.

The support (50) of spikes (180), on which the stitches are fitted during the hooking-up step, is semicircular and fixed to a corresponding rotary actuator (53) which, in turn, is mounted on a driving arm (51) provided with a hole allowing it to be hinged to said column (500).

It will be appreciated that the method according to the invention may be carried out according to different modes, depending on the type of machine used for knitting the article and on the textile degree to be reached.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. A method for seaming the edges of a tubular knitted article, the method comprising the steps of:

knitting the article in a knitting station to provide a knitted article with a last knitted rank;

removing the stitches of the last knitted rank with a stitches-removing device mounted on a first unit movable between the knitting station and a hook-up station;

subsequent to the step of removing the stitches of the last knitted rank, transferring the stitches of at least one semirank onto a transfer device other than the stitches-removing device;

overturning through 180° a first semirank of stitches about an axis which substantially subdivides the last knitted rank into the first semirank and a second semirank so as to dispose the overturned first semirank of stitches in a stitch position corresponding to the stitches of the second semirank;

supporting the stitches of the at least one semirank during the overturning step with the transferring device;

hooking-up the thus disposed overturned first semirank of stitches in a stitch position corresponding to the stitches of the second semirank.

2. A method according to claim 1, wherein, during the hooking-up of stitches of first and second semiranks, the stitches are supported by the transferring device for the overturning of the first semirank of stitches.

3. A method according to claim 1, wherein said transfer step includes transferring the stitches of the other semirank onto the transfer device so as to support the stitches of first and second semiranks.

4. A method according to claim 1, wherein said transfer step includes directly supporting the stitches of only one semirank.

5. A method according to claim 1, wherein said overturning step is carried out after the transfer of the stitches of first semirank onto corresponding members of a temporary support and then onto overturning step support members of the transferring device.

6. A method according to claim 1, wherein said overturning step is carried out after the transfer of the stitches of first semirank onto corresponding members of a temporary support of a second movable unit, moveable between a hooking-up station and a knitting station and then onto overturning step support members of the transferring device.

7. A method according to claim 1, wherein said article is knitted with a two cylinder circular machine.

8. A method according to claim 1, wherein said article is knitted with a one cylinder circular machine.

9. A method according to claim 1, further comprising turning the article inside out in said hooking-up station and in said knitting station.

10. An apparatus for seaming the edges of a tubular knit article the apparatus comprising:

a knitting station with a circular machine for the preliminary knitting of the article;

a hooking-up station;

a first moveable unit;

a stitch removal device removing the last knitted rank, said stitch removal device being mounted on the first movable unit and moveable between said knitting station and the hooking-up station;

a transferring device transferring the stitches of at least one semirank and for overturning the at least one semirank of stitches through 180° about an axis which substantially subdivides the last knitted rank into a first semirank of stitches and a second semirank of stitches; and a stitch support for supporting the stitches of the first and second semiranks thus disposed for the hooking-up thereof.

11. An apparatus according to claim 10, wherein said stitch removal device for receiving or transferring at least one semirank of stitches, is mounted on a movable unit between said knitting station and said hooking-up station.

12. An apparatus according to claim 10, wherein said stitch removal device for removing the stitches of the last knitted rank comprises a support, a moveable unit and a plurality of stitch-removing elements with a stem associated to the corresponding said unit through said support, said support comprising two concentric circular crowns connected to an arm of the movable unit, and between facing edges of which said stems of said elements are housed angularly equidistant and with a pitch substantially equal to a center distance of the stitches to be removed and a free end of said stitch-removing elements exhibiting a seat for the head of a corresponding needle whereby during stitch-removal, said arm of said moveable unit exhibits, at an end opposite to that for a housing of said stitch-removing elements, a hole to allow said arm to fit on a supporting column which is in turn fitted into a sleeve mounted on a base.

13. An apparatus according to claim 10, wherein the transferring device supporting the stitches during the hooking-up step comprises a moveable unit and a plurality of hook-up spikes fixed to said movable unit by a semicircular support, with two coaxial and overlapping semicrowns between the facing surfaces of which stems of said hook-up spikes are housed angularly equidistant at the end of an arm provided with a hole to allow the fitting thereof into a sleeve mounted on a base.

14. An apparatus according to claim 10, wherein the transferring device for supporting the stitches to be overturned comprises a plurality of bodies with corresponding stems mounted on a semicircular support with two coaxial semicrowns, between the facing surfaces of which the stems of said bodies are fitted angularly equidistant, said bodies being associatable to said stitch removal device for supporting stitches to be overturned.

15. An apparatus according to claim 10, wherein said support of said bodies is provided with a radial appendix connected by a hinge to an external side appendix of an arm, the axis of the hinge being orthogonal to said arm.

16. An apparatus according to claim 15, wherein said support has a radial appendix associated to a rotary actuator whose axis lies on an extension of a diametral axis of said support said axis corresponding, following the rotation of said rotary actuator, to the axis of stitches being overturned.

17. An apparatus according to claim 10, wherein said first movable unit, on which said stitch removal device is mounted, comprises two semicircular supports carried by a corresponding driving arm between said knitting station and said hooking-up station, said arm having two elements connected by a vertical pin to allow vertical separation of said two semicircular supports under control of an actuator acting linearly, said two elements of said arm being provided with a hole for their hinge-connection to a supporting column, and each of said supports being made up of two semicircular concentric crowns between the facing edges of which stems of members for the removal of stitches from the knitting needles are housed.

18. An apparatus according to claim 10, wherein said transferring transferring device means comprise a plurality of bodies mounted on a corresponding support with two semicircular concentric semicrowns having facing edges, and stems housed between the facing edges, and an arm carrying two semicircular at the end of an arm, the arm including two elements connected by a vertical pin which guides the relative vertical displacement thereof under control of an actuator acting linearly, a support of transfer members fixed to one of said elements of said arm and support body having semicircular development fixed to the other of said elements.

19. An apparatus according to claim 10, wherein the stitch support for the hooking-up comprise a plurality of hook-up spikes mounted os a corresponding semicircular support which is fixed to a corresponding rotary actuator which is in turn mounted on a driving arm provided with a hole for its hinge-connection to a column.

* * * * *